US009010212B2

(12) United States Patent
Minami

(10) Patent No.: US 9,010,212 B2
(45) Date of Patent: Apr. 21, 2015

(54) ACCELERATOR PEDAL MALFUNCTION ELIMINATION APPARATUS

(76) Inventor: Heiji Minami, Kawaguchi (JP)

( * ) Notice: Subject to any disclaimer, the term of this patent is extended or adjusted under 35 U.S.C. 154(b) by 0 days.

(21) Appl. No.: 14/123,680

(22) PCT Filed: Jun. 5, 2012

(86) PCT No.: PCT/JP2012/064421

§ 371 (c)(1),
(2), (4) Date: Dec. 3, 2013

(87) PCT Pub. No.: WO2012/169477

PCT Pub. Date: Dec. 13, 2012

(65) Prior Publication Data

US 2014/0109711 A1 Apr. 24, 2014

(30) Foreign Application Priority Data

Jun. 10, 2011 (JP) ..... 2011-130715

(51) Int. Cl.
*G05G 13/00* (2006.01)
*G05G 1/30* (2008.04)

(52) U.S. Cl.
CPC ..... *G05G 13/00* (2013.01); *Y10T 74/20238* (2015.01); *G05G 1/305* (2013.01)

(58) Field of Classification Search
CPC ..... G05G 13/00; G05G 1/305
USPC ..... 74/478, 483 R, 512, 513, 514
See application file for complete search history.

(56) References Cited

U.S. PATENT DOCUMENTS

| | | | | |
|---|---|---|---|---|
| 7,395,734 | B2 * | 7/2008 | Fujiwara et al. | 74/516 |
| 8,783,130 | B2 * | 7/2014 | Sakaguchi et al. | 74/513 |
| 2012/0279347 | A1 * | 11/2012 | Schmitt et al. | 74/513 |

FOREIGN PATENT DOCUMENTS

| | | |
|---|---|---|
| JP | 2002-178782 | 6/2002 |
| JP | 2002-287839 | 10/2002 |
| JP | 2003-195962 | 7/2003 |
| JP | 2004-210100 | 7/2004 |
| WO | WO 2005/058631 | 6/2005 |

OTHER PUBLICATIONS

International Search Report of PCT/JP2012/064421 (2 pages).

* cited by examiner

*Primary Examiner* — Thomas R. Hannon
*Assistant Examiner* — Adam D Rogers
(74) *Attorney, Agent, or Firm* — Flynn, Thiel, Boutell & Tanis, P.C.

(57) ABSTRACT

An accelerator pedal operation error resolution device has a stepping force conversion pendant body which depends from a pendant pin of a support pillar which is anchored to a brake arm, supporting a first rising member with a fluctuation fulcrum pin and a second rising member with an acceleration fulcrum pin. The stepping force conversion pendant body movably supports a guide member, one end wherein makes contact with a chassis. A conversion metal fitting houses the pendant pin in the upper part thereof, and has, in the lower protrusion part, a pin and a lock metal fitting. The lock metal fitting and a notch part of the guide member are either engaged or disengaged. When the guide member and the lock metal fitting are engaged, the movement of the brake arm is restricted, and is allowed when these are disengaged.

17 Claims, 47 Drawing Sheets

ACCELERATOR PEDAL MALFUNCTION ELIMINATION APPARATUS

BACKGROUND

1. Technical Field

The present invention relates to an apparatus including a brake function in an accelerator pedal so that an accident is not caused even if a misstep of a brake and an accelerator is made due to an operational error while driving a motor vehicle, and in particular, relates to an accelerator pedal malfunction elimination apparatus that enables a driving operation by an accelerator pedal only and eliminates accidents due to a malfunction.

2. Related Art

A driving operation is performed by alternately stepping on an accelerator pedal and a brake pedal when a motor vehicle is driven, but if a misstep is made, a grave accident could be caused and thus, it is extremely important to drive a motor vehicle by being careful so as not to make a misstep.

However, if the accelerator pedal is stepped on due to a malfunction, the driver may be upset and further step on the accelerator pedal and thus, various accelerator pedal malfunction elimination apparatuses to eliminate such a malfunction have been proposed. Conventional accelerator pedal malfunction elimination apparatuses have, for example, a structure described in JP 5-185862 A (pages 4-5, FIGS. 1-2).

The accelerator pedal malfunction elimination apparatus described in JP 5-185862 A has an accelerator pedal stepping force transmission member including an accelerator linking mechanism linked to a wire operating plate onto which an accelerator wire is locked or unlinked therefrom at a tip of an accelerator rod including an accelerator pedal and also includes a brake arm that performs a braking operation via a rotary movement by having a brake pedal fixed to one end thereof and the other end attached to a pivot, wherein a pedal linking mechanism that, while connecting the brake arm and the accelerator pedal stepping force transmission member, converts a further stepping force of the accelerator pedal into stepping of the brake pedal after transmission of a stepping force being released is included.

The pedal linking mechanism in the conventional accelerator pedal malfunction elimination apparatus includes a motion conversion mechanism that converts a rocking motion of the accelerator pedal provided in an approximate center portion of the accelerator rod into a rotary movement, a mechanism that makes a motion when the accelerator pedal is further stepped on from a certain position via the motion conversion mechanism, and a brake arm to which the mechanism is pivotally attached.

In the conventional accelerator pedal malfunction elimination apparatus, when the accelerator pedal is further stepped on from a certain position, the accelerator linking mechanism is released to slacken the tension of the accelerator wire and also the brake pedal is slightly stepped on via the motion conversion mechanism.

Thus, when the accelerator pedal is stepped on by exceeding a certain position, the conventional accelerator pedal malfunction elimination apparatus achieves an effect of returning an accelerator to low r.p.m. and applying a brake without requiring any special operation while the accelerator pedal is maintained in a stepped-on state.

However, the conventional accelerator pedal malfunction elimination apparatus operates the brake pedal by displacement of a transverse lever fixed to an approximate center portion of the accelerator rod constituting the motion conversion mechanism and the action of an interlocking link attached to the brake arm and thus, a displacement distance of the transverse lever is short and a braking effect thereof is extremely limited.

That is, the conventional accelerator pedal malfunction elimination apparatus is only configured to avoid a malfunction in a very initial stage of the malfunction of the accelerator pedal and is intended to brake a motor vehicle by, after the malfunction of the accelerator pedal being noticed, avoiding the malfunction and at the same time, performing an initial braking operation and then performing an original braking operation.

Therefore, if the driver is upset and cannot switch to the brake pedal, a sufficient deceleration and braking action cannot be performed.

The invention is made to resolve the above problem of a conventional accelerator pedal malfunction elimination apparatus and an object thereof is to provide an accelerator pedal malfunction elimination apparatus capable of braking a motor vehicle and exerting brake control reliably only by an accelerator pedal being stepped on even if the driver is upset and cannot switch to the brake pedal.

Another object thereof is to provide an accelerator pedal malfunction elimination apparatus capable of performing a motor vehicle driving operation only by a stepping operation of an accelerator pedal, performing normally a conventional driving operation without requiring a special switching operation, performing start or accelerated driving by the accelerator pedal being stepped on, applying a brake or stopping the motor vehicle by further stepping on the pedal and adjusting a stepping force with the driver's intention to apply a brake or stop the motor vehicle, and restoring an initial state of the accelerator by releasing the stepping force.

Still another object thereof is to provide an accelerator pedal malfunction elimination apparatus capable of, even if an accelerator pedal is erroneously stepped on, stopping a motor vehicle more swiftly and reliably than switching to step on a brake pedal based on the driver's intention of stopping the motor vehicle.

SUMMARY

To solve the above problem, an accelerator pedal malfunction elimination apparatus according to the invention is an accelerator pedal malfunction elimination apparatus having a brake arm having a brake pedal fixed to one end and the other end attached to a pivot to perform a braking operation by rotary movement, an accelerator pedal stepping force transmission member having an accelerator pedal fixed to one end, a rocking fulcrum pin loosely inserted into an intermediate portion, and an accelerator wire locked onto the other end, an accelerator linking mechanism constituting a portion of the accelerator pedal stepping force transmission member to transmit a stepping force to the accelerator wire or to release transmission thereof, and a pedal linking mechanism that converts a further stepping force of the accelerator pedal into stepping on the brake pedal after the transmission of the stepping force being released, wherein the brake arm includes a fitting springing out from a neighborhood of an arm bent portion to a side of the accelerator pedal stepping force transmission member, a pillar body fixed to the fitting and having a suspension pin laterally placed in an upper portion thereof, and a stepping force conversion suspended body suspended from the suspension pin and having the rocking fulcrum pin placed laterally in a protruding portion on a pedal side at a lower end of the suspended body, the accelerator pedal stepping force transmission member includes a first rising member rotatably attached via the rocking fulcrum pin and to which a return spring to return to an initial position when the accelerator pedal is released is annexed and a second rising member whose base end is rotatably attached to the side opposite to a pedal at the lower end of the stepping force conversion suspended body and having an accelerator wire locked onto the upper end, the accelerator linking mechanism includes an accelerator linking member provided in the intermediate portion of the second rising member and a movable member annexed to the first rising member to be locked onto or unlocked from the accelerator linking member in accordance with a rotation angle of the first rising member, and the pedal linking mechanism includes a guide member through which the stepping force conversion suspended body is inserted and having one end abutting on a wall, a linking connection member connecting the suspension pin and the first rising member to link both in accordance with the rotation angle of the first rising member, a conversion fitting supported by a bearing provided in the intermediate portion of the stepping force conversion suspended body, a conversion fitting rotating member capable of rotating the conversion fitting by abutting on the conversion fitting when the linking connection member rotates, and a lock fitting rotatably suspended from the conversion fitting to allow a lower locking portion to be locked onto or unlocked from a notch portion of the guide member.

The fitting and the pillar body support all members of the accelerator pedal stepping force transmission member. The stepping force conversion suspended body is configured to be installed side by side with the pillar body, has both side surfaces in an inverse T shape or an inverse L shape, and loosely inserts a rocking fulcrum pin into a protruding portion on a pedal side at a lower end of the suspended body and an accelerator fulcrum pin protruding from the base end of the second rising member to the opposite side of the pedal.

The first rising member is a portion of a rocking member having a side face in a "⌃" shape to fix the accelerator pedal to an end and rotatably locks a bent portion of the rocking member by using the rocking fulcrum pin. The guide member is a member that, when the lock fitting abutting on the guide member is locked onto the notch portion, suppresses displacement of the conversion fitting, the stepping force conversion suspended body, the pillar body, and further the brake arm when the accelerator pedal is stepped on and when the lock fitting is unlocked from the notch portion, enables displacement thereof. The lock fitting is positioned on the wall side of the rear surface of the stepping force conversion suspended body.

The conversion fitting is fixed to an axis and is configured to be able to rotate around the bearing of the stepping force conversion suspended body. When the accelerator pedal is stepped on, the first rising member attempts to rock around the rocking fulcrum pin, but the position of the rocking fulcrum pin is not fixed and so the stepping force pushes the stepping force conversion suspended body to the wall side via the rocking fulcrum pin and the pillar body and the brake arm linked thereto also attempt to rotate.

On the other hand, the conversion fitting, and the lock fitting and the guide member linked thereto are connected to the stepping force conversion suspended body and if the accelerator pedal is stepped on while the lock fitting is locked onto the notch portion of the guide member, the stepping force conversion suspended body is pushed to the wall side to abut on the lock fitting. The lock fitting is sandwiched between the notch portion and the stepping force conversion suspended body and at this point, a load in the direction of the wall acts on the guide member, but the tip thereof abuts on the wall and cannot be displaced and thus, the displacement of the lock fitting is also suppressed.

Therefore, the displacement of the conversion fitting, the stepping force conversion suspended body, the pillar body, and the brake arm is suppressed and the position of the rocking fulcrum pin becomes fixed, thereby realizing rocking of the first rising member around the rocking fulcrum pin Accordingly, the second rising member rotates in synchronization until the accelerator pedal is stepped on halfway via the accelerator linking member and the movable member as an accelerator linking mechanism. When unlocking of both occurs, the second rising member is brought back to its initial position by a tensile force of the accelerator wire and also stops supplying the fuel. Incidentally, both are not unlocked in the normal stepping range of the accelerator pedal and the unlocking occurs only in a region close to the maximum stepping. At this point, the accelerator wire returns and thus, abrupt starting and abrupt acceleration are suppressed.

When the accelerator pedal is stopped being stepped on, the first rising member is brought back to its initial position by the action of the return spring and at this point, the accelerator linking member and the movable member are closer and abut on each other. The abutting force displaces the movable member and both are locked to change to their initial state.

On the other hand, if the accelerator pedal is further stepped on after unlocking of the first rising member from the second rising member occurs, the first rising member is further rocked around the rocking fulcrum pin. If the linking connection member provided at the upper end of the first rising member rotates, the conversion fitting rotating member abuts on the conversion fitting to rotate the conversion fitting. The start thereof is configured to be the time when the accelerator linking member is unlocked from the movable member.

When the conversion fitting rocks in synchronization with the first rising member, the conversion fitting starts to rotate around the bearing of the stepping force conversion suspended body and lifts the lock fitting suspended to the lower end of the conversion fitting. At this point, no load acts on the guide member in the direction of the wall.

If the accelerator pedal is further stepped on, the suspension pin is displaced in synchronization with the rotation of the linking connection member, the first rising member, the pillar body, and the brake arm start to perform an integrated operation. That is, stepping on the accelerator pedal further means stepping on the brake pedal and the brake pedal is stepped on in accordance with a force to step on the accelerator pedal to achieve reliable braking.

The guide member is configured not to block the displacement of the first rising member, the conversion fitting, the stepping force conversion suspended body, and the pillar body. For example, the guide member is configured to have a shape corresponding to the locus of the first rising member or the like around the pivot or configured such that one end thereof slides or rolls on the wall surface in accordance with motion of the first rising member or the like.

When stepping on the accelerator pedal is stopped, the first rising member is brought back to its initial position and thus, the connection between the linking connection member, and the suspension pin and the conversion fitting rotating member is cut and the conversion fitting, the stepping force conversion suspended body, the pillar body, the brake arm, and the brake pedal return to their initial positions. The lock fitting also descends and the lower locking portion abuts on the notch portion of the guide member to be locked, which suppresses displacement of the stepping force conversion suspended body and the like.

The guide member of the accelerator pedal malfunction elimination apparatus according to a second aspect is characterized in that the guide member includes a spring supported displaceably with respect to the stepping force conversion suspended body and energizing to the side of the wall and has a tip portion that can be displaced while abutting on a surface of the wall.

The guide member is perpendicular to the stepping force conversion suspended body and always abuts on the wall due to an elastic force of the spring. When the lock fitting abuts on the notch portion, upward motion of the guide member is suppressed, but when unlocking occurs, the stepping force conversion suspended body starts to rotate and the guide member supported thereby also rotates and the tip portion thereof can be displaced along the wall.

When stepping on the accelerator pedal is stopped, the stepping force conversion suspended body returns to its initial position and the guide member also returns to its initial position to be locked.

The accelerator linking mechanism of the accelerator pedal malfunction elimination apparatus according to a third aspect is characterized in that the accelerator linking mechanism includes the accelerator linking member including a linking claw protruding to the side of the first rising member, the movable member including a locking pin capable of appearing and disappearing with respect to the linking claw by being energized in a direction of the linking claw, and a locking pin pushing portion capable of pressing and displacing the locking pin in accordance with the rotation angle of the first rising member.

The locking portion of the linking claw of the locking pin as the movable member has a shape allowing the abutting portion thereof to be displaced when rotating after being locked onto the linking claw and to be unlocked in a predetermined position. The locking pin pushing portion pushes the locking pin when pressing by abutting on the locking pin or a member fixed to the locking pin and returns the locking pin to its initial state when isolated.

The locking pin presents a locked state by protruding after sinking by abutting on the linking claw when the first rising member returns to its initial position.

The pedal linking mechanism of the accelerator pedal malfunction elimination apparatus according to a fourth aspect is characterized in that the pedal linking mechanism includes the linking connection member including a ring member having one end fixed to the locking pin and a long hole formed on the side of the other end, the conversion fitting provided with a crotch portion as a rotation stopper in an upper portion by accommodating the suspension pin to suppress rotation around the bearing, and the conversion fitting rotating member that inserts a brake pin protruded in the intermediate portion of the conversion fitting into the long hole and the locking pin pushing portion is formed in the ring member.

When rocking around the rocking fulcrum pin of the first rising member is realized after the accelerator pedal being stepped on and the ring member of the linking connection member provided at the upper end of the first rising member rotates, the ring member abuts on the brake pin as the conversion fitting rotating member to rotate the conversion fitting. One inner surface of the long hole is configured so as to abut on the brake pin when the first rising member rotates and the accelerator linking member is unlocked from the movable member. If the abutting state continues, the pedal linking mechanism acts and if the abutting state disappears, the braking force also decreases and disappears.

If the conversion fitting rocks in synchronization with the first rising member, the conversion fitting starts to rotate around the bearing of the stepping force conversion suspended body and lifts the lock fitting, the lower locking portion is unlocked from the notch portion of the guide member, and no load acts on the guide member in the direction of the wall.

If the accelerator pedal is further stepped on after unlocking of the first rising member from the second rising member occurs, the first rising member is further rocked around the rocking fulcrum pin and the conversion fitting also continues to rotate around the bearing. At this point, if one of the above crotch portion as a rotation stopper abuts on the suspension pin, the crotch portion becomes unable to rotate and the action of the conversion fitting is transmitted to the stepping force conversion suspended body. That is, the first rising member, the conversion fitting, the stepping force conversion suspended body, the pillar body, and the brake arm start to perform an integrated operation and stepping on the accelerator pedal further means stepping on the brake pedal and the brake pedal is stepped on in accordance with a force to step on the accelerator pedal to achieve reliable braking.

When stepping on the accelerator pedal is stopped, the first rising member is brought back to its initial position and thus, the connection between the linking connection member and the conversion fitting intermediate portion is cut and the conversion fitting, the stepping force conversion suspended body, the pillar body, the brake arm, and the brake pedal return to their initial positions. The lock fitting also descends and the lower locking portion abuts on the notch portion of the guide member to be locked, which suppresses displacement of the stepping force conversion suspended body and the like.

The locking pin pushing portion of the accelerator pedal malfunction elimination apparatus according to a fifth aspect is characterized in that the locking pin pushing portion comprises a bent portion forming a free end side of the ring member and an upper inner surface of the pillar body capable of abutting on the bent portion.

The bent portion of the ring member fixed to the locking pin is bent toward the upper inner surface of the pillar body and if the first rising member is rocked when the accelerator pedal is stepped on, both abut on each other to push in the locking pin and when the first rising member is brought back to its initial position after stepping on the accelerator pedal is stopped, both are separated from each other to return the locking pin to its initial position.

The pillar body of the accelerator pedal malfunction elimination apparatus according to a sixth aspect is characterized in that the pillar body has a supporting plate including a horizontal portion and an inclined rising portion protruding downward and the lock fitting includes a leg capable of rolling on the supporting plate below the lower locking portion suspended from the lower end of the conversion fitting.

The supporting plate and the leg of the lock fitting simultaneously rotate the lock fitting, the conversion fitting, the stepping force conversion suspended body, and the first rising member by matching motion of the brake arm and the pillar body when the brake pedal is stepped on. The supporting plate springs out to the side of each pedal and, and when the brake pedal is stepped on, the pillar body rotates and the inclined rising portion of the supporting plate acts in the direction in which the leg of the lock fitting is pushed up.

The lock fitting rotates the conversion fitting in the same direction and thus, the stepping force conversion suspended body and the first rising member and also the second rising member rotate in the same direction. The accelerator pedal also rotates, but does not rotate around the rocking fulcrum pin and so the accelerator wire is not pulled. That is, only the braking force of the brake pedal acts.

At this point, the brake pedal and the accelerator pedal are rotated in synchronization and thus, the relative position thereof is approximately the same as the initial state thereof.

The rotation stopper of the accelerator pedal malfunction elimination apparatus according to a seventh aspect is characterized in that the rotation stopper is a protruding body protruding to the side of the wall of the stepping force conversion suspended body and capable of abutting on the wall of the protruding portion at the lower end of the conversion fitting.

The pedal linking mechanism of the accelerator pedal malfunction elimination apparatus according to an eighth aspect is characterized in that the pedal linking mechanism includes the linking connection member including a first ring member having one end fixed to the locking pin and a long hole formed on the side of the other end through which the suspension pin is inserted, the conversion fitting that energizes an axis to which a crossing portion of a horizontal portion from whose tip the lock fitting is suspended and a blade rising portion set up at a rear end thereof is fixed to rotate in a direction of the notch portion of the guide member, and a conversion fitting rotating member including a blade pushing member protruding from the lower portion of the first ring member and capable of abutting on a tip of the blade rising portion, and the locking pin pushing portion is annexed to the first ring member.

When rocking around the rocking fulcrum pin of the first rising member is realized after the accelerator pedal being stepped on and the first ring member of the linking connection member provided at the upper end of the first rising member rotates, the blade pushing member as a conversion fitting rotating member protruding downward abuts on the tip of the blade rising portion of the conversion fitting to rotate the conversion fitting.

When the conversion fitting rocks in synchronization with the first rising member, the conversion fitting starts to rotate around the bearing of the stepping force conversion suspended body and lifts the lock fitting to allow the lower locking portion to be unlocked from the notch portion of the guide member and no load acts on the guide member in the direction of the wall.

If the accelerator pedal is further stepped on after unlocking of the first rising member from the second rising member occurs, the first rising member is further rocked around the rocking fulcrum pin and the first ring member of the linking connection member also continues to rotate. At this point, one inner surface of the long hole abuts on the suspension pin and if this abutting state continues, the pedal linking mechanism acts and the first rising member, the pillar body, and the brake arm performs an integrated operation and further stepping on the pedal means stepping on the brake pedal so that the brake pedal is stepped on in accordance with a force to step on the accelerator pedal to achieve reliable braking.

When stepping on the accelerator pedal is stopped, the first rising member is brought back to its initial position and thus, the connection between the linking connection member and the suspension pin is cut, the conversion fitting, the stepping force conversion suspended body, the pillar body, the brake arm, and the brake pedal return to their initial positions, and the braking force also decreases and disappears. The lock fitting also descends and the lower locking portion abuts on the notch portion of the guide member to be locked, which suppresses displacement of the stepping force conversion suspended body and the like.

The locking pin pushing portion of the accelerator pedal malfunction elimination apparatus according to a ninth aspect is characterized in that the locking pin pushing portion includes an upper locking pin pushing portion including a springing portion formed on a free end side of the first ring member and an upper inner surface of the stepping force conversion suspended body capable of abutting on the springing portion and an internal locking pin pushing portion rotatably supports an axial body protruding from the intermediate portion of a columnar body whose lower end is rollable with respect to a side protruding plate formed on the guide member and whose upper end is slidingly displaceable on the first ring member by the stepping force conversion suspended body, an elastic body energizing the upper end to rotate to an outer side being wound around the axial body.

The springing portion of the ring member fixed to the locking pin springs out while being inclined toward the upper inner surface of the stepping force conversion suspended body and if the first rising member is rocked when the accelerator pedal is stepped on, the upper locking pin pushing portion and the springing portion abut on each other to push in the locking pin and when the first rising member is brought back to its initial position after stepping on the accelerator pedal is stopped, both are separated from each other to return the locking pin to its initial position.

The internal locking pin pushing portion is a member in a substantial T shape made rotatable around the axial body, the upper end of the columnar body is energized by an elastic body wound around the axial body to rotate to the outer side and the lower end is energized to rotate to the inner side, a rolling member at the lower end is in contact with the guide member, and the upper end is in contact with the first ring member. If the relative position of the member in the substantial T shape and the guide member changes and the rolling member at the lower end abuts on the side protruding plate formed on the guide member, the upper end rotates to the inner side to push in the first ring member. Thus, the locking pin is pushed in and unlocking of the first rising member from the second rising member occurs.

The upper locking pin pushing portion and the internal locking pin pushing portion may simultaneously act to push in the locking pin, but each may act individually.

The locking pin pushing portion of the accelerator pedal malfunction elimination apparatus according to a tenth aspect is characterized in that the locking pin pushing portion has an L-shaped body adjacent to a crossing portion of the conversion fitting whose upper end is fixed to the axis and having a tapered protruding surface formed at the lower end installed side by side and the tapered protruding surface abuts on the lower end of the columnar body during rotation of the axis.

The locking pin pushing portion includes, in addition to the upper locking pin pushing portion and the internal locking pin pushing portion in a substantial T shape, an internal locking pin pushing portion in a substantial L shape. When the conversion fitting rotates, the internal locking pin pushing portion in a substantial L shape causes the tapered protruding surface to abut on the rolling member at the lower end of the columnar body of the internal locking pin pushing portion in a substantial T shape accompanying the rotation.

That is, when the conversion fitting rotates, the L-shaped body rotates the columnar body in a substantial T shape to push in the first ring member and also the locking pin to cause unlocking of the first rising member from the second rising member.

The upper locking pin pushing portion, the internal locking pin pushing portion in a substantial T shape, and the internal locking pin pushing portion in a substantial L shape may simultaneously be displayed to push in the locking pin, but each may act individually.

The pillar body of the accelerator pedal malfunction elimination apparatus according to an eleventh aspect is characterized in that the pillar body has a coupling member in a bar shape annexed below, the conversion fitting has a suspended member adjacent to the crossing section whose upper end is fixed to the axis installed side by side, a horizontal member is connected to the lower end of the suspended member displaceably in a horizontal direction, and the horizontal member and the coupling member are linked by a pin.

The coupling member, the horizontal member, and the suspended member simultaneously rotate the conversion fitting, the lock fitting, the stepping force conversion suspended body, and the first rising member by matching motion of the brake arm and the pillar body when the brake pedal is stepped on. When the brake pedal is stepped on, the pillar body rotates to pull out the coupling member and the horizontal member, thereby rotating the suspended member diagonally to the front to rotate the conversion fitting.

When the conversion fitting rotates, the leg of the lock fitting is lifted, the lower locking portion is unlocked from the notch portion of the guide member, and no load acts on the guide member in the direction of the wall. If the brake pedal is stepped on in this state, the action of pulling the suspended member by the rotation of the pillar body is added and further a pulling force in the direction acts on the axis fixing the conversion fitting and the guide member pivotally supporting the axis and therefore, the guide member in a direction in which the pedal side is pushed down and the wall side is rises.

At this point, the stepping force conversion suspended body, the first rising member, and the second rising member rotate in the same direction and also the accelerator pedal rotates, but does not rotate around the rocking fulcrum pin and thus, the accelerator wire is not pulled. That is, only the braking force of the brake pedal acts.

When the L-shaped body is installed side by side with the axis of the conversion fitting, displaceability of the guide member is realized by the rotation of the conversion fitting and at the same time, the L-shaped body rotates the columnar body of the internal locking pin pushing portion in a substantial T shape to push in the first ring member and also the locking pin to cause unlocking of the first rising member from the second rising member.

That is, when the brake pedal is stepped on, the second rising member is brought back to its initial position by a tensile force of the accelerator wire. Therefore, if the accelerator pedal is erroneously stepped on when the brake pedal should be stepped on, no fuel is supplied.

The stepping force conversion suspended body of the accelerator pedal malfunction elimination apparatus according to a twelfth aspect is characterized in that the stepping force conversion suspended body is provided with a stopper that abuts on the pillar body on the side of the wall.

While a rotary force when the brake pedal is stepped on initially acts on the coupling member and the like, but when the pillar body abuts on the stopper due to the displacement, the rotary force of the brake arm and the pillar body acts on the stepping force conversion suspended body so that the concentration of load on the conversion fitting can be avoided.

The pillar body of the accelerator pedal malfunction elimination apparatus according to a thirteenth aspect is characterized in that the pillar body is provided with a springing portion whose cross section is like sawteeth on an upper side, a pedal linking pin body is laterally installed displaceably in an axial direction below the locking pin of the first rising member, an elastic body fixing bar body arranged in parallel on an outer side of the first ring member and energizing to the side of the second rising member is wound around the pin body, the bar body is inserted through a long hole provided in the columnar body of the internal locking pin pushing portion, and the pin body forms a tapered tip capable of engaging with the springing portion whose cross section is like sawteeth and is displaceable along a sawtooth inclined plane.

The pedal linking pin body is accommodated on the inner side of the first rising member such that the pin body is laterally displaceable and the tip of the pin body can spring out and the springing portion whose cross section is like sawteeth is disposed on the axial outer side of the pin body. When the upper end of the columnar body of the internal locking pin pushing portion is positioned on the outer side and the lower end thereof is positioned on the inner side, no pressing force acts on the bar body and thus, the tip of the bar body is positioned on the inner side of the first rising member due to the action of the elastic body wound around the pin body.

When the upper end of the columnar body of the internal locking pin pushing portion is rotated to the inner side, the bar body and the pin body are displaced to the side of the springing portion whose cross section is like sawteeth and the tip of the pin body protrudes to the outer side of the first rising member to engage with the springing portion.

If, in this state, the pillar body rotates in the direction in which the brake pedal is stepped on, the first rising member also rotates in synchronization therewith. Also when the accelerator pedal is stepped on in this state, the rotation in which the first rising member is separated from the pillar body is blocked and the pillar body rotates in synchronization with the accelerator pedal so that the brake pedal is stepped on.

When stepping on the accelerator pedal is stopped and the first rising member is rotated in the direction in which the first rising member is brought closer to the pillar body, the pin body is pushed along the sawtooth inclined plane and so the engagement position successively changes and the pin body can be displaced up to the initial position of the first rising member.

The accelerator linking mechanism of the accelerator pedal malfunction elimination apparatus according to a fourteenth aspect is characterized in that the accelerator linking mechanism forms upper and lower springing portions having the locking pin inserted through one end thereof and also the suspension pin inserted on the side of the other end such that a crossing position can vary, a triangular coma capable of overstepping displacement by supporting the suspension pin when the suspension pin is displaced away from the locking pin and by rotation when the suspension pin is displaced closer to the locking pin is disposed in the lower springing portion, and the upper springing portion includes an adjusting plate pushed up when the locking pin is linked by a pin and the suspension pin oversteps by being supported by the triangular coma and an accelerator pedal stepping force adjusting ring including an elastic body holding an outer end of the adjusting plate while energizing to the side of the lower springing portion.

The upper springing portion includes two opposed plates and accommodates the adjusting plate on the inner side thereof. An adjusting screw around which an elastic body is wound is inserted through an outer end of the adjusting plate and the tip of the screw is screwed into the rear end of the lower springing portion. An upward force of the adjusting plate is changed by adjusting the height of screwing of the adjusting screw.

The lower springing portion is provided with a hole in the intermediate portion thereof and accommodates the triangular coma therein. The triangular coma has a vertical angle protruding from the hole and supports a lower outer vertical angle with a pin. An elastic body energizing upward abuts on the bottom surface of an inner vertical angle.

The outer side of the one vertical angle protruding from the hole abuts on a hole wall surface. The relative position of the stepping force adjusting ring and the suspension pin changes depending on the stepping force of the accelerator pedal and when the suspension pin abuts on one vertical angle of the triangular coma and is about to be displaced further to the outer side after the accelerator pedal being stepped on, the triangular coma cannot be displaced to the outer side and thus, the suspension pin is supported by the triangular coma.

The abutting point of the suspension pin and the triangular coma is set immediately unlocking of the first rising member from the second rising member occurs after the locking pin being pushed. If the accelerator pedal is further stepped on, the suspension pin goes up onto the triangular coma and also abuts on the adjusting plate on the top surface to push up the plate. The resistance when pushed up becomes the resistance of the accelerator pedal so that an excessive stepping position of the accelerator pedal can be detected.

If, at this point, the accelerator pedal is further stepped on without loosening, the suspension pin is displaced and also the locking pin is pushed in and unlocking of the first rising member from the second rising member occurs. The suspension pin is displaced to the front of the hole after climbing the triangular coma and separated from the adjusting plate to return to its initial position.

Then, if the accelerator pedal is eased up and the first rising member is rotated to its initial position, the suspension pin runs in the opposite direction inside the adjusting ring and this time, rotates while pressing one vertical angle of the triangular coma from the outer side to the inner side. Accordingly, the relative position of the stepping force adjusting ring and the suspension pin returns to the initial position thereof. The triangular coma over which the suspension pin have passed is rotated by the elastic body abutting on the inner vertical angle and the outer side of the one vertical angle protruding from the hole is caused to abut on the hole wall surface.

The brake arm of the accelerator pedal malfunction elimination apparatus according to a fifteenth aspect is characterized in that the brake arm includes an auxiliary brake arm attached immediately above the brake pedal and an auxiliary brake pedal installed side by side with the brake pedal by being fixed to a tip of the auxiliary brake arm.

While the accelerator pedal is normally stepped on after switching from the brake pedal, both pedals are too close when both feet are used and thus, the auxiliary brake pedal is annexed in a distant position where it is easier to step.

The brake arm of the accelerator pedal malfunction elimination apparatus according to a sixteenth aspect includes, in addition to the locking pin pushing portion having an L-shaped body adjacent to a crossing portion of the conversion fitting whose upper end is fixed to the axis and having a tapered protruding surface formed at the lower end installed side by side and the tapered protruding surface abutting on the lower end of the columnar body during rotation of the axis, an arched body whose upper portion is fixed to the axis of the conversion fitting and having a lower end abutting on a movable iron core of a solenoid; a stepping operation unit provided on a side of the accelerator pedal; and an operation circuit connecting the stepping operation unit and the solenoid.

The stepping operation unit includes a foot place springing out from the accelerator pedal and a lever member that can be operated by moving the foot and a switch of the operation circuit is turned on to push out the movable iron core of the solenoid. The arched body rotates the conversion fitting and causes the tapered protruding surface of the internal locking pin pushing portion in an L shape to abut on the rolling member at the lower end of the columnar body of the internal locking pin pushing portion to push in the first ring member and also the locking pin so that unlocking of the first rising member from the second rising member occurs.

The brake arm of the accelerator pedal malfunction elimination apparatus according to a seventeenth aspect is characterized in that the brake arm includes an auxiliary brake arm attached immediately above the brake pedal and an auxiliary brake pedal installed side by side with the brake pedal by being fixed to a tip of the auxiliary brake arm and to which a second stepping operation unit is annexed and the second stepping operation unit is connected to the operation circuit.

The second stepping operation unit is operated when the auxiliary brake pedal is stepped on and always disables the accelerator pedal when the auxiliary brake pedal is operated.

An accelerator pedal malfunction elimination apparatus of the invention is provided with a guide member, a linking connection member, a conversion fitting, a conversion fitting rotating member, and a lock fitting as a pedal linking mechanism and connects an upper end of a first rising member constituting an accelerator pedal stepping force transmission member and a suspension pin to link both in accordance with a rotation angle of the first rising member, wherein the accelerator function is disabled when an accelerator pedal is stepped on further from a certain position and a brake pedal is stepped on in accordance with a force with which the accelerator pedal is stepped on without the need to switch to the brake pedal so that brake control can be exerted and reliable braking can be achieved.

Therefore, when switching to the brake pedal is not done after losing oneself, a motor vehicle can be braked only by stepping on the accelerator pedal, which makes the braking time shorter and can exert brake control reliably and prevent accidents. Therefore, a contribution can be made to prevent accidents by novice drivers or elderly drivers.

All members of the accelerator pedal stepping force transmission member are supported by the brake arm and the pillar body and the stepping force conversion suspended body are caused to abut on each other and therefore, after the guide member being unlocked, a stepping force of the accelerator pedal directly becomes stepping of the brake pedal so that the brake works better and braking during a malfunction is made reliable.

An accelerator pedal malfunction elimination apparatus of the invention makes a contribution to preventing serious accidents due to a misstep of pedals by novice drivers immediately after getting a driver's license or old-old persons and also an effect of preventing reckless driving assumed by young people, for example, a roaring start by fully stepping on the accelerator pedal, abrupt acceleration, tailgating, and irritated driving can be expected.

Prevention of unexpected accidents such as rear-end collisions, minor collisions, and traffic accidents resulting in injury or death and secondary serious accidents caused by reckless panic driving after an act of hit-and-run accidents causing property damage or resulting in injury or death can be expected.

The guide member of the accelerator pedal malfunction elimination apparatus according to the second aspect has a tip portion that can be displaced while abutting on a surface of the wall and therefore, the rotation of the stepping force conversion suspended body when unlocked can be made smooth and a linear guide member suffices, which makes the configuration simpler.

The accelerator linking mechanism of the accelerator pedal malfunction elimination apparatus according to the third aspect is provided with a linking claw as an accelerator linking member, a locking pin capable of appearing and disappearing as a movable member, and a locking pin pushing portion and therefore, the configuration of the accelerator linking member can be made smaller and simpler.

The pedal linking mechanism of the accelerator pedal malfunction elimination apparatus according to the fourth aspect is provided with a ring member as a linking connection member forming the locking pin pushing portion, the conversion fitting provided with a crotch portion in an upper portion, and a brake pin as a conversion fitting rotating member and thus, the accelerator pedal is released by the linking connection member, unlocking is caused by the brake pin of the conversion fitting, and a braking operation is performed by the crotch portion of the conversion portion. Therefore, the release of the accelerator pedal, unlocking, and the braking operation can be done by separate members and the start of the braking operation can be adjusted by fine-tuning each action point thereof.

The locking pin pushing portion of the accelerator pedal malfunction elimination apparatus according to the fifth aspect is a bent portion of a ring member and therefore, pushing and restoration of the locking pin can be realized by a simple configuration.

The pillar body of the accelerator pedal malfunction elimination apparatus according to the sixth aspect has a supporting plate protruding downward and the lock fitting includes a leg capable of abutting thereon and therefore, the accelerator pedal can also be rotated in synchronization when the brake pedal is stepped on and the relative position thereof becomes substantially the same as that in the initial state, which makes switching from the brake pedal to the accelerator pedal smooth.

The rotation stopper of the accelerator pedal malfunction elimination apparatus according to the seventh aspect is a protruding body capable of abutting on the conversion fitting and therefore, the rotation can reliably be blocked.

The pedal linking mechanism of the accelerator pedal malfunction elimination apparatus according to the eighth aspect includes the conversion fitting from which the lock fitting is suspended and having a blade rising portion set up and the first ring member of the linking connection member including the blade rising portion as a conversion fitting rotating member and having the locking pin pushing portion annexed thereto and therefore, the conversion fitting and the linking connection member can be separated and reliable braking control can be exerted.

The locking pin pushing portion of the accelerator pedal malfunction elimination apparatus according to the ninth aspect includes an upper locking pin pushing portion and an internal locking pin pushing portion and therefore, the locking pin can also be pushed in other than when the accelerator pedal is excessively stepped on.

The locking pin pushing portion of the accelerator pedal malfunction elimination apparatus according to the tenth aspect has an L-shaped body installed side by side with the conversion fitting and therefore, the locking pin can be pushed in by rotation of the conversion fitting and the locking pin can also be pushed in when the brake pedal is operated.

The pillar body of the accelerator pedal malfunction elimination apparatus according to the eleventh aspect is connected to the conversion fitting and therefore, the conversion fitting, the lock fitting, the stepping force conversion suspended body, and the first rising member can be rotated simultaneously when the brake pedal is stepped on and only the braking force of the brake pedal can be acted on without pulling the accelerator wire.

If the L-shaped body is installed side by side with the conversion fitting, the locking pin is pushed in when the brake pedal is stepped on and therefore, even if the accelerator pedal is erroneously stepped on, no fuel is supplied.

The stepping force conversion suspended body of the accelerator pedal malfunction elimination apparatus according to the twelfth aspect is provided with a stopper that abuts on the pillar body and therefore, the concentration of the rotary force of the brake arm and the pillar body on the conversion fitting can be avoided.

The pillar body of the accelerator pedal malfunction elimination apparatus according to the thirteenth aspect is provided with a springing portion whose cross section is like sawteeth and a pedal linking pin body is provided in the first rising member and therefore, the brake pedal and the accelerator pedal can simultaneously be rotated.

The accelerator linking mechanism of the accelerator pedal malfunction elimination apparatus according to the fourteenth aspect is provided with an accelerator pedal stepping force adjusting ring and therefore, an excessive accelerator pedal stepping position can reliably be detected.

The brake arm of the accelerator pedal malfunction elimination apparatus according to the fifteenth aspect includes an auxiliary brake arm and therefore, a braking operation using both feet can be made easier. When accelerated by stepping on the accelerator pedal, the accelerator function can be eliminated by slightly stepping on the brake pedal using the left foot. Because the accelerator pedal accelerated by the right foot is automatically switched to a brake pedal function, a motor vehicle can be stopped earlier by stepping on both pedals simultaneously without switching to the brake pedal and also accidents can be minimized or prevented.

The accelerator pedal malfunction elimination apparatus according to the sixteenth aspect has a solenoid linked to the accelerator pedal and an arched body abutting thereon provided in the conversion fitting and therefore, unlocking of the first rising member from the second rising member is realized by movement of the foot on the accelerator pedal.

The accelerator pedal malfunction elimination apparatus according to the seventeenth aspect has a second stepping operation unit annexed to the auxiliary brake pedal and therefore, the accelerator pedal can always be disabled when the auxiliary brake pedal is operated

BRIEF DESCRIPTION OF THE DRAWINGS

FIG. 13 is a sectional view showing the principal element side of the accelerator pedal stepping force transmission member of the accelerator pedal malfunction elimination apparatus immediately after the brake pedal being stepped on;

FIG. 14 is a sectional view showing the principal element side of the accelerator pedal stepping force transmission member when the brake pedal is stepped on;

FIG. 27 is an outline side view of the accelerator pedal malfunction elimination apparatus before the accelerator pedal is stepped on;

FIG. 28 is a plan view omitting a portion of the accelerator pedal malfunction elimination apparatus before the accelerator pedal is stepped on;

FIG. 35 is a sectional view showing the principal element side of the accelerator pedal stepping force transmission member of the accelerator pedal malfunction elimination apparatus immediately after the brake pedal is stepped on;

FIG. 39 is a sectional view showing the principal element side of the accelerator pedal stepping force transmission member of the accelerator pedal malfunction elimination apparatus after the brake pedal is stepped on;

FIG. 40 is a sectional view showing the principal element side of an accelerator pedal stepping force adjusting ring before the accelerator pedal is stepped on;

DETAILED DESCRIPTION

Figure 1:
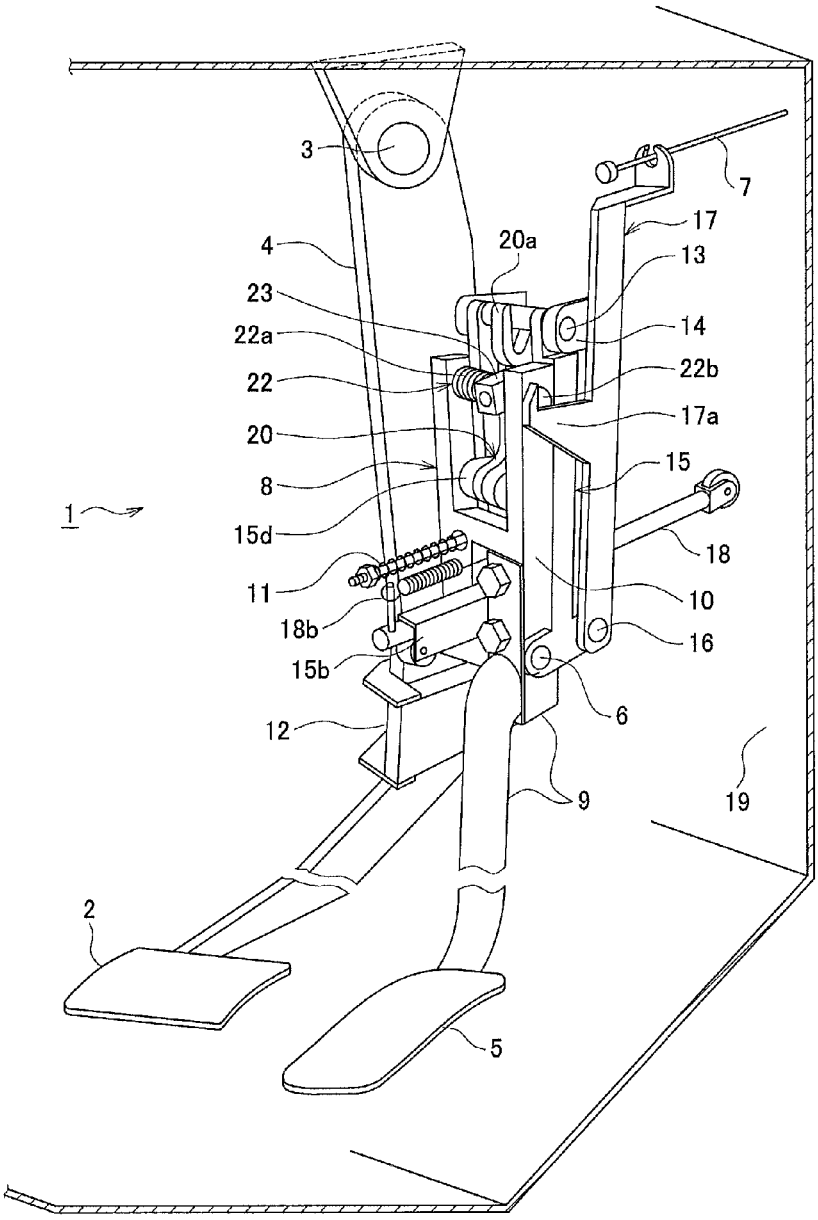
FIG. 1 is a perspective view showing principal elements of an accelerator pedal malfunction elimination apparatus.
Figure 2:
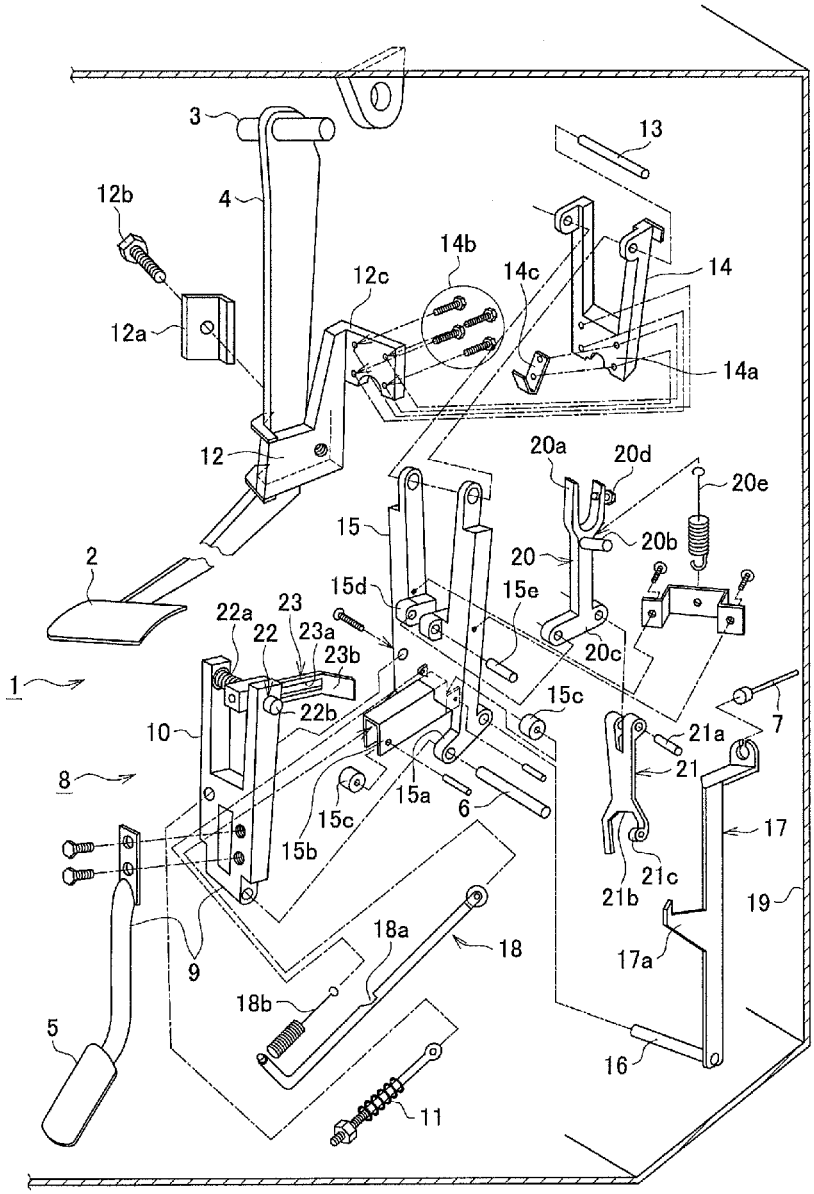
FIG. 2 is an exploded perspective view of the accelerator pedal malfunction elimination apparatus.

Next, embodiments of the invention will be described in detail based on the appended drawings. FIG. 1 is a perspective view showing principal elements of an accelerator pedal malfunction elimination apparatus and FIG. 2 is an exploded perspective view of the accelerator pedal malfunction elimination apparatus. An accelerator pedal malfunction elimination apparatus 1 includes a brake arm 4 having a brake pedal 2 fixed to one end and whose other end is attached to a pivot 3 to perform a braking operation by rotary movement and an accelerator pedal stepping force transmission member 8 having an accelerator pedal 5 attached to one end, a rocking fulcrum pin 6 loosely inserted into an intermediate portion, and an accelerator wire 7 locked onto the other end.

The accelerator pedal stepping force transmission member 8 includes a rocking member 9 fixing the accelerator pedal 5 to one end thereof and having a side face in a "⌒" shape and a bent portion of the rocking member 9 is rotatably locked via the rocking fulcrum pin 6. An upper portion of the bent portion constitutes a first rising member 10 and a return spring 11 is annexed to a lower portion thereof. The return spring 11 has an action to return the first rising member 10 to its initial position after the accelerator pedal 5 is stepped on and released.

The brake arm 4 includes a fitting 12 springing out from the neighborhood of the arm bent portion to the side of the accelerator pedal stepping force transmission member 8. As shown in FIG. 2, a pillar body 14 fixed to the fitting 12 and having a suspension pin 13 laterally placed in an upper portion thereof and a stepping force conversion suspended body 15 as a suspended body rotatably suspended from the suspension pin 13 and having a substantial H front shape, wherein the rocking fulcrum pin 6 is laterally placed at the lower end of the suspended body on the side of a protruded pedal, are connected.

The fitting 12 is secured to the brake arm 4 by using a fixing plate 12*a* and a fixing bolt 12*b* and a lower surface plate 14*a* of the pillar body 14 is tightly bound to an upper springing plate 12*c* by using bolts 14*b*. The pillar body 14 is configured to support all members of the accelerator pedal stepping force transmission member 8 by the suspension pin 13 and the like.

The stepping force conversion suspended body 15 is configured to be installed side by side with the pillar body 14, has both side surfaces in an inverse T shape, and rockably supports the first rising member 10 by loosely inserting the rocking fulcrum pin 6 into one (pedal side) of lower end protruding portions 15*a*. A second rising member 17 having the accelerator wire 7 locked onto the upper end thereof and an accelerator fulcrum pin 16 protruding from the lower end thereof is rotatably attached to the other (opposite to the pedal side) side of the lower end protruding portions 15*a* of the stepping force conversion suspended body 15. The second rising member 17 also constitutes a portion of the accelerator pedal stepping force transmission member 8.

The stepping force conversion suspended body 15 has a guide case 15*b* attached perpendicularly in the center of the lower portion thereof and accommodates a guide member 18 therein. The guide member 18 is a rod in a substantial L shape supported on guide rollers 15*c*, 15*c* inside the guide case 15*b* and has a notch portion 18*a* formed in an intermediate portion and a spring 18*b* attached to the bent tip portion exposed from the guide case 15*b*.

The guide member 18 is inserted through the stepping force conversion suspended body 15 to abut on a chassis 19 via one end thereof and the one end thereof always abuts on the surface of the chassis 19 by the action of the spring 18*b* supported displaceably with respect to the stepping force conversion suspended body and energizing to the chassis 19 side. The other end of the spring 18*b* is fixed to the stepping force conversion suspended body 15.

A bearing 15*d* is provided in an intermediate portion of the stepping force conversion suspended body 15 and a pin 15*e* is inserted therethrough to rotatably support a conversion fitting 20 fixed to the pin 15*e*. The conversion fitting 20 is a plate body in a substantial inverse T shape and includes a crotch portion 20*a* accommodating the suspension pin 13 in the upper portion thereof, a brake pin 20*b* protruding from an intermediate portion thereof, and both protruding portions 20*c* provided at the lower end, and one of the protruding portions 20*c* is supported by the pin 15*e* on the bearing 15*d* and a lock fitting pin 21*a* that rotatably suspends a lock fitting 21 is loosely inserted into the other.

The crotch portion 20*a* plays the role of a rotating stopper and when the pin 15*e* fixing the conversion fitting 20 rotates around the bearing 15*d* and the crotch portion 20*a* abuts on the suspension pin 13, the rotation is blocked. To adjust the rotation stop position, an adjusting screw 20*d* is screwed and attached to the crotch portion 20*a*. In addition, a spring 20*e* is attached to the crotch portion 20*a* on the side of the adjusting screw 20*d* to energize the crotch portion 20*a* on the side opposed to the adjusting screw 20*d* in the direction of the suspension pin 13.

The lock fitting 21 is a plate body in a substantial inverse Y shape and is rotatably suspended from the lower end of the conversion fitting 20 such that a branching portion 21*b* is locked onto or unlocked from the notch portion 18*a* of the guide member 18. The lock fitting 21 includes a leg 21*c* equipped with a roller below the branching portion 21*b*. The leg 21*c* is configured to be able to roll on a supporting plate 14*c* attached to the lower surface plate 14*a* of the pillar body 14. The supporting plate 14*c* includes a horizontal portion and an inclined rising portion.

The guide member 18 is a member that, when the branching portion 21*b* of the lock fitting 21 abutting thereon is locked onto the notch portion 18*a*, suppresses displacement of the conversion fitting 20, the stepping force conversion suspended body 15, the pillar body 14, and further the brake arm 4 while the accelerator pedal 5 is stepped on and, when the branching portion 21*b* of the lock fitting 21 is unlocked from the notch portion 18*a*, enables displacement thereof.

A locking pin 22 as a movable member constituting a portion of the accelerator linking mechanism is protruded from the side of the upper end of the first rising member 10 and a spring 22*a* is wound therearound. A ring member 23 whose one end is fixed to the locking pin 22 abuts on the spring 22*a* and the locking pin 22 and the ring member 23 are energized to the side of the second rising member 17.

A long hole 23*a* inserted through the brake pin 20*b* protruding from the conversion fitting 20 is formed in the ring member 23 and also a bent portion 23*b* is provided at the tip of the ring member 23. The ring member 23 constitutes a linking connection member that connects the upper end of the first rising member 10 and an intermediate portion of the conversion fitting 20 appropriately to link both in accordance with the rotation angle of the first rising member 10.

A linking claw 17*a* in an L shape protrudes from an intermediate portion of the second rising member 17 on the side of the first rising member 10 as an accelerator linking member constituting a portion of the accelerator linking mechanism. A pin tip 22*b* of the locking pin 22 of the first rising member 10 is configured to lock onto the linking claw 17*a* when the accelerator pedal 5 is stepped on and to unlock therefrom. The pin tip 22*b* is obtained by tapering a tip portion of a pillar body section constituting the locking pin 22 to the side of the second rising member 17.

The accelerator linking mechanism transmits a stepping force of the accelerator pedal 5 to the accelerator wire 7 or releases the transmission when the position of the rocking fulcrum pin 6 is immovable. Thanks to the presence of the accelerator linking mechanism, the first rising member 10 and the second rising member 17 rotate in synchronization until the accelerator pedal 5 is stepped on halfway.

When the pin tip 22*b* and the linking claw 17*a* are unlocked, the second rising member 17 is brought back to its initial position by a tensile force of the accelerator wire 7 and also stops supplying the fuel. Incidentally, both are not unlocked in the normal stepping range of the accelerator pedal 5 and the unlocking occurs only in a region close to the maximum stepping.

The position of the rocking fulcrum pin 6 needs to be immovable for the first rising member 10 and the second rising member 17 to be locked and unlocked mutually and if the position of the rocking fulcrum pin 6 is not fixed, that is, the position is movable, a stepping force pushes the stepping force conversion suspended body 15 to the side of the chassis 19 via the movable rocking fulcrum pin 6 when the accelerator pedal 5 is stepped on, which also rotates the pillar body 14 and the brake arm 4 linked thereto around the pivot 3.

Thus, in the accelerator pedal malfunction elimination apparatus 1, the stepping force conversion suspended body 15, the conversion fitting 20, the lock fitting 21, and the guide member 18 are provided to selectively realize an immovable state and a movable state of the position of the rocking fulcrum pin 6.

Figure 3:
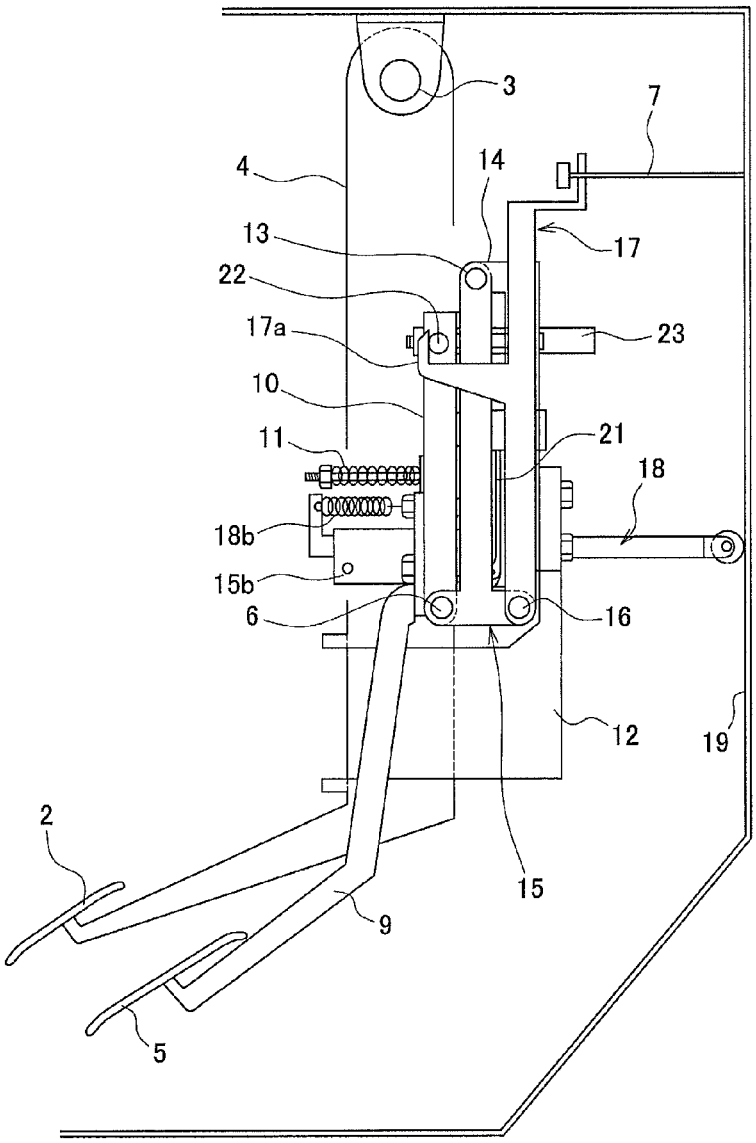
FIG. 3 is an outline side view of the accelerator pedal malfunction elimination apparatus.
Figure 4:
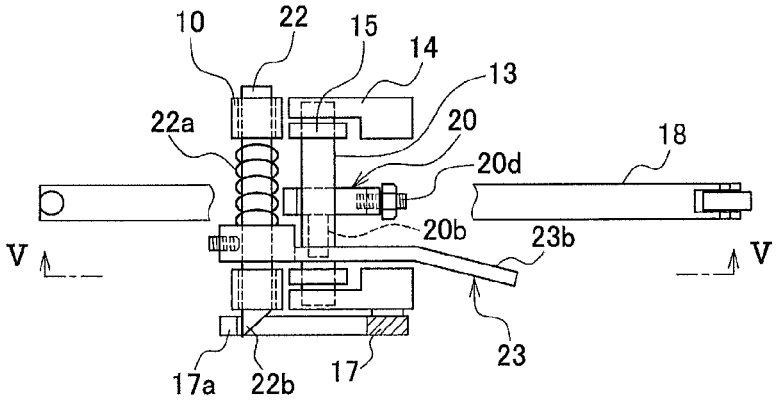
FIG. 4 is a plan sectional view omitting a portion of an accelerator pedal stepping force transmission member of the accelerator pedal malfunction elimination apparatus.
Figure 5:
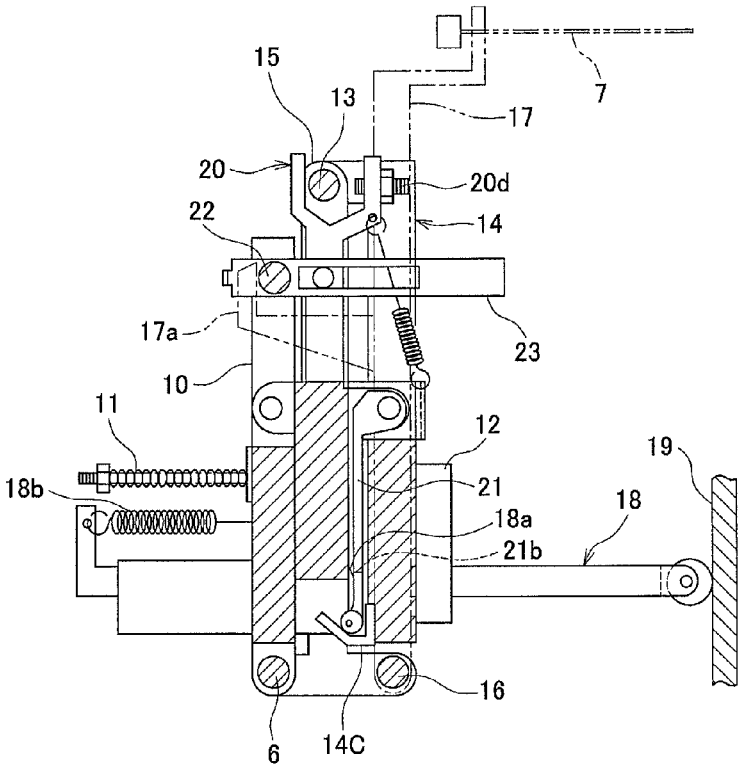
FIG. 5 is a sectional view showing a V-V section of FIG. 4.

Details thereof will be described based on FIGS. 3 to 5. FIG. 3 is an outline side view of the accelerator pedal malfunction elimination apparatus, FIG. 4 is a plan sectional view omitting a portion of an accelerator pedal stepping force transmission member of the apparatus, and FIG. 5 is a sectional view showing a V-V section of FIG. 4.

The conversion fitting 20, and the lock fitting 21 and the guide member 18 linked thereto are connected to the stepping force conversion suspended body 15 and if the accelerator pedal 5 is stepped on while the branching portion 21*b* of the lock fitting 21 is locked onto the notch portion 18*a* of the guide member 18, the stepping force conversion suspended body 15 is pushed to the side of the chassis 19 via the rocking fulcrum pin 6 to abut on the back surface of a suspended portion of the lock fitting 21. The lock fitting 21 is sandwiched between the notch portion 18*a* of the guide member 18 and the stepping force conversion suspended body 15 and at this point, a load in the direction of the chassis 19 acts on the guide member 18, but the tip thereof abuts on the chassis 19 and cannot be displaced and thus, the displacement of the lock fitting 21 is also suppressed.

Therefore, the displacement of the conversion fitting 20, the stepping force conversion suspended body 15, the pillar body 14, and the brake arm 4 is suppressed and the position of the rocking fulcrum pin 6 becomes immovable, thereby realizing rocking of the first rising member 10 around the rocking fulcrum pin 6.

Figure 6:
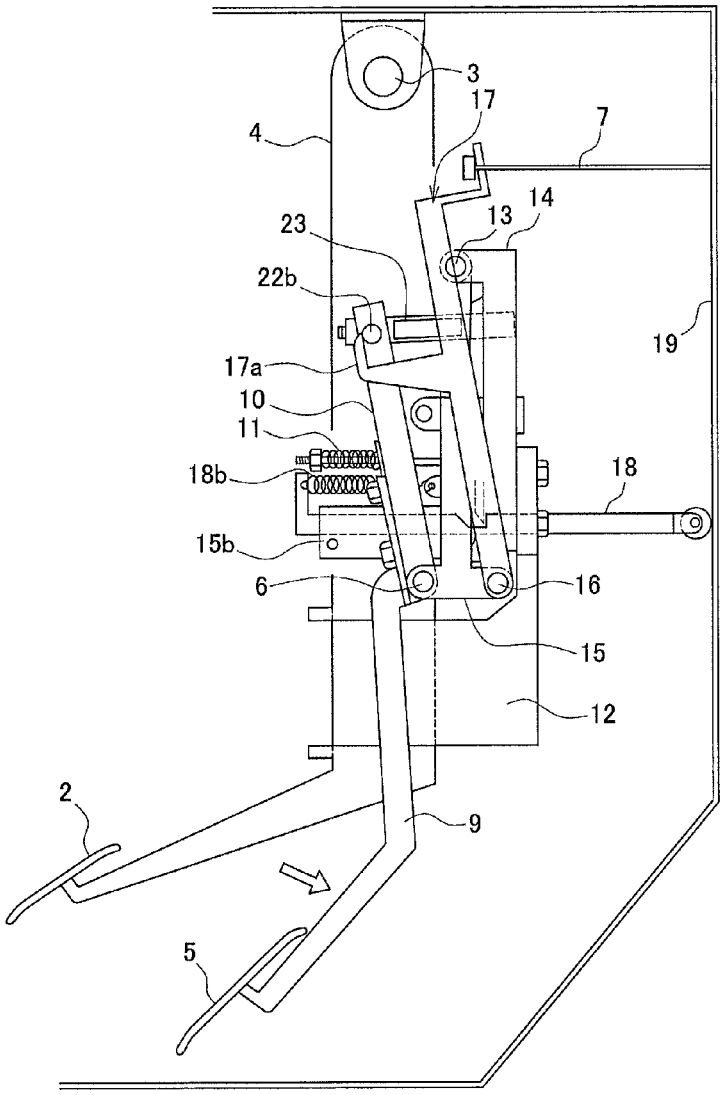
FIG. 6 is an outline side view of the accelerator pedal malfunction elimination apparatus when an accelerator pedal is stepped on within a normal range.

Accordingly, the second rising member 17 rotates in synchronization until the accelerator pedal 5 is stepped on halfway via the accelerator linking member and the movable member as an accelerator linking mechanism. Details thereof will be described based on FIGS. 6 to 8. FIG. 6 is an outline side view of the accelerator pedal malfunction elimination apparatus when an accelerator pedal is stepped on within a normal range, FIG. 7 is a plan sectional view omitting a portion of the accelerator pedal stepping force transmission member of the apparatus, and FIG. 8 is a sectional view showing a VIII-VIII section of FIG. 7.

When the pin tip 22*b* of the locking pin 22 of the first rising member 10 is locked onto the linking claw 17*a*, as shown in FIG. 6, the first rising member 10 and the second rising member 17 rotate in synchronization as the accelerator pedal 5 is stepped on.

When the accelerator pedal 5 is stepped on within the normal range, the pin tip 22*b* and linking claw 17*a* rotate while being locked and thus, the second rising member 17 can pull the accelerator wire 7 and perform normal start-up, starting, acceleration, and constant speed driving of a vehicle.

Figure 7:
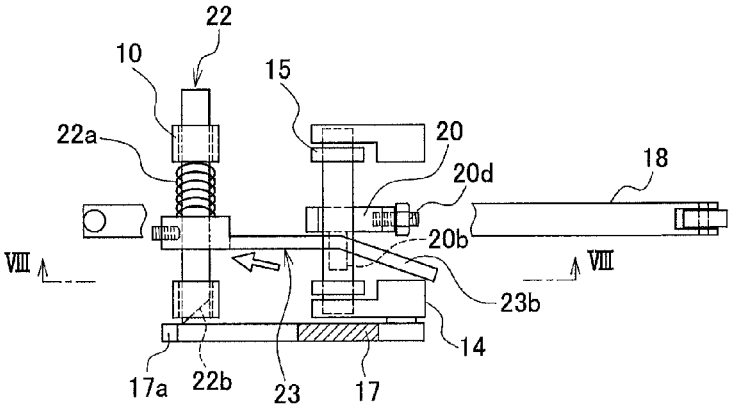
FIG. 7 is a plan sectional view omitting a portion of the accelerator pedal stepping force transmission member of the accelerator pedal malfunction elimination apparatus when the accelerator pedal is stepped on within the normal range.
Figure 8:
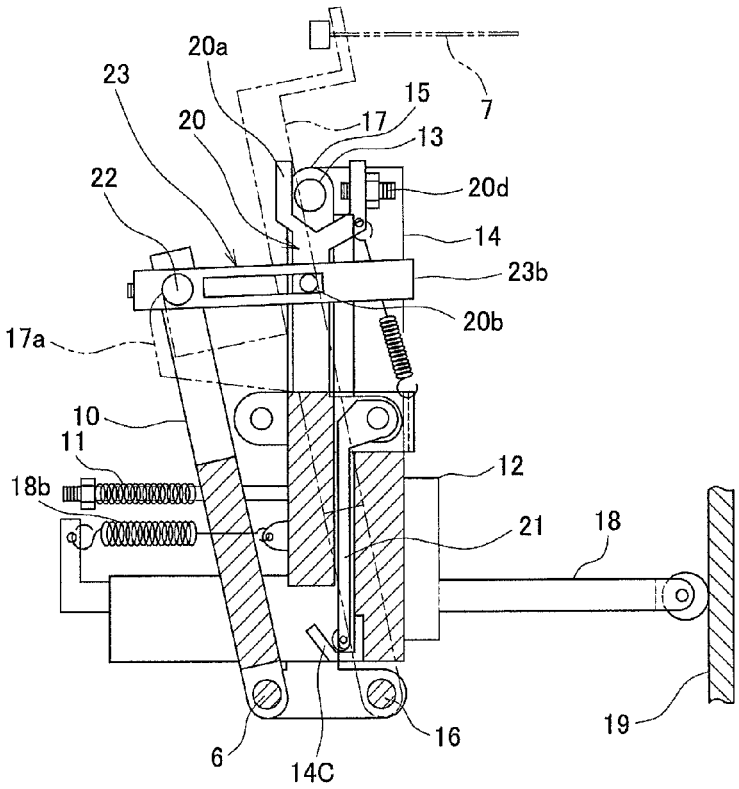
FIG. 8 is a sectional view showing a VIII-VIII section of FIG. 7.

At this point, the ring member 23 fixed to the locking pin 22 is displaced, as shown in FIG. 7, accompanying the rotation of the first rising member 10 to push in the ring member 23 and the locking pin 22 while the bent portion 23*b* of the ring member 23 is in sliding contact with the upper inner surface of the pillar body 14.

When the sliding contact of the bent portion 23*b* of the ring member 23 against an elastic force of the spring 22*a* proceeds up to the position shown in FIG. 7, the pin tip 22*b* of the locking pin 22 sinks into the first rising member 10 and unlocking from the linking claw 17*a* occurs.

Figure 9:
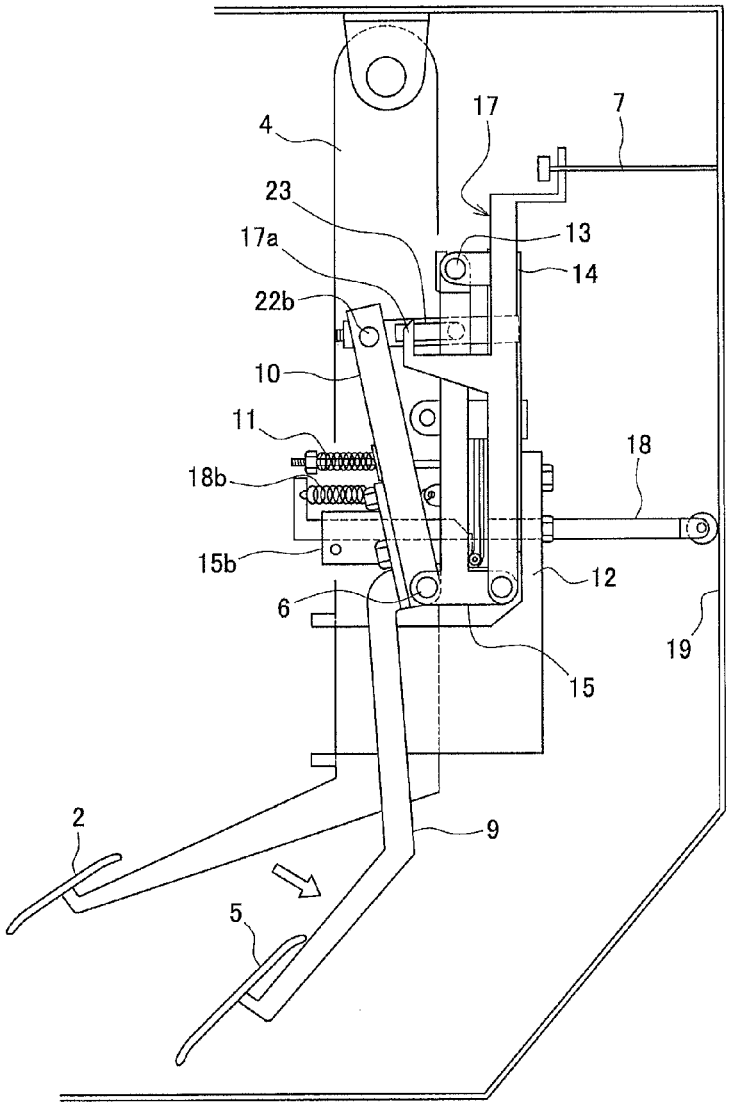
FIG. 9 is an outline side view of the accelerator pedal malfunction elimination apparatus when the accelerator pedal is stepped on by exceeding the normal range.
Figure 10:
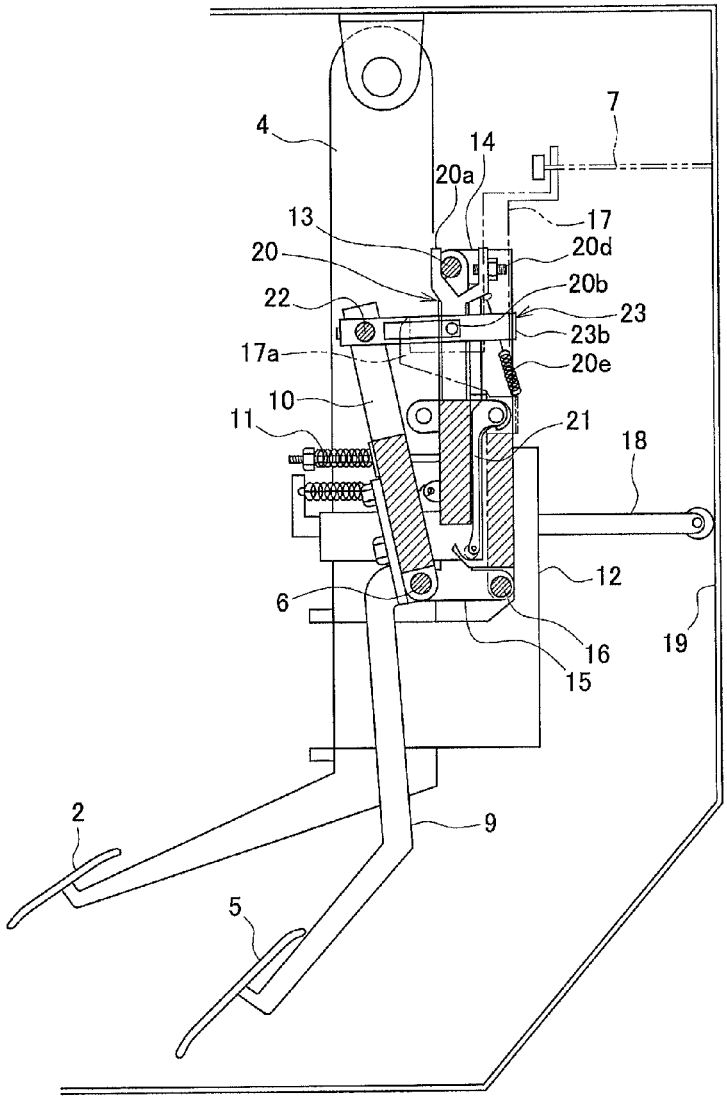
FIG. 10 is a sectional view showing a principal element side of the accelerator pedal stepping force transmission member of the accelerator pedal malfunction elimination apparatus when the accelerator pedal is stepped on by exceeding the normal range.

Details when unlocking of both occurs will be described based on FIGS. 9 and 10. FIG. 9 is an outline side view of the accelerator pedal malfunction elimination apparatus when the accelerator pedal is stepped on by exceeding the normal range and FIG. 10 is a sectional view showing a principal element side of the accelerator pedal stepping force transmission member of the apparatus.

When unlocking of the pin tip 22*b* of the locking pin 22 from the linking claw 17*a* occurs, the second rising member 17 is brought back to its initial position by the tensile force of the accelerator wire 7 and also stops supplying the fuel. Incidentally, both are not unlocked in the normal stepping range of the accelerator pedal 5 and the unlocking occurs only in a region close to the maximum stepping. At this point, the accelerator wire 7 returns and thus, abrupt starting and abrupt acceleration are suppressed.

When an unexpected emergency occurs while driving a motor vehicle, the accelerator pedal 5 may be stepped on without the brake pedal 2 being stepped on. In such a case, when a region close to the maximum stepping is reached, as shown in FIG. 9, unlocking of the pin tip 22*b* from the linking claw 17*a* occurs and the second rising member 17 is brought back to its initial position by the tensile force of the accelerator wire 7 and stops supplying the fuel. Therefore, the engine changes to a low-rpm region and the possibility of abrupt starting or abrupt acceleration is eliminated.

If the accelerator pedal 5 is stepped on abruptly, unlocking of the locking pin 22 from the linking claw 17*a* is more likely to occur and therefore, abrupt starting and abrupt acceleration of a vehicle are suppressed and fuel consumption is reduced thanks to an ecological driving operation friendly to humans and nature, which is more economical.

When the accelerator pedal 5 is stopped being stepped on, the first rising member 10 is brought back to its initial position by the action of the return spring 11 and when there is no sliding contact between the bent portion 23*b* of the ring member and the pillar body 14, the locking pin 22 is protruded again by being energized by the spring 22*a* and the pin tip 22*b* and the linking claw 17*a* are brought closer and a tapered portion abuts. After the spring 22*a* is compressed again by the abutting force and the locking pin 22 is displaced to sink into the first rising member 10, the locking pin 22 is protruded by being energized by the spring 22*a* and both are locked to change to the initial state.

Figure 11:
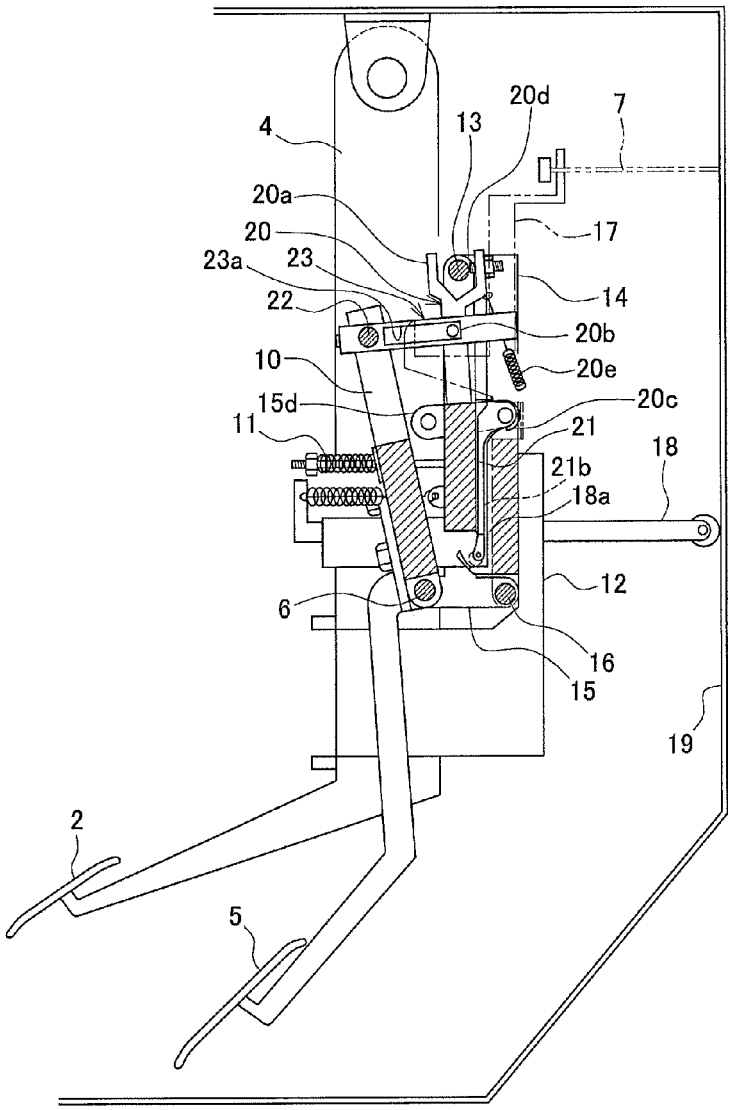
FIG. 11 is a sectional view showing the principal element side of the accelerator pedal stepping force transmission member of the accelerator pedal malfunction elimination apparatus immediately after the accelerator pedal is stepped on by exceeding the normal range and a guide member is unlocked.
Figure 12:
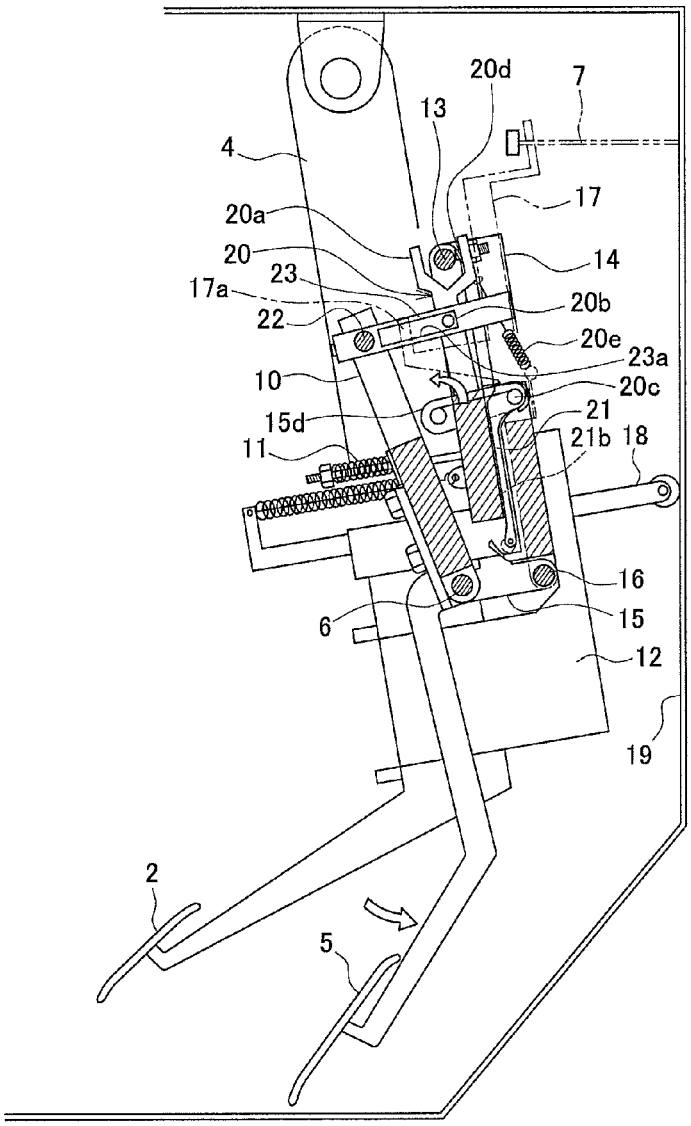
FIG. 12 is a sectional view showing the principal element side of the accelerator pedal stepping force transmission member of the accelerator pedal malfunction elimination apparatus when a brake pedal is displaced after the guide member being unlocked.

On the other hand, if the accelerator pedal 5 is further stepped on after unlocking of the first rising member 10 from the second rising member 17 occurs, the first rising member 10 is further rocked around the rocking fulcrum pin 6. Details At this point will be described based on FIGS. 11 and 12. FIG. 11 is a sectional view showing the principal element side of the accelerator pedal stepping force transmission member of the accelerator pedal malfunction elimination apparatus immediately after the accelerator pedal is stepped on by exceeding the normal range and a guide member is unlocked and FIG. 12 is a sectional view showing the principal element side of the accelerator pedal stepping force transmission member of the apparatus when a brake pedal is displaced after the guide member being unlocked.

When the brake pin 20*b* protruding from the conversion fitting 20 abuts on an end of the long hole 23*a* of the ring member 23, the conversion fitting 20 is displaced in synchronization with the first rising member 10. An internal surface of the long hole 23*a* is configured so as to abut on the brake pin 20*b* when the first rising member 10 rotates and unlocking of the accelerator linking member from the movable member occurs.

If the accelerator pedal 5 is further stepped on in this state, the conversion fitting 20 starts to rotate around the bearing 15*d* of the stepping force conversion suspended body 15 and lifts the lock fitting 21 suspended to the chassis 19 side of the lower end protruding portions 20*c* of the conversion fitting 20. At this point, the branching portion 21*b* of the lock fitting 21 is locked onto the notch portion 18*a* of the guide member 18.

At this point, no load in the direction of the chassis 19 acts on the guide member 18. The upward motion of the guide member 18 is suppressed while the lock fitting 21 abuts on the notch portion 18*a*, but when the lock fitting 21 is unlocked, the stepping force conversion suspended body 15 starts to rotate and the guide member 18 supported thereby also rotates so that the tip portion thereof can be displaced along the chassis 19.

If the accelerator pedal 5 is further stepped on, as shown in FIG. 12, the conversion fitting 20 continues to rotate around the bearing 15*d* against the tensile force of the spring 20*e*. When the above crotch portion 20*a* is displaced with respect to the suspension pin 13 and the suspension pin 13 abuts on the adjusting screw 20*d*, the rotation is blocked.

When the rotation is blocked, the first rising member 10, the conversion fitting 20, the stepping force conversion suspended body 15, the pillar body 14, and the brake arm 4 start to perform an integrated operation (rotation). That is, stepping on the accelerator pedal 5 further becomes equivalent to stepping on the brake pedal 2 and the brake pedal 2 is stepped on in accordance with a force to step on the accelerator pedal 5 to achieve reliable braking.

At this point, one end of the guide member 18 slides on the chassis 19 by matching the motion of the first rising member 10, the stepping force conversion suspended body 15 and the like. The end may be configured to roll by providing a roller.

When stepping on the accelerator pedal 5 is stopped and the foot is taken off the pedal, the first rising member 10 is brought back to its initial position and thus, the connection of the brake pin 20*b* and the ring member 23 is cut and next, the conversion fitting 20, the stepping force conversion suspended body 15, the pillar body 14, the brake arm 4, and the brake pedal 2 return to their initial positions.

The lock fitting 21 also descends and the branching portion 21*b* abuts on the notch portion 18*a* of the guide member 18 to be locked, which suppresses displacement of the stepping force conversion suspended body 15 and the like. This enables a normal driving operation.

Figure 13:
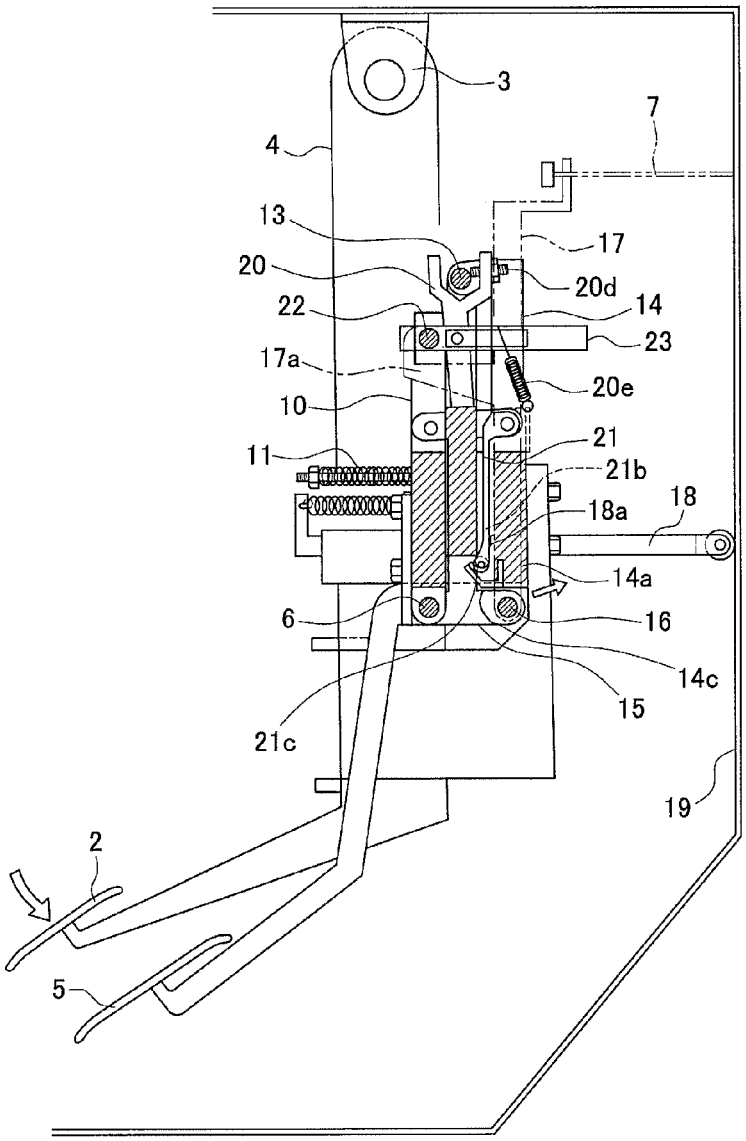

Next, details of the action when the brake pedal is stepped on will be described based on FIGS. 13 and 14. FIG. 13 is a sectional view showing the principal element side of the accelerator pedal stepping force transmission member of the accelerator pedal malfunction elimination apparatus immediately after the brake pedal being stepped on and FIG. 14 is a sectional view showing the principal element side of the accelerator pedal stepping force transmission member when the brake pedal is stepped on.

When the brake pedal 2 is stepped on, the brake arm 4 and the pillar body 14 rotate around the pivot 3. The supporting plate 14*c* is protruded from the lower surface plate 14*a* of the pillar body 14 and the leg 21*c* of the lock fitting 21 abuts on the top surface thereof. When the supporting plate 14*c* rotates together with the pillar body 14, as shown in FIG. 13, the inclined rising portion of the supporting plate 14*c* acts in a direction in which the leg 21*c* is lifted.

At this point, the lock fitting 21 rises and the branching portion 21*b* is unlocked from the notch portion 18*a* of the guide member 18 to be unlocked. Thus, the displacement of the guide member 18 becomes free.

Figure 14:
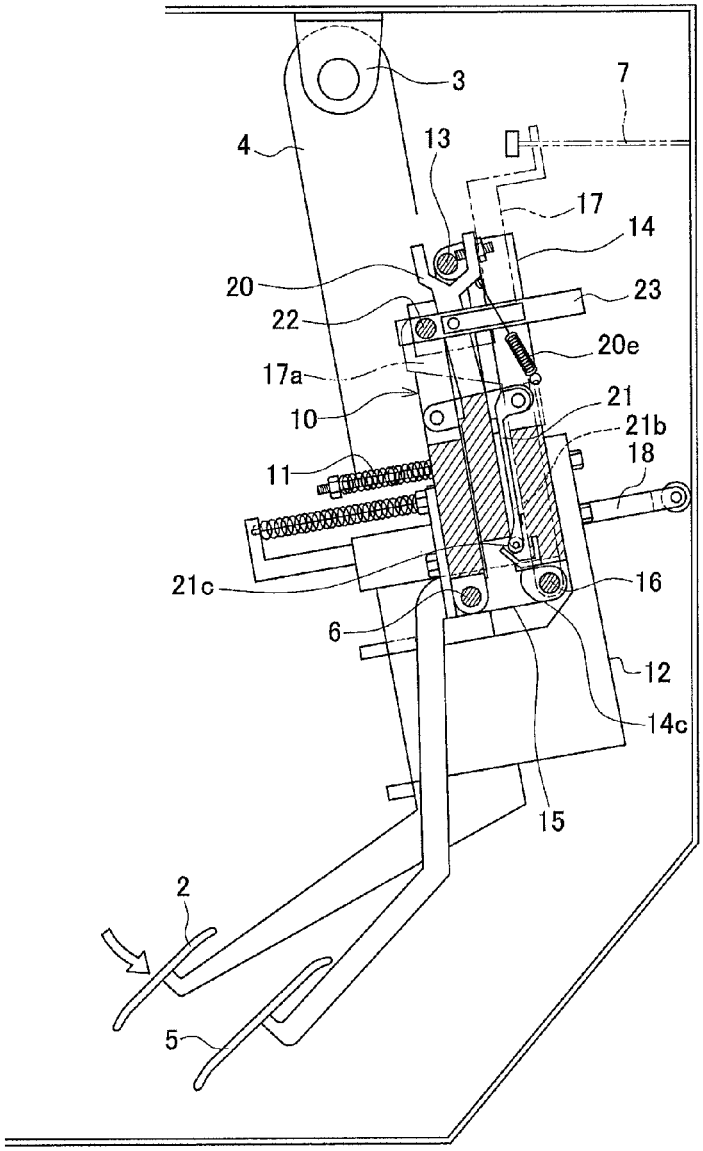

If the brake pedal 2 is further stepped on, as shown in FIG. 14, the pillar body 14 and the supporting plate 14*c* rotate and the leg 21*c* of the lock fitting 21 rotates the conversion fitting 20, the stepping force conversion suspended body 15, and the first rising member 10 at the same time.

At this point, the accelerator pedal 5 also rotates at the same time, but the rotation is not around the rocking fulcrum pin 6 and so the accelerator wire 7 is not pulled. That is, only the braking force of the brake pedal 2 acts. The brake pedal 2 and the accelerator pedal 5 are rotated in synchronization and thus, the relative position thereof is approximately the same as the initial state thereof.

Figure 15:
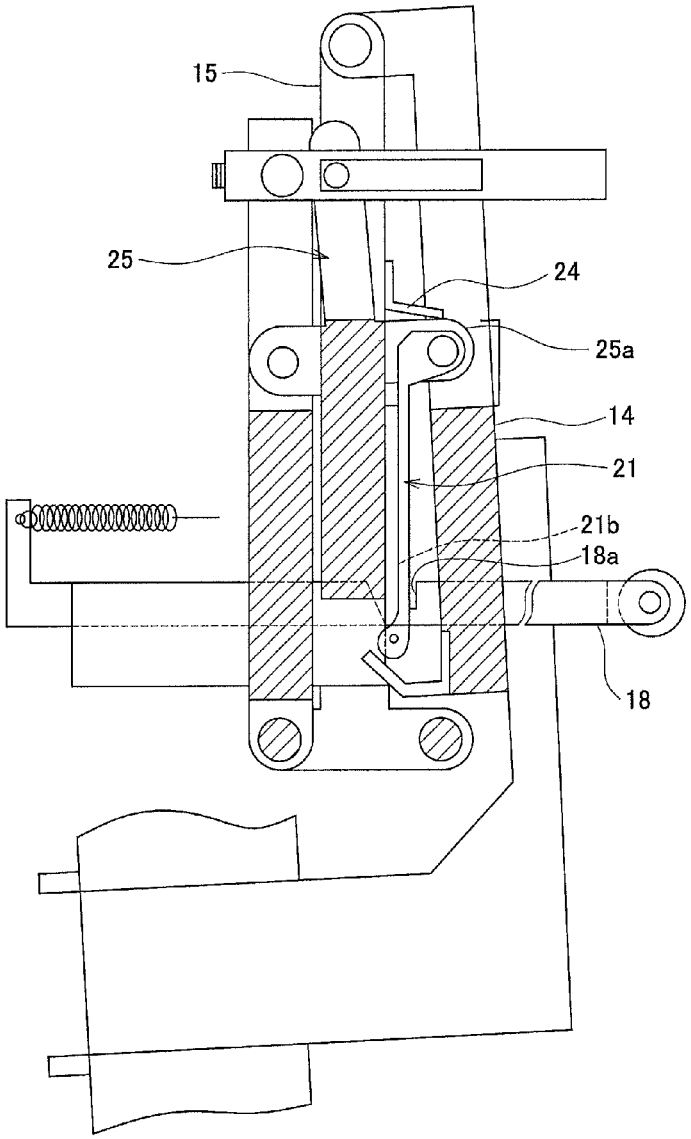
FIG. 15 is a side view of principal elements of the accelerator pedal malfunction elimination apparatus equipped with a rotating stopper separated from a conversion fitting.

Next, an embodiment including a rotating stopper separated from a conversion fitting will be described based on FIG. 15. FIG. 15 is a side view of principal elements of the accelerator pedal malfunction elimination apparatus equipped with a rotating stopper separated from a conversion fitting. A rotating stopper 24 is a protruding body capable of abutting on the pillar body 14 of a lower end protruding portion 25*a* of a conversion fitting 25 and is protruded to the pillar body 14 side of the stepping force conversion suspended body 15.

The rotating stopper 24 may be attached to any member capable of blocking further lifting (rotation) of the conversion fitting 25 after the branching portion 21*b* of the lock fitting 21 being unlocked from the notch portion 18*a* of the guide member 18.

Figure 16:
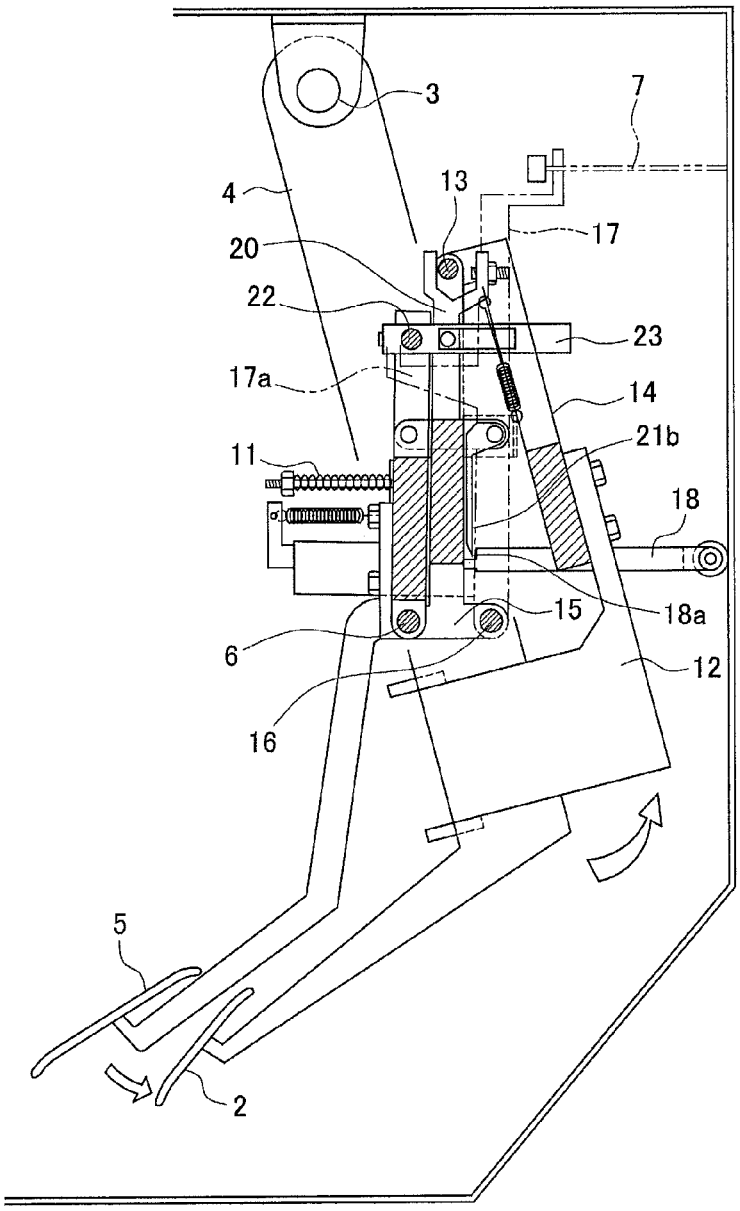
FIG. 16 is a sectional view showing the principal element side of the accelerator pedal stepping force transmission member of the accelerator pedal malfunction elimination apparatus immediately after the brake pedal being stepped on in a different embodiment.

A configuration in which the accelerator pedal stepping force transmission member is not linked when the brake pedal is stepped on may be adopted. In this configuration, no supporting plate is provided on the pillar plate. Details of the action when the brake pedal is stepped on in this embodiment will be described based on FIG. 16. FIG. 16 is a sectional view showing the principal element side of the accelerator pedal stepping force transmission member of the accelerator pedal malfunction elimination apparatus immediately after the brake pedal being stepped on in a different embodiment.

In FIG. 16, the same reference numerals are attached to structural elements similar to those in FIG. 1 or members exerting similar actions and a detailed description thereof is omitted. When the brake pedal 2 is stepped on, the brake arm 4 and pillar body 14 rotate around the pivot 3.

At this point, the suspension pin 13 of the pillar body 14 supports all members of the accelerator pedal stepping force transmission member 8, but provides only suspended support in the vertical direction and there is no action of rotation. In addition, the branching portion 21*b* of the lock fitting 21 is locked onto the notch portion 18*a* of the guide member 18 to be locked and thus, there is almost no displacement of the accelerator pedal stepping force transmission member 8 and the accelerator wire 7 is not acted on.

Therefore, stepping on the brake pedal 2 is a substantially single operation and there is no displacement of the accelerator pedal 5.

Figure 17:
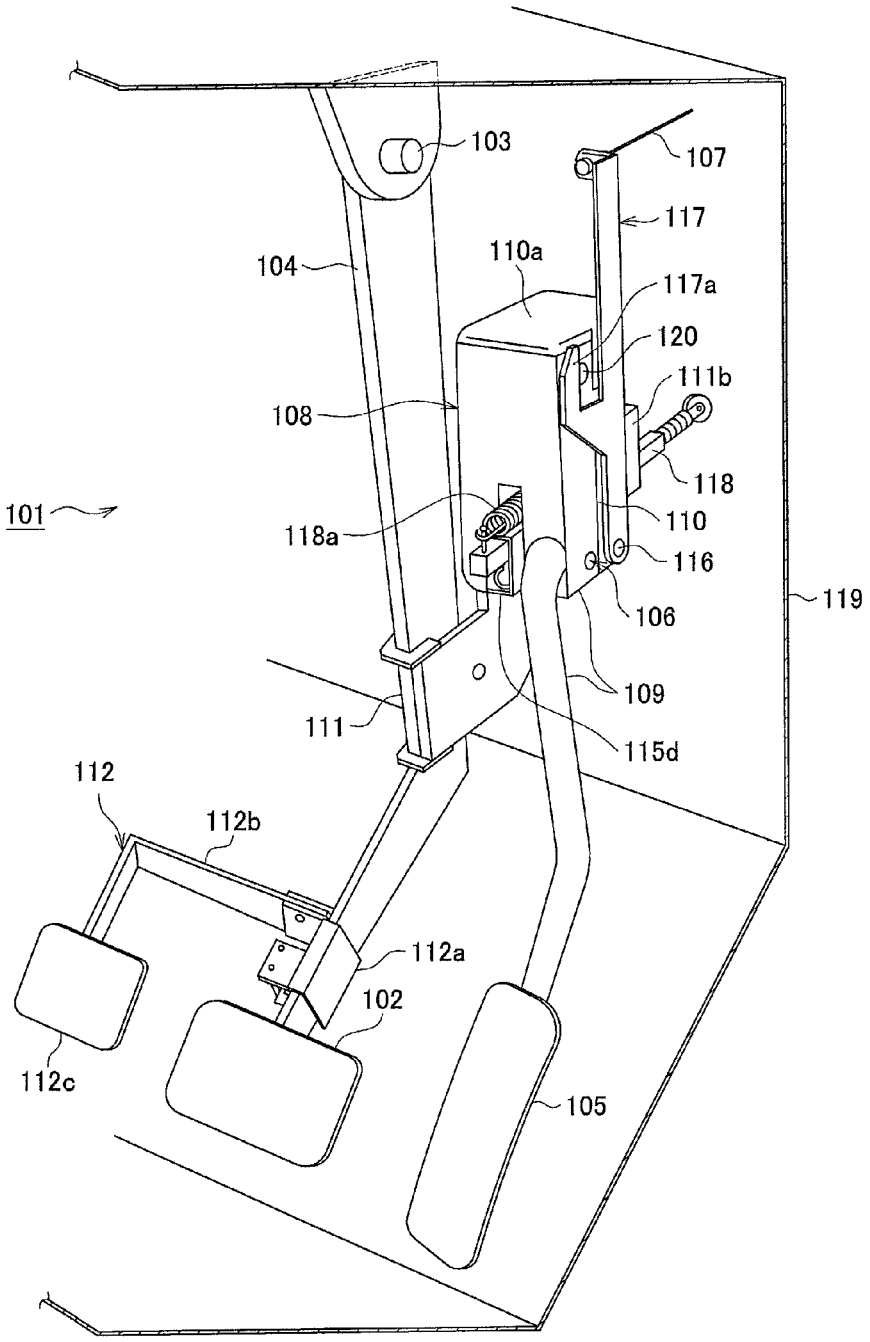
FIG. 17 is a perspective view showing principal elements of an accelerator pedal malfunction elimination apparatus according to another embodiment.
Figure 18:
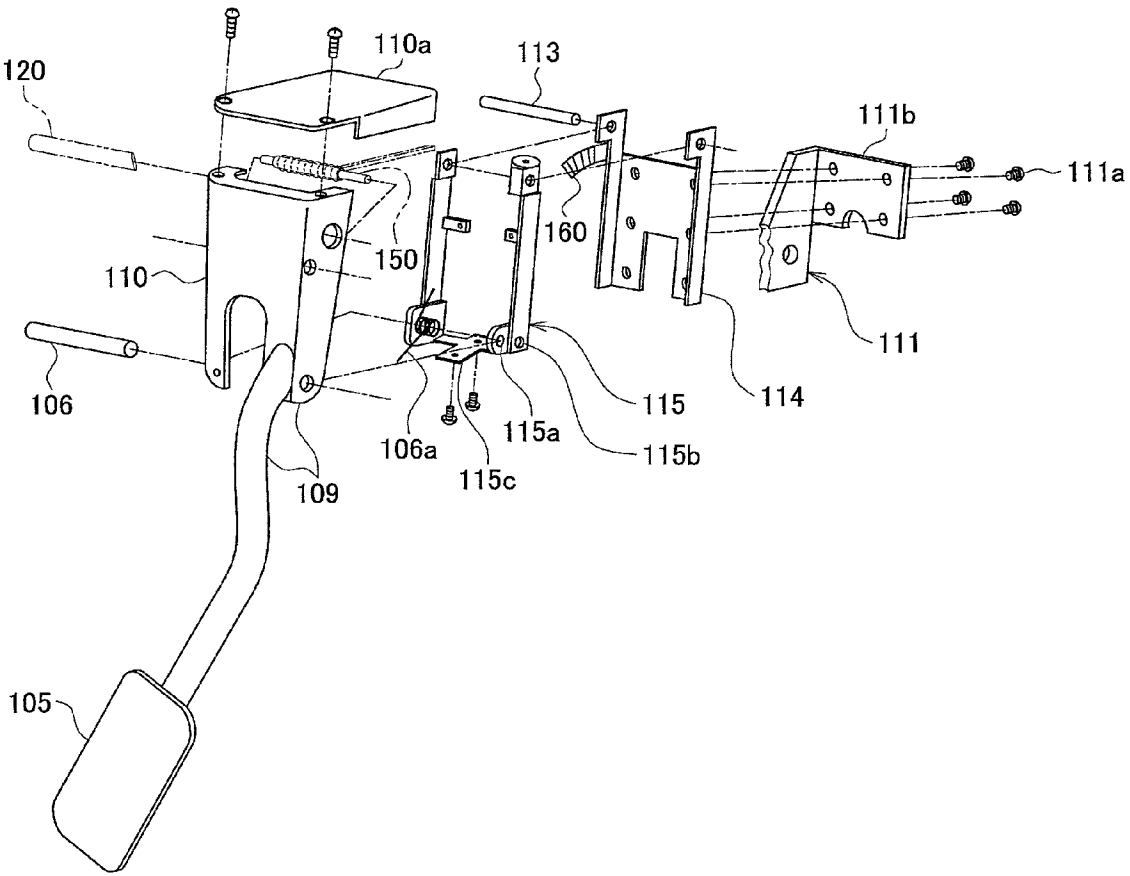
FIG. 18 is an exploded perspective view showing principal elements of an accelerator pedal stepping force transmission member attached to a first fitting.
Figure 19:
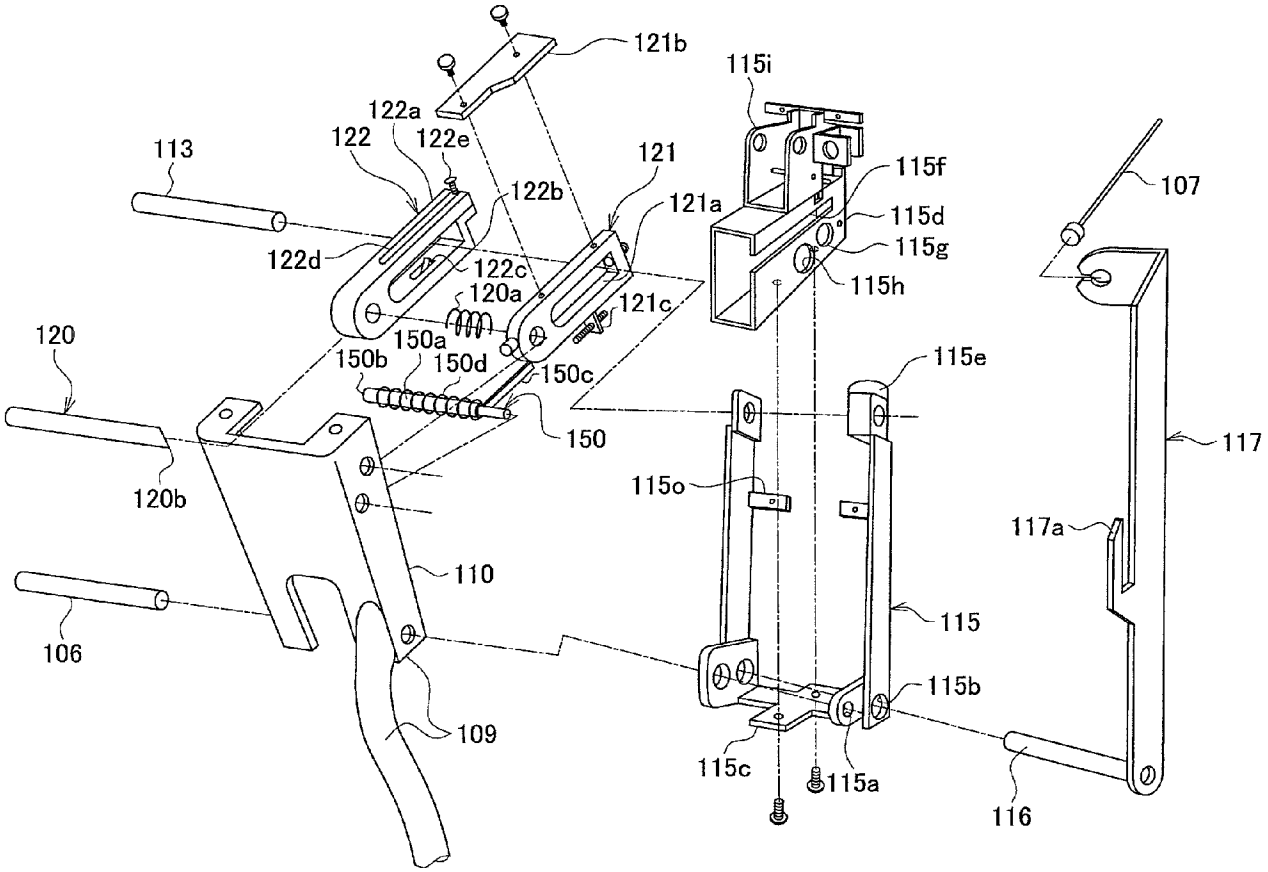
FIG. 19 is an exploded perspective view showing principal elements of an accelerator linking mechanism.
Figure 20:
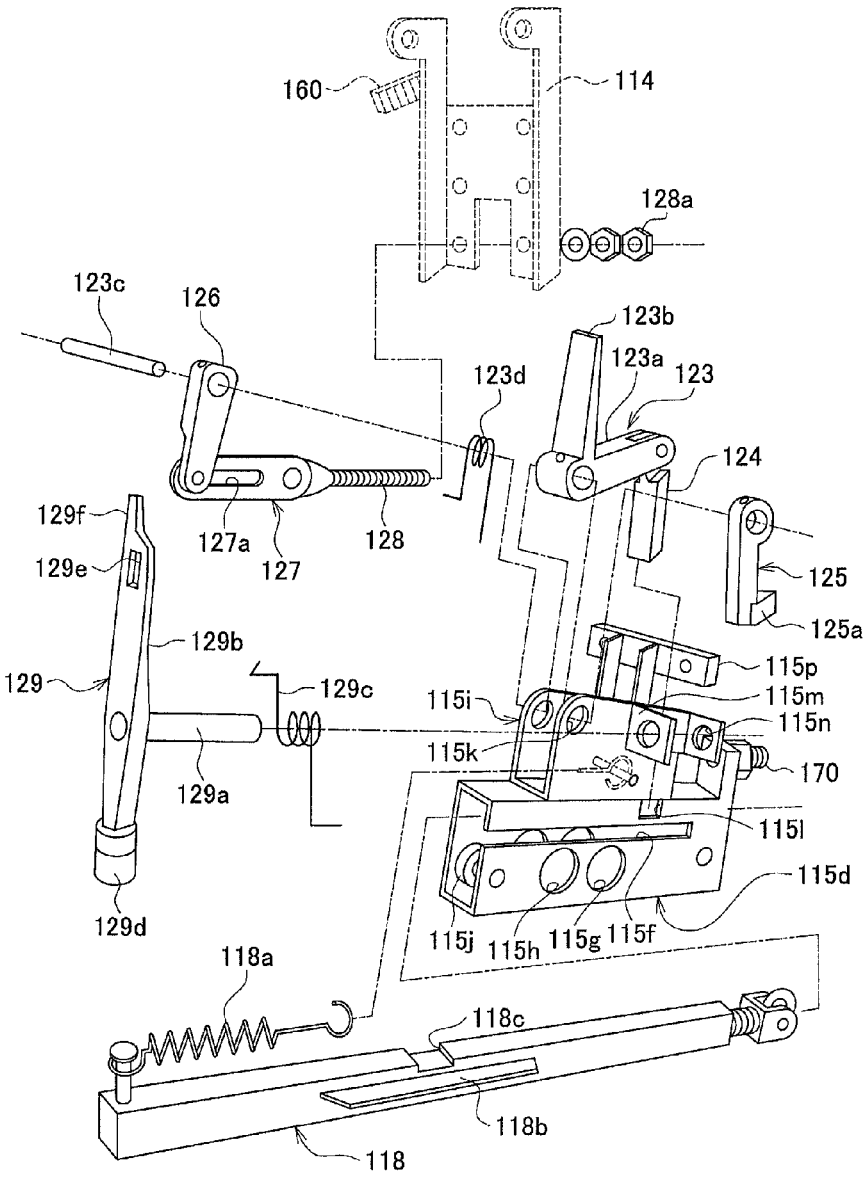
FIG. 20 is an exploded perspective view showing a relationship of members connected to a guide case.

Next, another embodiment will be described based on FIGS. 17 to 20. FIG. 17 is a perspective view showing principal elements of an accelerator pedal malfunction elimination apparatus according to another embodiment, FIG. 18 is an exploded perspective view showing principal elements of an accelerator pedal stepping force transmission member attached to a first fitting, FIG. 19 is an exploded perspective view showing principal elements of an accelerator linking mechanism, and FIG. 20 is an exploded perspective view showing a relationship of members connected to a guide case.

As shown in FIG. 17, an accelerator pedal malfunction elimination apparatus 101 includes a brake arm 104 having a brake pedal 102 fixed to one end and whose other end is attached to a pivot 103 to perform a braking operation by rotary movement and an accelerator pedal stepping force transmission member 108 having an accelerator pedal 105 attached to one end, a rocking fulcrum pin 106 loosely inserted into an intermediate portion, and an accelerator wire 107 locked onto the other end.

The accelerator pedal stepping force transmission member 108 includes a rocking member 109 fixing the accelerator pedal 105 to one end thereof and having a side face in a " ⌒ " shape and a bent portion of the rocking member 109 is rotatably locked via the rocking fulcrum pin 106. An upper portion of the bent portion constitutes a first rising member 110.

The brake arm 104 includes a first fitting 111 springing out from the vicinity of the arm bent portion to the accelerator pedal stepping force transmission member 108 and also has an auxiliary brake pedal 112*c* fixed to the tip of an auxiliary brake arm 112*b* installed side by side with the brake pedal 102 by a second fitting 112*a* to attach an auxiliary brake 112 being removably fixed immediately above the brake pedal 102.

Members attached to the first fitting will be described based on FIG. 18. The first fitting 111 fixes a pillar body 114 in which a suspension pin 113 is placed laterally to the front of a springing portion 111*b* by a bolt 111*a* in an upper portion thereof. A stepping force conversion suspended body 115 whose front has a substantial H shape is suspended to the suspension pin 113 so as to be rotatable to the inner side of the pillar body 114. The pillar body 114 is configured to support all members of the accelerator pedal stepping force transmission member 108 shown in FIG. 17 by the suspension pin 113 or the like.

A hole is provided at the lower end of both side plates of the stepping force conversion suspended body 115 and the rocking fulcrum pin 106 is inserted through a hole 115*a*. The stepping force conversion suspended body 115 is configured to be installed side by side in front of the pillar body 114, has both side surfaces in an inverse L shape, and rockably supports the first rising member 110 by the rocking fulcrum pin 106 loosely inserted into the lower end.

A return spring 106*a* whose one end is locked onto the first rising member 110 is wound around the rocking fulcrum pin 106. The return spring 106*a* has the action to return the first rising member 110 to its initial position when the accelerator pedal 105 is released after being stepped on. A cover body 110*a* is fixed to the top surface of the first rising member 110 by a screw and a locking pin 120 and a pedal linking pin body 150 as movable members constituting a portion of an accelerator linking mechanism are laterally placed above the rocking fulcrum pin 106. In addition, a rack 160 whose cross section is like sawteeth is provided on the upper side of the pillar body 114. A bottom plate 115*c* is provided in the center of the lower hem of the stepping force conversion suspended body 115 and a guide case 115*d* shown in FIG. 17 is attached perpendicularly.

As shown in FIG. 17, a second rising member 117 having the accelerator wire 107 locked onto the upper end thereof and an accelerator fulcrum pin 116 protruding from the lower end thereof is rotatably attached by loosely inserting the accelerator fulcrum pin 116 into a hole 115*b* opposite to the pedal side of the stepping force conversion suspended body 115 shown in FIG. 18. The second rising member 117 also constitutes a portion of the accelerator pedal stepping force transmission member 108.

A guide member 118 is accommodated inside the guide case 115*d* of the stepping force conversion suspended body 115. A spring 118*a* is attached to the tip portion exposed from the guide member 118 and the other end thereof is fixed to an upper portion of the guide case 115*d*. The tip of the guide member 118 abuts on a chassis 119 and the spring 118*a* energizes in the direction of the chassis 119.

The tip of the locking pin 120 as a movable member constituting a portion of the accelerator linking mechanism protrudes from the upper end side of the first rising member 110. In addition, a linking claw 117*a* in an L shape protrudes from an intermediate portion of the second rising member 117 on the side of the first rising member 110 as an accelerator linking member constituting a portion of the accelerator linking mechanism. The locking pin 120 of the first rising member 110 is configured to lock onto the linking claw 117*a* when the accelerator pedal 105 is stepped on and to unlock therefrom.

The accelerator linking mechanism will be described based on FIG. 19. The locking pin 120 is inserted through the upper end of the first rising member 110 and has a spring 120*a* wound around an intermediate portion thereof and a pin tip 120*b* obtained by tapering a tip portion of a pillar body section to the side of the second rising member 117.

The locking pin 120 has a first ring member 121 that fixes one end thereof and an accelerator pedal stepping force adjusting ring 122 installed side by side. The first ring member 121 has a long hole 121*a* formed therein to allow the suspension pin 113 suspending the stepping force conversion suspended body 115 to be inserted through and the locking pin 120 and the first ring member 121 abut on the spring 120*a* to be energized to the side of the second rising member 117.

A plate 121*b* provided with planar steps is attached to a top portion of the first ring member 121 by screws. A springing portion of the plate 121*b* constitutes a portion of a locking pin pushing portion and when the springing portion is brought into sliding contact with a pushing roller 115*e* provided in the top portion of the stepping force conversion suspended body 115, the first ring member 121 and the locking pin 120 are pushed to the inner side.

The first ring member 121 includes a blade pushing member 121*c* to rotate a conversion fitting 123 described later in a lower portion thereof. The first ring member 121 connects the upper end of the first rising member 110 and the suspension pin 113 appropriately to constitute a linking connection member that appropriately links both in accordance with the rotation angle of the first rising member 110.

The accelerator pedal stepping force adjusting ring 122 has the locking pin 120 inserted through one end thereof and also the suspension pin 113 inserted between an upper springing plate 122*a* and a lower springing plate 122*b* such that the crossing position can vary. A triangular cam 122*c* is disposed in the lower springing plate 122*b* and the upper springing plate 122*a* is provided with an adjusting plate 122*d* and an adjusting plate support plate 122*e*.

The triangular cam 122*c* is a member capable of overstepping displacement by supporting the suspension pin 113 when the suspension pin 113 is displaced away from the side of the locking pin 120 and by rotation when the suspension pin 113 is displaced closer from the opposite direction.

A pedal linking pin body 150 is laterally placed below the locking pin 120 that attaches the first ring member 121 and the accelerator pedal stepping force adjusting ring 122. The pedal linking pin body 150 includes a pin body 150*a* and a tapered tip 150*b* and the pin body 150*a* has a bar body 150*c* in parallel with an outer direction of the first ring member 121 fixed thereto and also a spring 150*d* energizing to the side of the second rising member 117 wound therearound.

The tapered tip 150*b* of the pedal linking pin body 150 forms a tapered tip capable of engaging with the rack 160 whose cross section is like sawteeth and is configured to be displaceable along a sawtooth inclined plane.

The guide case 115*d* is fixed to the bottom plate 115*c* provided in the center of the lower portion of the stepping force conversion suspended body 115 by a screw and has with a notched opening 115*f*, an accelerator fulcrum pin hole 115*g*, and a rocking fulcrum pin hole 115*h* formed on the case side face and is provided with a conversion fitting support member 115*i* to support the conversion fitting 123 described later on the top plate.

Details of the guide case will be described based on FIG. 20. A roller 115*j* is disposed inside the guide case 115*d* to support the guide member 118 by rolling motion. The guide member 118 has a side protruding plate 118*b* protruding from the side face thereof and exposed to the outside from the notched opening 115*f* of the guide case 115*d*. A stopper 170 capable of abutting on the pillar body 114 is provided at the rear end of the guide case 115*d*.

The guide member 118 has a notch portion 118*c* formed in an intermediate portion and the spring 118*a* attached to the tip portion of the guide member 118 has the other end fixed to the inside of the conversion fitting support member 115*i*.

The conversion fitting support member 115*i* supports the conversion fitting 123 and a plurality of members related thereto and is produced by bending a plate.

The conversion fitting 123 has a horizontal portion 123*a* and a blade rising portion 123*b* formed so as to have a side face in an L shape and a crossing portion thereof is fixed to an axis 123*c*. The axis 123*c* is supported by a bearing 115*k* provided on the pedal side of the conversion fitting support member 115*i*. A lock fitting 124 is rotatably suspended from the tip of the horizontal portion 123*a*.

The lock fitting 124 is suspended from an opening 1151 providing a lower locking portion on the upper surface of the guide case 115*d* to be locked onto or unlocked from the notch portion 118*c* of the guide member 118.

The axis 123*c* fixing the conversion fitting 123 has a coil spring 123*d* wound therearound to energize the conversion fitting 123 to rotate in the direction of the notch portion 118*c* of the guide member 118. In addition, the blade pushing member 121*c* of the first ring member 121 described above can abut on the tip of the blade rising portion 123*b*.

Outside the conversion fitting support member 115*i* of the axis 123*c* fixing the conversion fitting 123, an L-shaped body 125 and a suspended member 126 are disposed side by side by being installed on the side of the second rising member 117 and on the side of the brake pedal 102 respectively.

A tapered protruding surface 125*a* is formed at the lower end of the L-shaped body 125. On the other hand, a horizontal member 127 is connected to the lower end of the suspended member 126 and a coupling member 128 in a bar shape is linked to the tip of the horizontal member 127 by a pin. The coupling member 128 is inserted through a lower portion of the pillar body 114 and a nut 128*a* is screwed to the protruding head thereof.

A long hole 127*a* is formed in the horizontal member 127 and the lower end of the suspended member 126 engaged therewith is made movable in the horizontal direction.

A springing support plate 115*m* protrudes on the side of the second rising member 117 outside the conversion fitting support member 115*i* and an internal locking pin pushing portion 129 is annexed to a hole 115*n* drilled therein. In addition, an attachment plate 115*p* locked onto a rear surface springing plate 115*o* of the stepping force conversion suspended body 115 shown in FIG. 19 protrudes from the top portion of the conversion fitting support member 115*i*.

Thus, the guide case 115*d* and the conversion fitting support member 115*i* fixed thereto are locked onto the bottom plate 115*c* and the rear surface springing plate 115*o* of the stepping force conversion suspended body 115 respectively and so are integrated with the stepping force conversion suspended body 115.

The internal locking pin pushing portion 129 includes an axial body 129*a* loosely inserted into the hole 115*n*, a columnar body 129*b* perpendicular to the head thereof, and a coil spring 129*c* wound around the axial body 129*a* to energize the upper end of the columnar body 129*b* to rotate to the outer side. The internal locking pin pushing portion 129 is a member in a substantial T shape made rotatable around the axial body 129*a*.

A rolling member 129*d* that rotates the upper end of the columnar body 129*b* in the inner direction by abutting on the side protruding plate 118*b* of the guide member 118 or the tapered protruding surface 125*a* of the L-shaped body 125 is attached to the lower end of the columnar body 129*b* and a long hole 129*e* through which the bar body 150*c* fixed to the pin body 150*a* of the pedal linking pin body 150 shown in FIG. 19 is inserted and a tip sliding contact portion 129*f* capable of sliding contact with the first ring member 121 are formed in the upper portion of the columnar body 129*b*.

Figure 21:
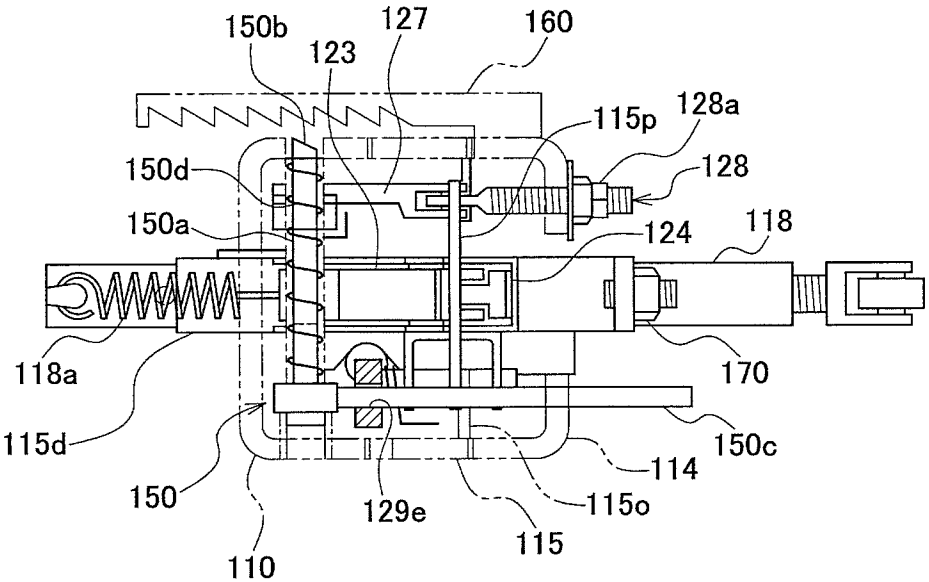
FIG. 21 is a plan view showing principal elements of the accelerator pedal malfunction elimination apparatus.
Figure 22:
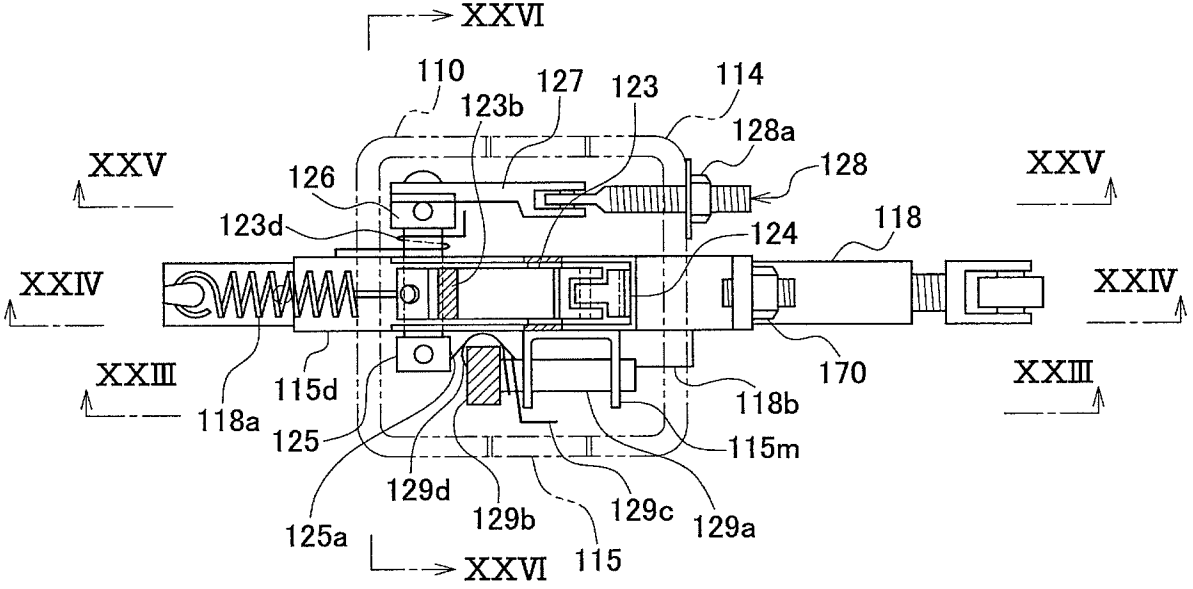
FIG. 22 is a sectional view showing a cross section of a lower portion of FIG. 21.
Figure 23:
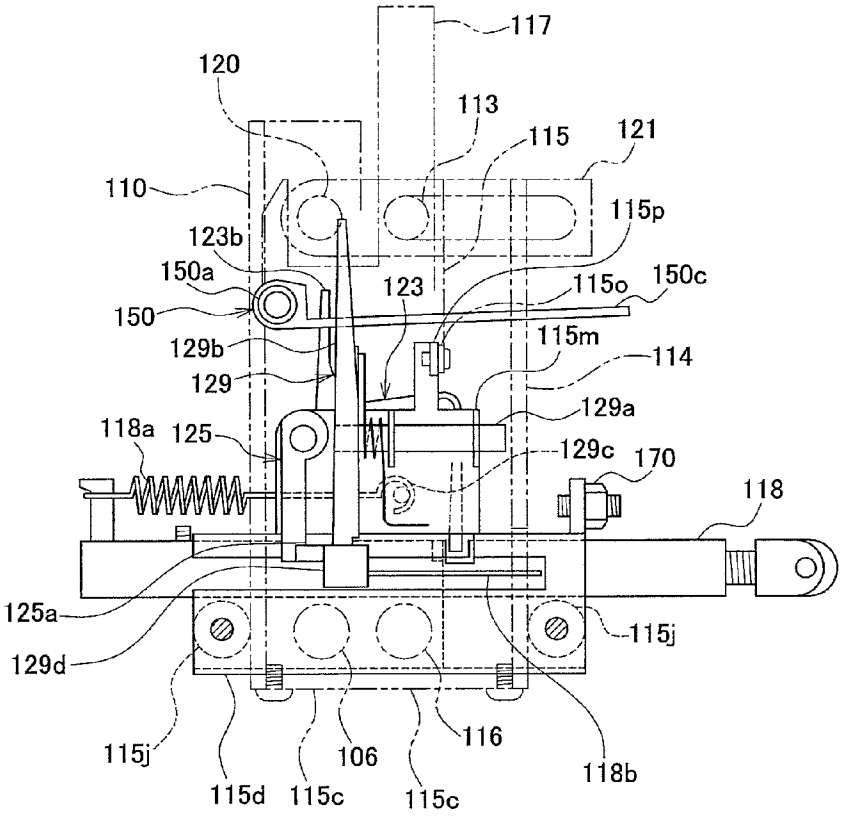
FIG. 23 is a sectional view showing a XXIII-XXIII section of FIG. 22.
Figure 24:
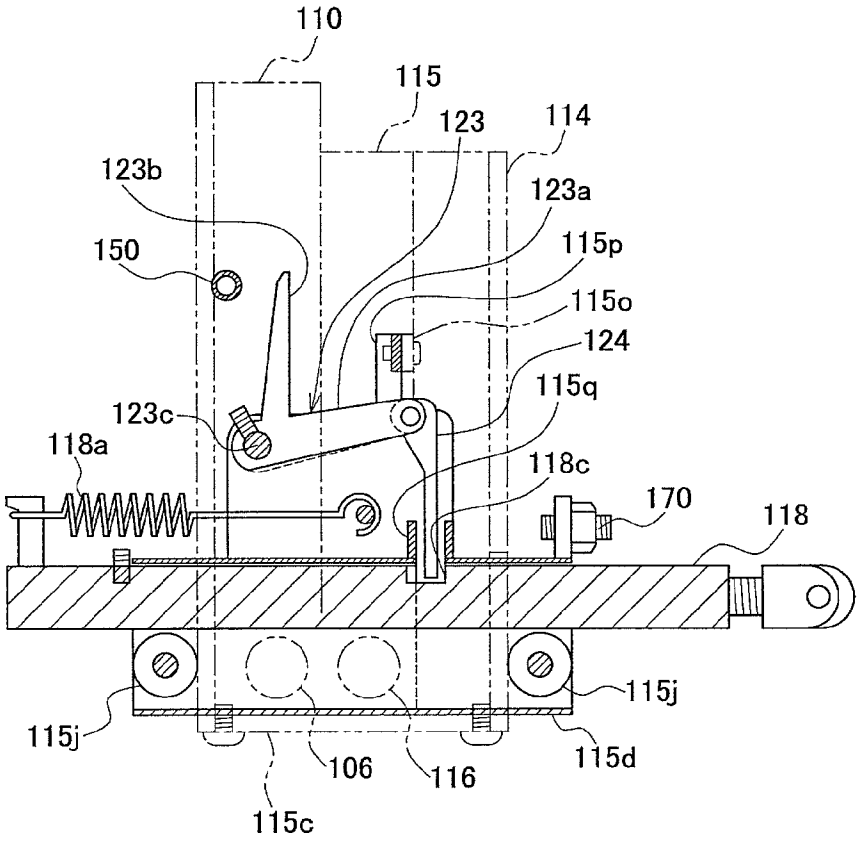
FIG. 24 is a sectional view showing a XXIV-XXIV section of FIG. 22.
Figure 25:
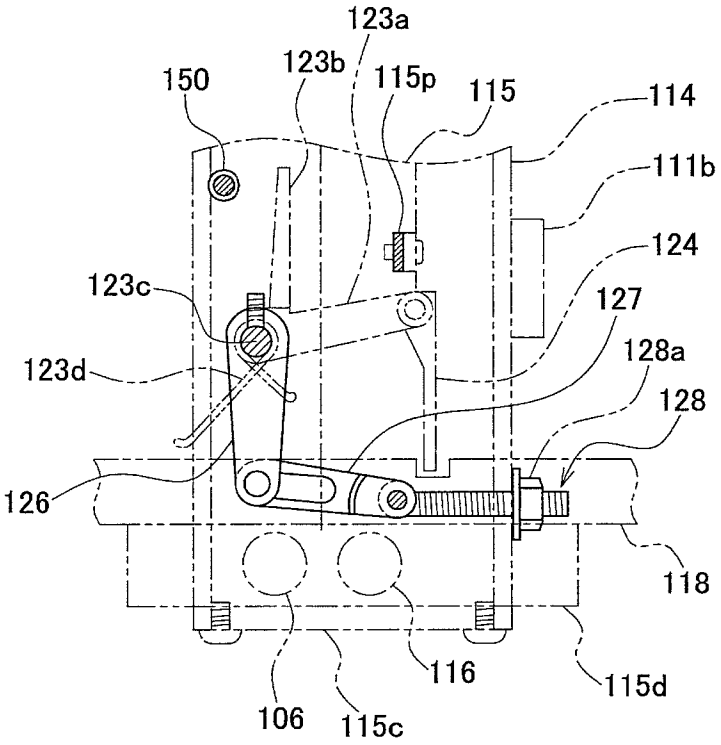
FIG. 25 is a sectional view showing a XXV-XXV section of FIG. 22.
Figure 26:
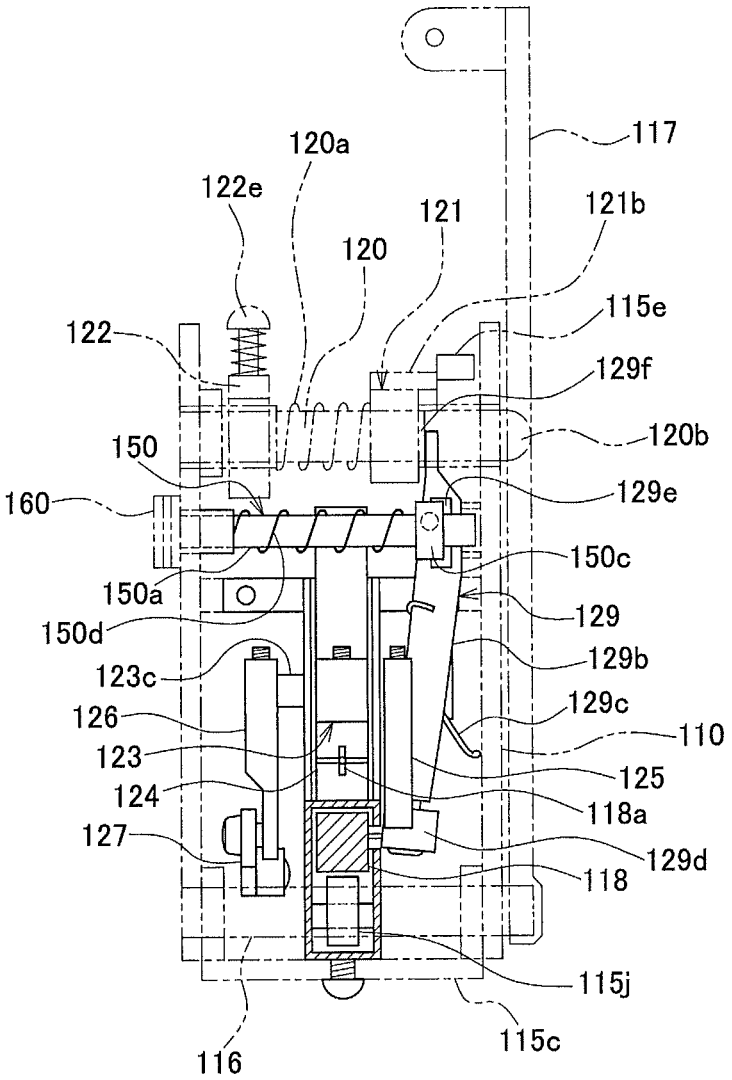
FIG. 26 is a sectional view showing a XXVI-XXVI section of FIG. 22.

Assembly drawings of an accelerator pedal malfunction elimination apparatus produced by assembling each member described above are shown in FIGS. 21 to 26. FIG. 21 is a plan view showing principal elements of the accelerator pedal malfunction elimination apparatus and FIG. 22 is a sectional view showing a cross section of a lower portion of FIG. 21. FIG. 23 is a sectional view showing a XXIII-XXIII section of FIG. 22, FIG. 24 is a sectional view showing a XXIV-XXIV section of FIG. 22, FIG. 25 is a sectional view showing a XXV-XXV section of FIG. 22, and FIG. 26 is a sectional view showing a XXVI-XXVI section of FIG. 22.

As shown in FIG. 21, the tapered tip 150*b* is formed in the pin body 150*a* of the pedal linking pin body 150. The pin body 150*a* is placed laterally inside the first rising member 110 so as to be movable laterally and when the long hole 129*e* of the columnar body 129*b* of the internal locking pin pushing portion 129 is positioned on the outer side, no pressing force acts on the bar body 150*c* and so the tapered tip 150*b* is positioned inside the first rising member 110 due to the action of the spring 150*d* wound around the pin body 150*a*.

At this point, as shown in FIG. 22, the rolling member 129*d* of the internal locking pin pushing portion 129 does not go up onto the side protruding plate 118*b* of the guide member 118 and also, as shown in FIG. 23, the tapered protruding surface 125*a* of the L-shaped body 125 does not push up the rolling member 129*d*. Therefore, as shown in FIG. 26, the upper end of the columnar body 129*b* of the internal locking pin pushing portion 129 rotates to the outer side.

On the other hand, when the long hole 129*e* and the tip sliding contact portion 129*f* of the internal locking pin pushing portion 129 rotates to the inner side after the rolling member 129*d* of the internal locking pin pushing portion 129 goes up onto the side protruding plate 118*b* of the guide member 118 or the tapered protruding surface 125*a* of the L-shaped body 125 pushes up the rolling member 129*d*, the bar body 150*c* and the first ring member 121 are pushed in.

When the bar body 150*c* is pushed in, the pin body 150*a* shown in FIG. 21 is displaced to the side of the rack 160 whose cross section is like sawteeth and the tip of the tapered tip 150*b* is protruded to the outside of the first rising member 110 so that the tapered tip is engaged with the rack 160.

When the pedal linking pin body 150 attempts to be displaced to the pedal side relative to the rack 160 whose cross section is like sawteeth, the displacement is controlled by the engagement, but when the pedal linking pin body 150 attempts to be displaced to the opposite side of the pedal, the tapered tip 150*b* is configured to be displaceable along the sawtooth inclined plane.

As shown in FIG. 24, the lock fitting 124 suspended from the tip of the horizontal portion 123*a* of the conversion fitting 123 is used for the lower locking portion to be locked onto or unlocked from the notch portion 118*c* of the guide member 118 and when the lower locking portion is locked between the notch portion 118*c* and a wall 115*q* set up on the top surface of the guide case 115*d*, the guide member 118 can no longer be displaced.

Unlocking of the lock fitting 124 from the notch portion 118*c* of the guide member 118 is realized by rotation of the conversion fitting 123, but is also realized when the brake pedal is stepped on. As shown in FIG. 25, the coupling member 128 is attached below the pillar body 114 fixed to the springing portion 111*b* of the first fitting 111 of the brake arm 104 and thus, the pillar body 114 rotates accompanying motion of the brake arm 104 to pull out the coupling member 128 and the horizontal member 127, thereby rotating the suspended member 126 diagonally to the front to rotate the conversion fitting 123.

FIG. 26 shows a state in which the long hole 129*e* of the columnar body 129*b* of the internal locking pin pushing portion 129 abuts on the bar body 150*c* and the tip sliding contact portion 129*f* of the columnar body 129*b* abuts on the first ring member 121.

Figure 27:
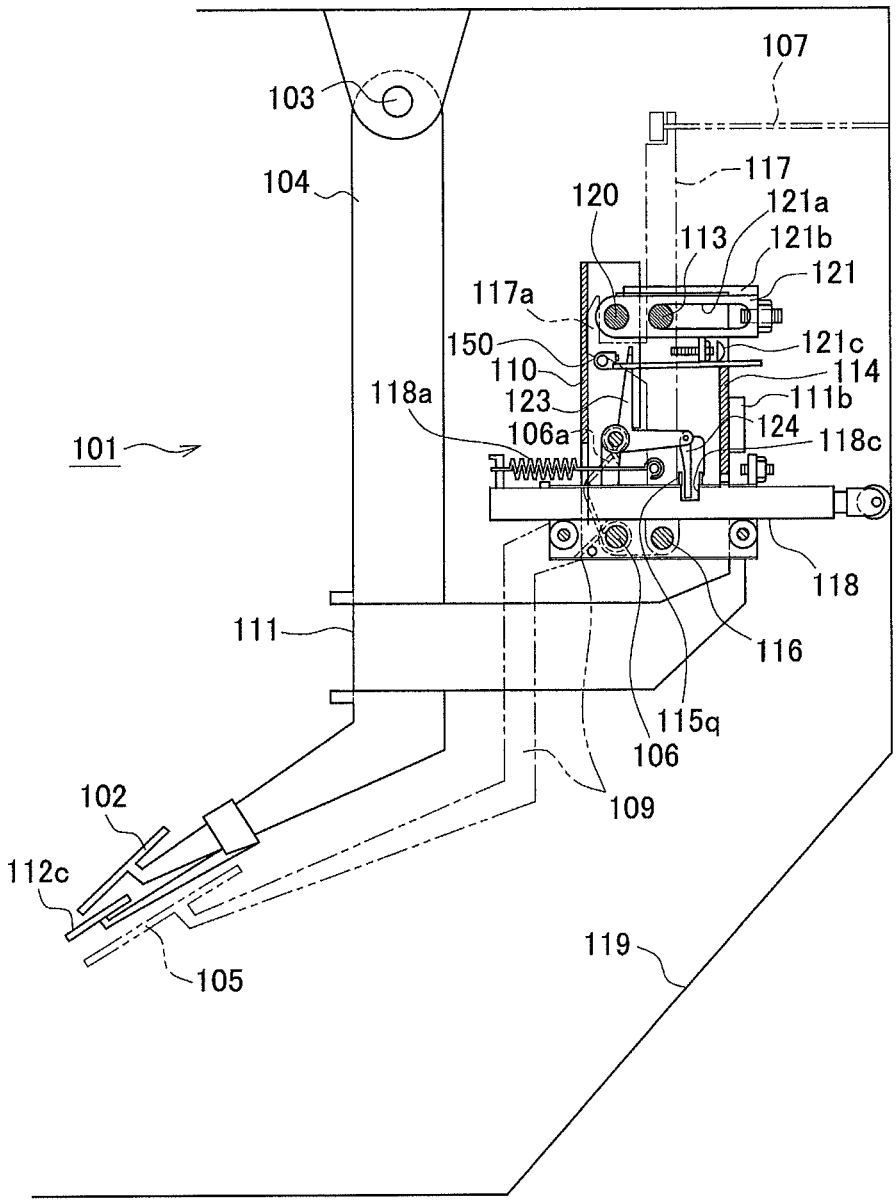
Figure 29:
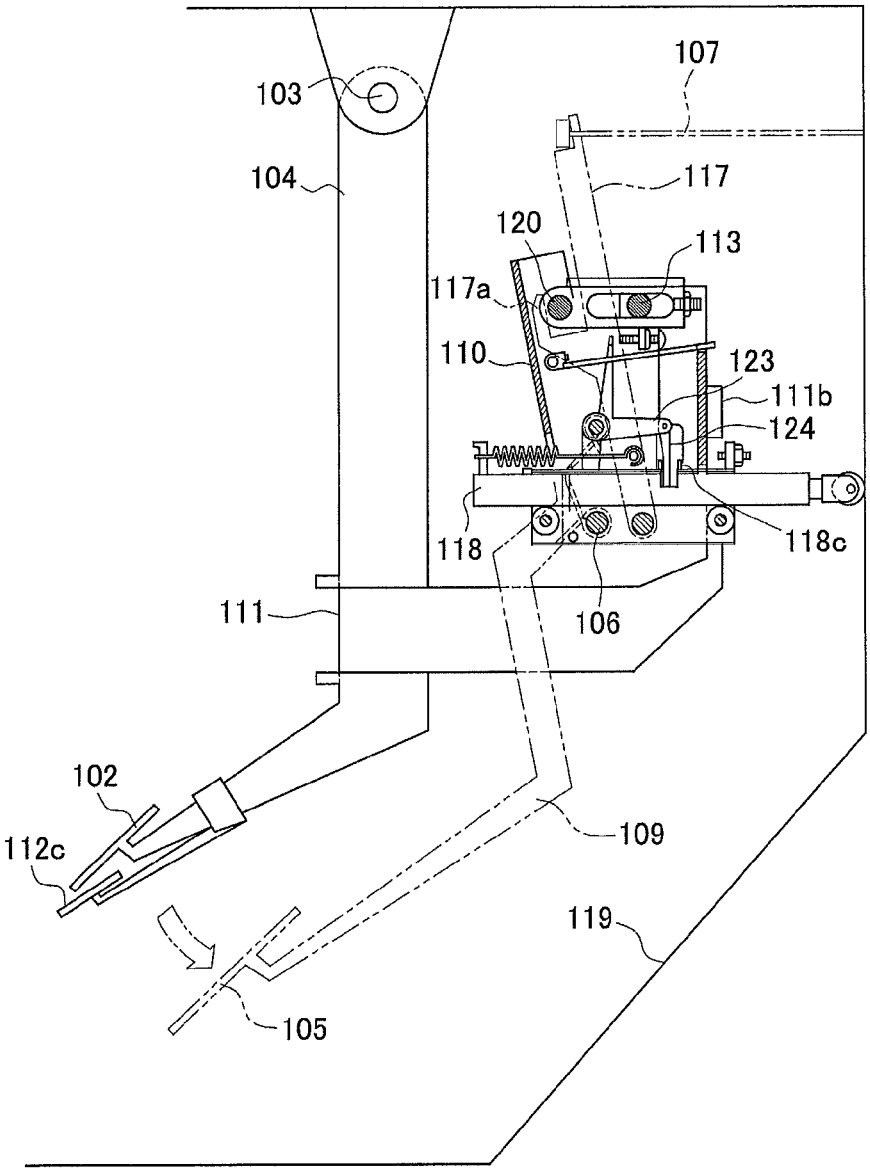
FIG. 29 is an outline side view of the accelerator pedal malfunction elimination apparatus when the accelerator pedal is stepped on within the normal range.
Figure 30:
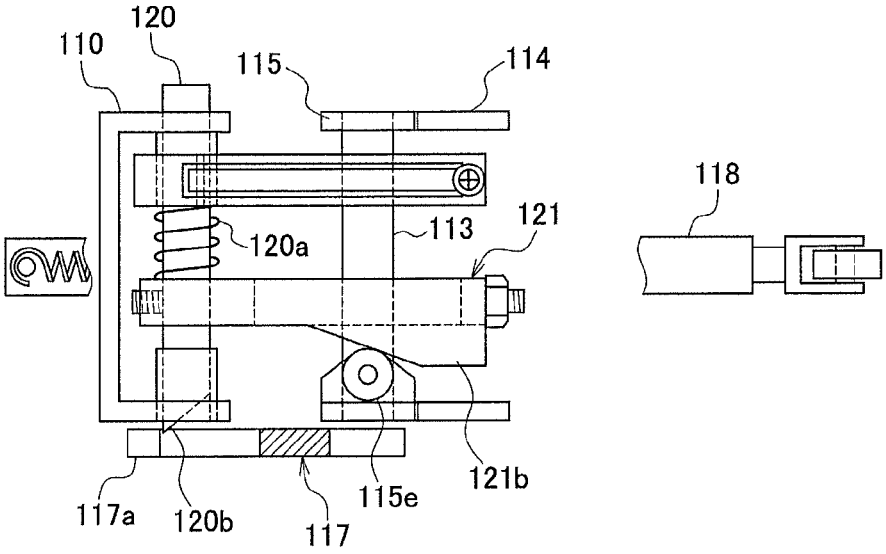
FIG. 30 is a plan view omitting a portion of the accelerator pedal malfunction elimination apparatus when the accelerator pedal is stepped on within the normal range.
Figure 31:
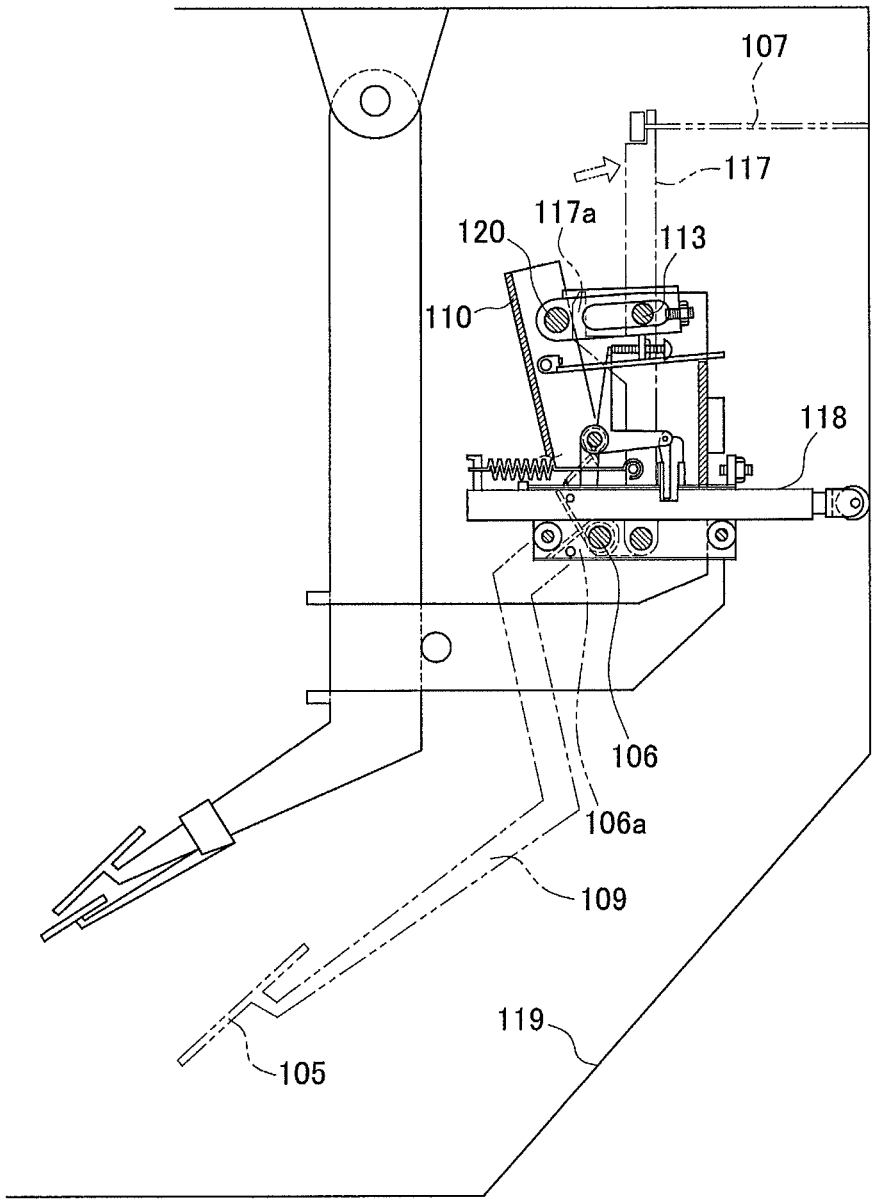
FIG. 31 is an outline side view of the accelerator pedal malfunction elimination apparatus when the accelerator pedal is stepped on by exceeding the normal range.
Figure 32:
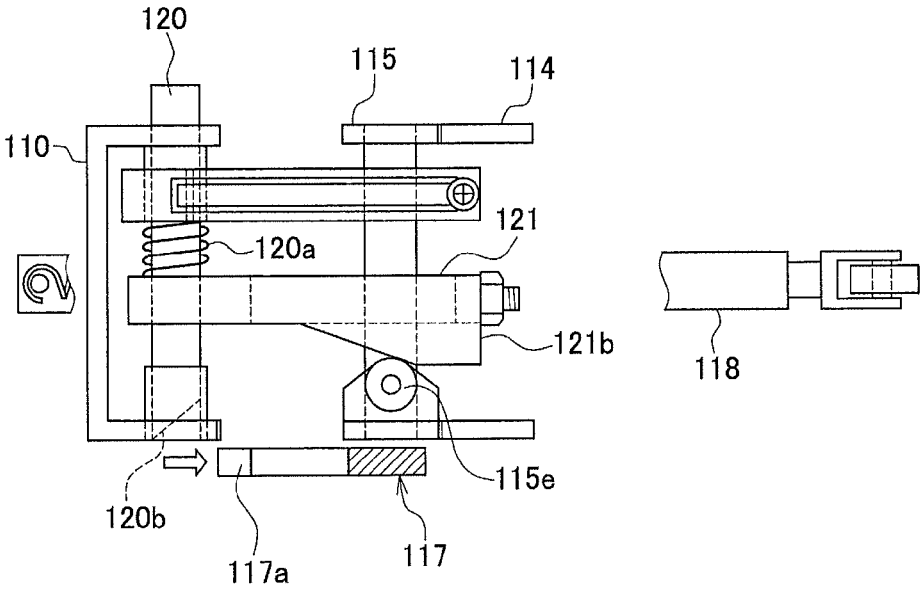
FIG. 32 is a plan view omitting a portion of the accelerator pedal malfunction elimination apparatus when the accelerator pedal is stepped on by exceeding the normal range.
Figure 33:
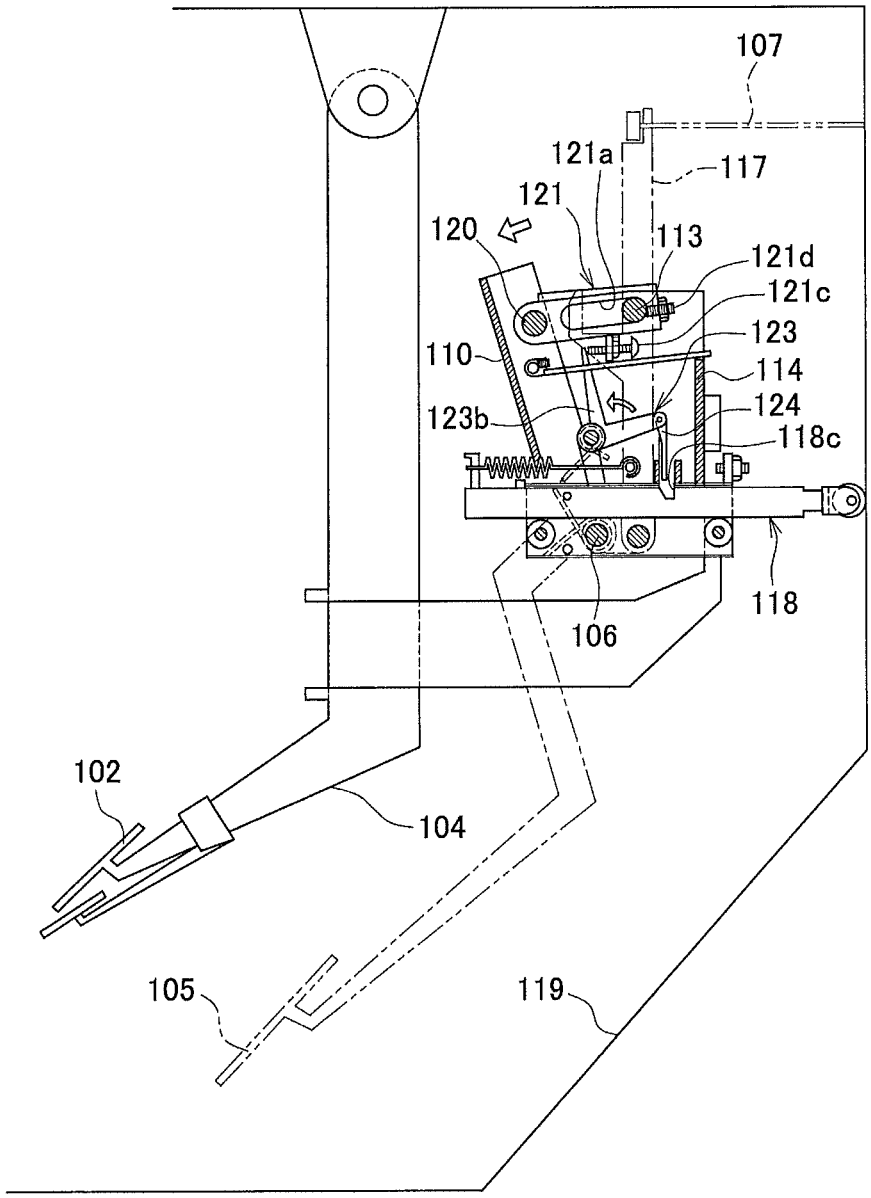
FIG. 33 is an outline side view of the accelerator pedal malfunction elimination apparatus when the accelerator pedal is stepped on up to an excessive range.
Figure 34:
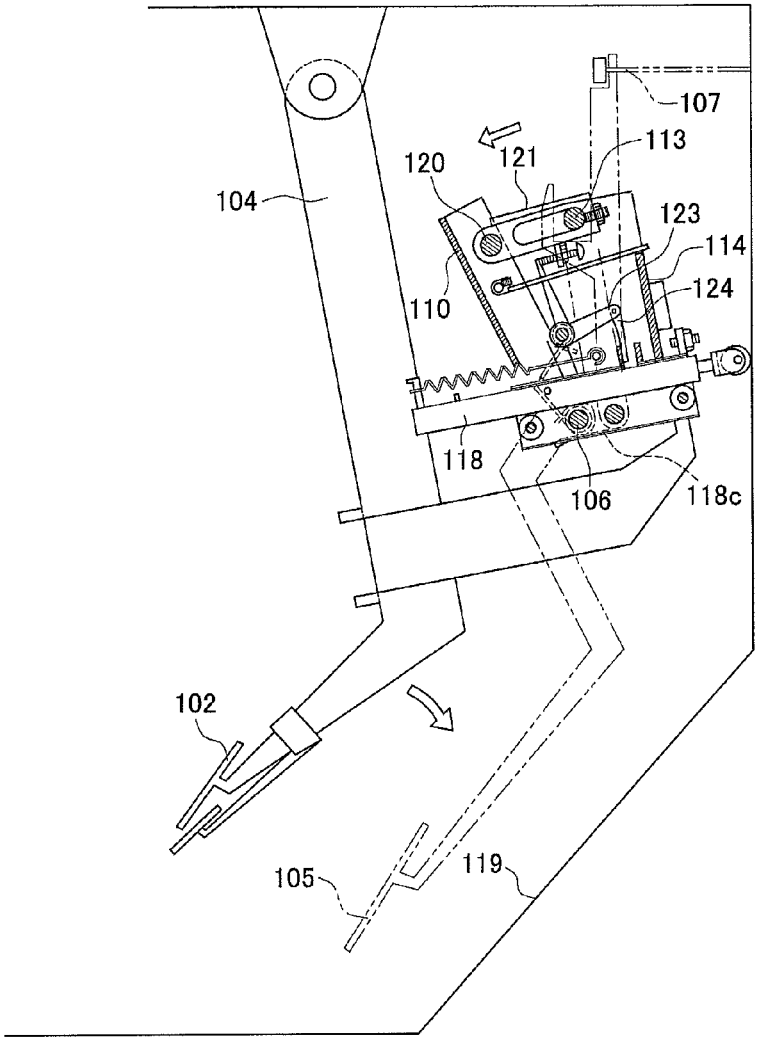
FIG. 34 is an outline side view of the accelerator pedal malfunction elimination apparatus when integrated with the brake pedal after the accelerator pedal being stepped on up to an excessive range.

Next, the action of the accelerator pedal malfunction elimination apparatus 101 when the accelerator pedal is stepped on will be described based on FIGS. 27 to 34. FIG. 27 is an outline side view of the accelerator pedal malfunction elimination apparatus before the accelerator pedal is stepped on, FIG. 28 is a plan view omitting a portion of the apparatus, FIG. 29 is an outline side view of the apparatus when the accelerator pedal is stepped on within the normal range, FIG. 30 is a plan view omitting a portion of the apparatus when the accelerator pedal is stepped on within the normal range, FIG. 31 is an outline side view of the apparatus when the accelerator pedal is stepped on by exceeding the normal range, FIG. 32 is a plan view omitting a portion of the apparatus when the accelerator pedal is stepped on by exceeding the normal range, FIG. 33 is an outline side view of the apparatus when the accelerator pedal is stepped on up to an excessive range, and FIG. 34 is an outline side view of the accelerator pedal malfunction elimination apparatus when integrated with the brake pedal after the accelerator pedal being stepped on up to an excessive range.

The conversion fitting 123, the lock fitting 124 linked thereto, and the guide member 118 are connected to the stepping force conversion suspended body 115 and, as shown in FIG. 27, the lower locking portion of the lock fitting 124 is locked onto the notch portion 118*c* of the guide member 118 before the accelerator pedal is stepped on.

Figure 28:
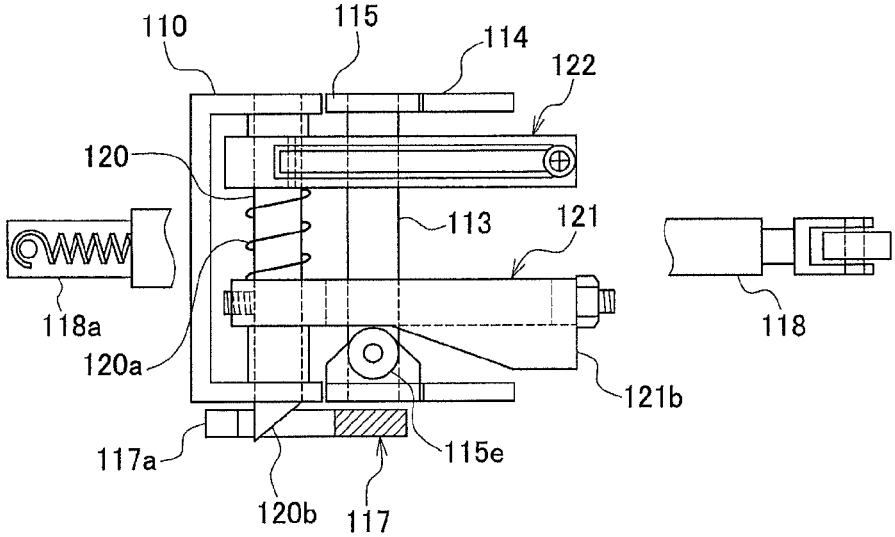

At this point, as shown in FIG. 28, the locking pin 120 inserted through the upper end of the first rising member 110 protrudes the pin tip 120*b* to the side of the second rising member 117 due to a pushing force of the spring 120*a* and the pin tip 120*b* is locked onto the linking claw 117*a* of the second rising member 117.

The pushing roller 115*e* provided in the top portion of the stepping force conversion suspended body 115 is in contact with the plate 121*b* of the first ring member 121 pressed by the spring 120*a*, but does not abut on the springing portion of the plate 121*b*.

If the accelerator pedal 105 is stepped on in this state, the stepping force conversion suspended body 115 is pushed to the side of the chassis 119 via the rocking fulcrum pin 106 and the wall 115*q* of the guide case 115*d* fixed to the stepping force conversion suspended body 115 abuts on the rear surface of a drooping portion of the lock fitting 124. The lock fitting 124 is in a state of being sandwiched between the notch portion 118*c* of the guide member 118 and the wall 115*q* of the stepping force conversion suspended body 115 and at this point, a load acts on the guide member 118 in the direction of the chassis 119, but the tip thereof abuts on the chassis 119 and cannot be displaced and the displacement of the lock fitting 124 is also suppressed.

Therefore, the displacement of the conversion fitting 123, the stepping force conversion suspended body 115, the pillar body 114, and the brake arm 104 is suppressed and the position of the rocking fulcrum pin 106 becomes immovable, thereby realizing, as shown in FIG. 29, rocking around the rocking fulcrum pin 106 of the first rising member 110.

Accordingly, because the pin tip 120*b* of the locking pin 120 of the first rising member 110 is locked onto the linking claw 117*a* of the second rising member 117, the first rising member 110 and the second rising member 117 rotate in synchronization after the accelerator pedal 105 being stepped on.

If the accelerator pedal 105 is stepped on up to the limit of the normal range, as shown in FIG. 30, the pin tip 120*b* is still locked onto the linking claw 117*a* and thus, the second rising member 117 can pull the accelerator wire 107 and normal start-up, starting, acceleration, and constant speed driving of a vehicle can be performed.

At this point, the interval between top portions of the first rising member 110 and the stepping force conversion suspended body 115 increases and thus, the pushing roller 115*e* is displaced in the direction of the springing portion of the plate 121*b* and gradually presses and displaces the first ring member 121 and the locking pin 120 against an elastic force of the spring 120*a*.

When the sliding contact of the pushing roller 115*e* proceeds close to the tip of the springing portion of the plate 121*b*, the pin tip 120*b* of the locking pin 120 sinks into the first rising member 110 and unlocking from the linking claw 117*a* occurs.

Details when the unlocking of both occurs will be described based on FIGS. 31 and 32. When unlocking of the pin tip 120*b* of the locking pin 120 from the linking claw 117*a* occurs, the second rising member 117 is brought back to its initial position by the tensile force of the accelerator wire 107 and stops supplying the fuel. Incidentally, unlocking of both does not occur within the normal stepping range of the accelerator pedal and the unlocking occurs only in a region close to the maximum stepping.

Then, if the accelerator pedal 105 is stopped being stepped on, the first rising member 110 is rotated in the direction of the initial position due to the action of the return spring 106*a* wound around the rocking fulcrum pin 106. When the interval between top portions of the first rising member 110 and the stepping force conversion suspended body 115 decreases and thus, the pushing roller 115*e* of the stepping force conversion suspended body 115 moves away from the springing portion of the plate 121*b* of the first ring member 121 and the locking pin 120 is energized by the spring 120*a* to protrude again to the outside of the first rising member 110.

When the pin tip 120*b* and the linking claw 117*a* are brought closer and the tapered portion abuts, the spring 22*a* is compressed again and the locking pin 120 is displaced to sink into the first rising member 110 and then, the locking pin 22 is protruded by being energized by the spring 120*a* and both are locked to shift to the initial state.

Incidentally, when an unexpected emergency occurs while driving a motor vehicle, the accelerator pedal 105 may further be stepped on without the brake pedal 102 being stepped on. If the accelerator pedal 105 is further stepped on after unlocking of the first rising member 110 and the second rising member 117 occurs, the first rising member 110 further rocks around the rocking fulcrum pin 106. Details at this point will be described based on FIGS. 33 and 34.

When the accelerator pedal 105 is stepped on and rocking of the first rising member 110 around the rocking fulcrum pin 106 increases, the blade pushing member 121*c* as a conversion fitting rotating member protruding from the lower portion of the first ring member 121 abuts on the tip of the blade rising portion 123*b* of the conversion fitting 123 to rotate the conversion fitting 123.

When the conversion fitting 123 rocks in synchronization with the first rising member 110, the conversion fitting 123 starts to rotate around the bearing 115*k* of the stepping force conversion suspended body 115 and lifts, as shown in FIG. 33, the lock fitting 124 to allow the lower locking portion to be unlocked from the notch portion 118*c* of the guide member 118 and no load acts on the guide member 118 in the direction of the chassis 119.

At this point, one inner surface of the long hole 121*a* of the first ring member 121 abuts on the suspension pin 113. The tip of an adjusting screw 121*d* provided at the rear end of the first ring member 121 protrudes from the one inner surface of the long hole 121*a* and a screw-in amount of the adjusting screw 121*d* is adjusted such that the tip abuts on the suspension pin 113 when the first rising member 110 rotates and unlocking of the accelerator linking member from the movable member occurs.

If the abutting state continues, the pedal linking mechanism acts and, as shown in FIG. 34, the first rising member 110, and the pillar body 114 and the brake arm 104 perform an integrated operation. That is, the brake pedal 102 is stepped on by the accelerator pedal 105 being further stepped on and the brake pedal 102 is stepped on in accordance with a force to step on the accelerator pedal 105 to achieve reliable braking.

At this point, one end of the guide member 118 slides on the surface of the chassis 119 by matching the motion of the first rising member 110, the stepping force conversion suspended body 115 and the like. The end may be configured to roll by providing a roller.

When stepping on the accelerator pedal 105 is stopped, the first rising member 110 is brought back to its initial position and thus, the connection of the first ring member 121 as a linking connection member and the suspension pin 113 is cut, the conversion fitting 123, the stepping force conversion suspended body 115, the pillar body 114, the brake arm 104, and the brake pedal 102 return to their initial positions and also the braking force decreases or disappears. The lock fitting 124 also descends and the lower locking portion abuts on the notch portion 118*c* of the guide member 118 to be locked, which suppresses displacement of the stepping force conversion suspended body 115 and the like.

Figure 35:
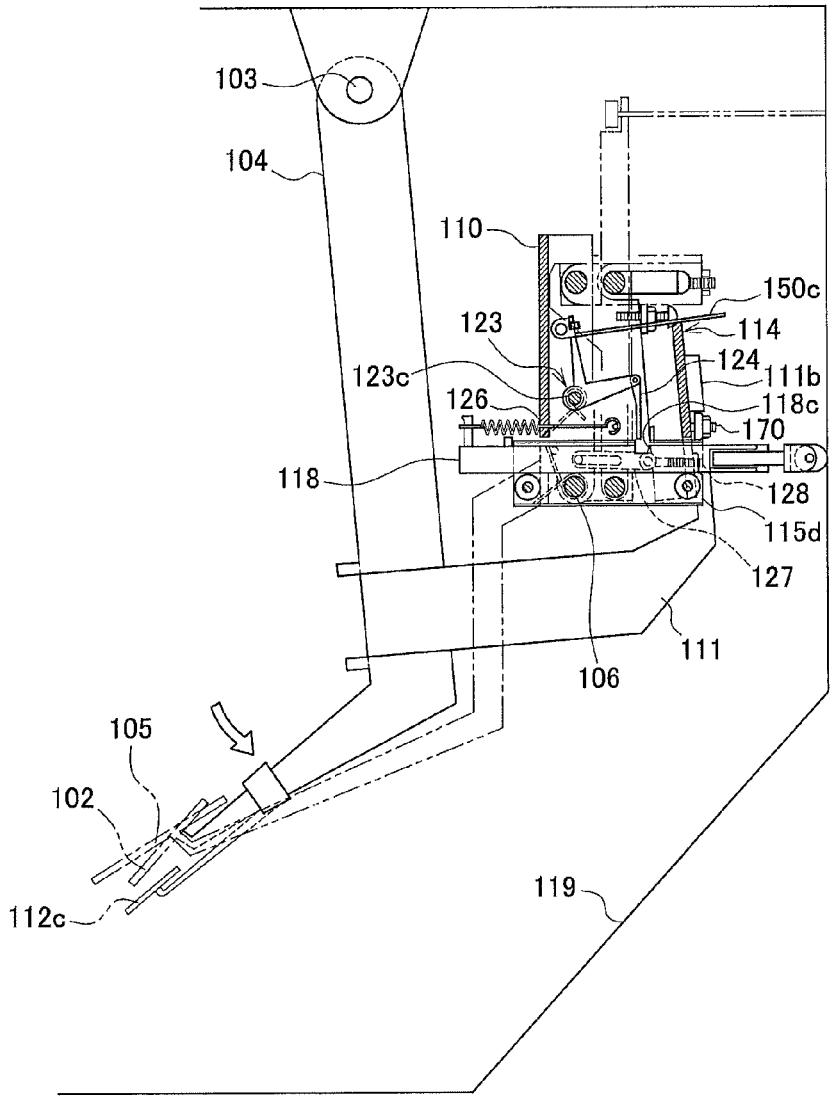
Figure 36:
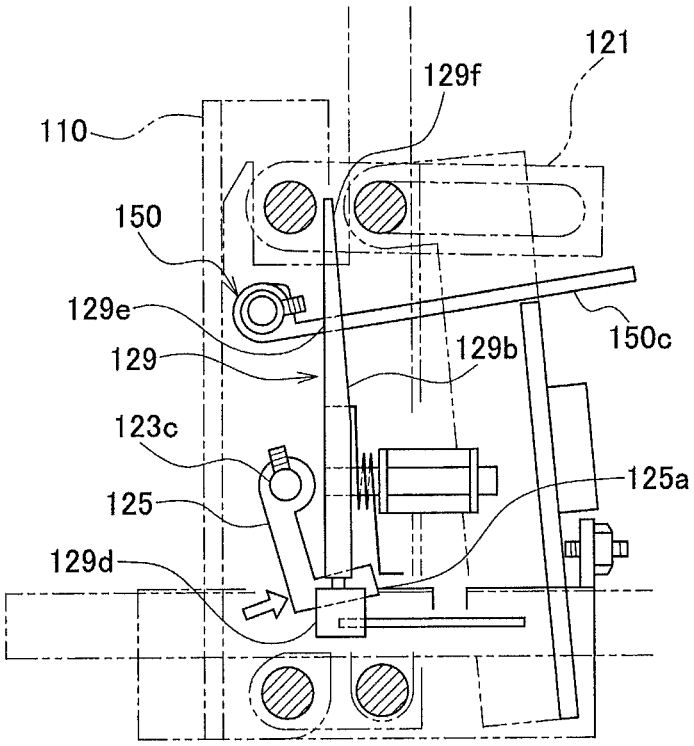
FIG. 36 is a side view showing an arrangement of internal locking pin pushing portions.
Figure 37:
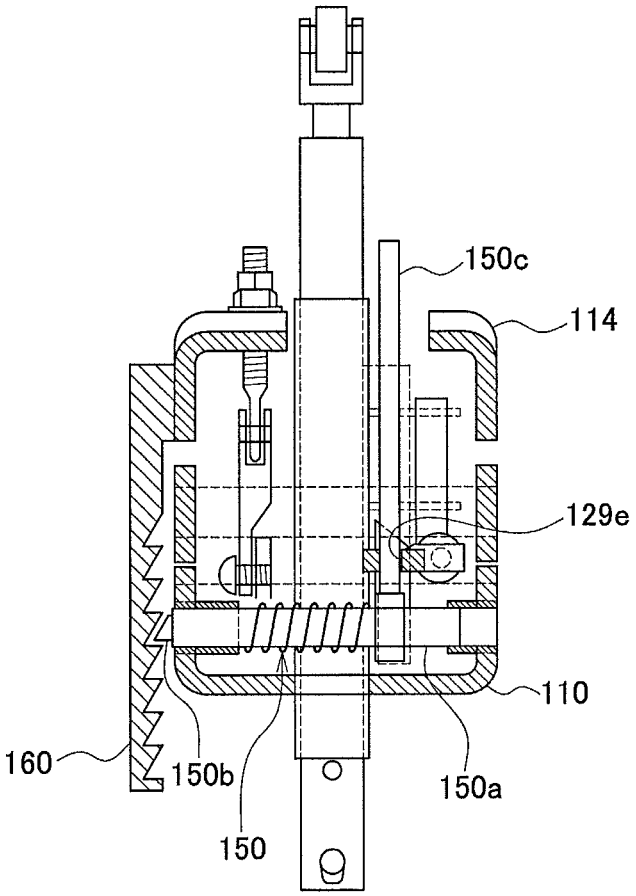
FIG. 37 is a plan view showing a relationship between a pedal linking pin body and a pillar body springing portion.
Figure 38:
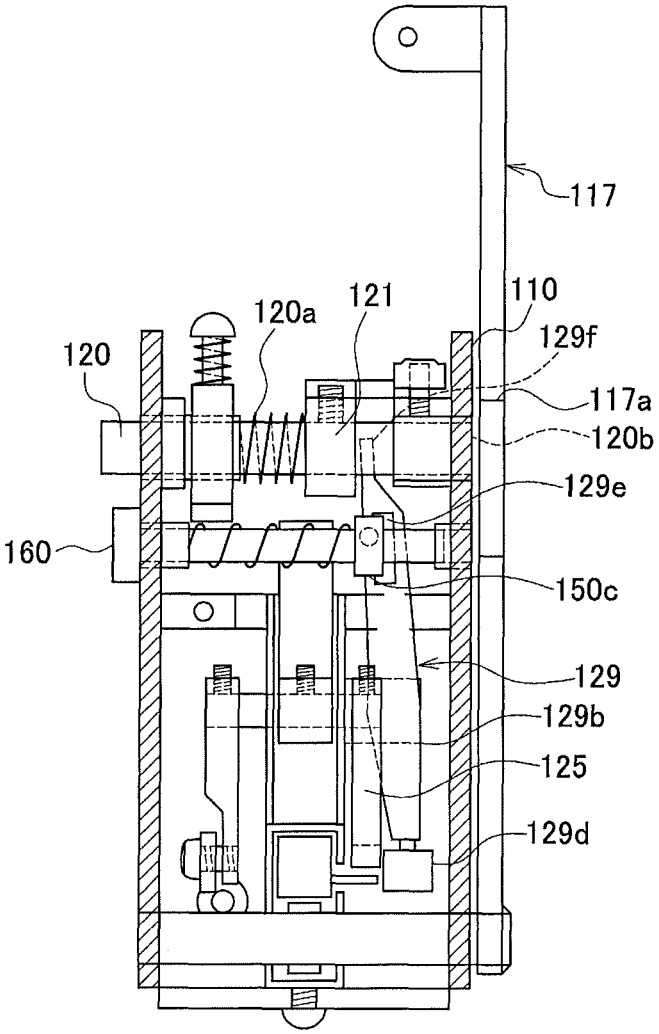
FIG. 38 is a front view showing a relationship among the internal locking pin pushing portion, the pedal linking pin body, and the pillar body springing portion.
Figure 39:
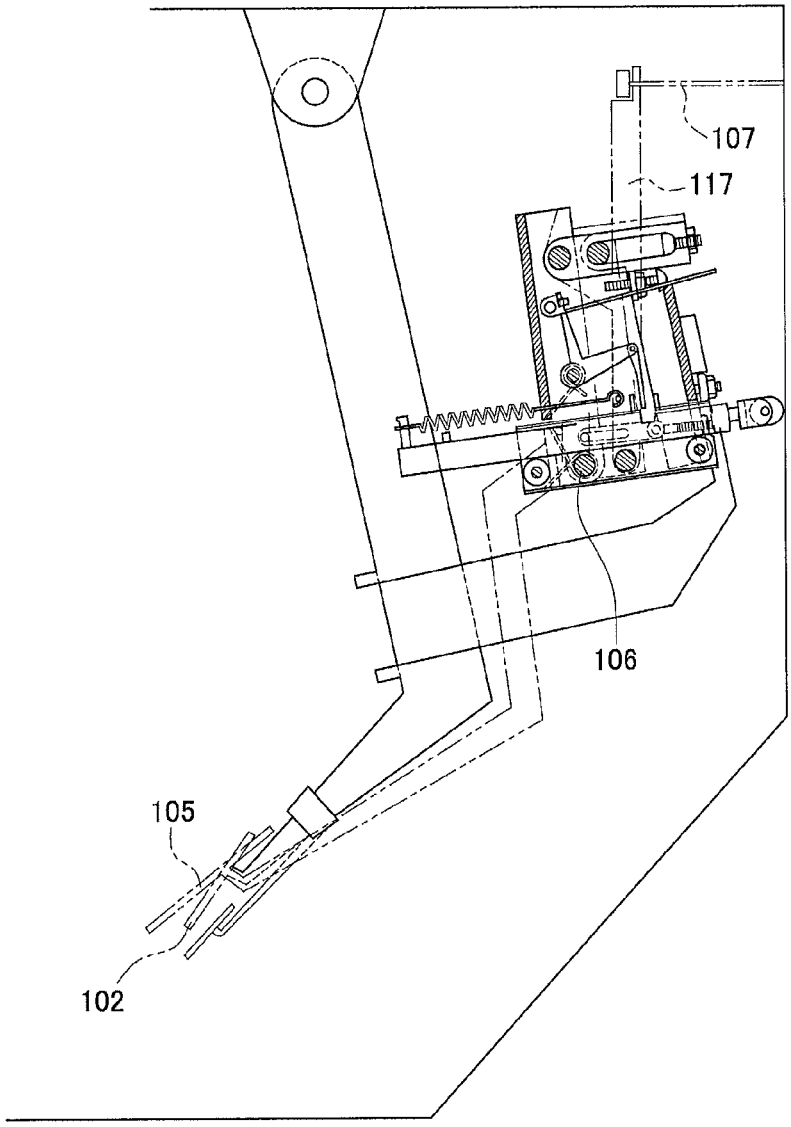

Next, details of the action when the brake pedal is stepped on will be described based on FIGS. 35 to 39. FIG. 35 is a sectional view showing the principal element side of the accelerator pedal stepping force transmission member of the accelerator pedal malfunction elimination apparatus immediately after the brake pedal is stepped on, FIG. 36 is a side view showing an arrangement of internal locking pin pushing portions, FIG. 37 is a plan view showing a relationship between a pedal linking pin body and a pillar body springing portion, FIG. 38 is a front view showing a relationship among the internal locking pin pushing portion, the pedal linking pin body, and the pillar body springing portion, and FIG. 39 is a sectional view showing the principal element side of the accelerator pedal stepping force transmission member of the accelerator pedal malfunction elimination apparatus after the brake pedal is stepped on.

When the brake pedal 102 is stepped on, as shown in FIG. 35, the brake arm 104, the fitting 111, and the pillar body 114 fixed to the springing portion 111*b* thereof rotate around the pivot 103. The coupling member 128 is attached below the pillar body 114 and thus, the pillar body 114 rotates accompanying motion of the brake arm 104 to pull out the coupling member 128 and the horizontal member 127, thereby rotating the suspended member 126 diagonally to the front to rotate the conversion fitting 123.

When the conversion fitting 123 rotates, the lock fitting 124 is lifted to allow the lower locking portion to be unlocked from the notch portion 118*c* of the guide member 118 and no load acts on the guide member 118 in the direction of the chassis 119. Therefore, the displacement of the guide member 118 becomes free.

If the brake pedal 102 is further stepped on, the lower rear surface of the pillar body 114 abuts on the stopper 170 provided at the rear end of the guide case 115*d*, which rotates the pillar body 114, the conversion fitting 123, the stepping force conversion suspended body 115 to which the guide case 115*d* is attached, and further the first rising member 110 at the same time when the brake pedal 102 is stepped on.

The rotary force when the brake pedal 102 is stepped on initially acts on the coupling member 128, but when the pillar body 114 abuts on the stopper 170 due to the displacement, the rotary force of the brake arm 104 and the pillar body 114 acts on the stepping force conversion suspended body 115 so that the concentration of load on the conversion fitting 123 can be avoided.

When the axis 123*c* fixing the conversion fitting 123 rotates, as shown in FIG. 36, the tapered protruding surface 125*a* of the L-shaped body 125 pushes up the rolling member 129*d* of the internal locking pin pushing portion 129. Thus, the tip of the columnar body 129*b* rotates to the inner side.

At this point, as shown in FIG. 37, the pin body 150*a* is displaced to the side of the rack 160 whose cross section is like sawteeth when the bar body 150*c* is pushed into the long hole 129*e* of the columnar body 129*b* and the tip of the tapered tip 150*b* protrudes to the outside of the first rising member 110 to engage the tapered tip with the rack 160.

The engagement synchronizes the rotation of the pillar body 114 and the first rising member 110 and the brake pedal 102 and the accelerator pedal 105 can be rotated at the same time. When the tip of the columnar body 129*b* rotates to the inner side, the tip sliding contact portion 129*f* presses and displaces the first ring member 121 and the locking pin 120 against an elastic force of the spring 120*a*. The pin tip 120*b* of the locking pin 120 sinks into the first rising member 110 and unlocking from the linking claw 117*a* occurs. When the unlocking of the pin tip 120*b* from the linking claw 117*a* occurs, the second rising member 117 is brought back to its initial position by the tensile force of the accelerator wire 107 and stops supplying the fuel.

This state is shown in FIG. 39. While the brake pedal 102 and the accelerator pedal 105 rotate in synchronization, the rotation is not around the rocking fulcrum pin 106 and the second rising member 117 is brought back to its initial position and thus, the accelerator wire 107 is not pulled and only the braking force of the brake acts.

Figure 40:
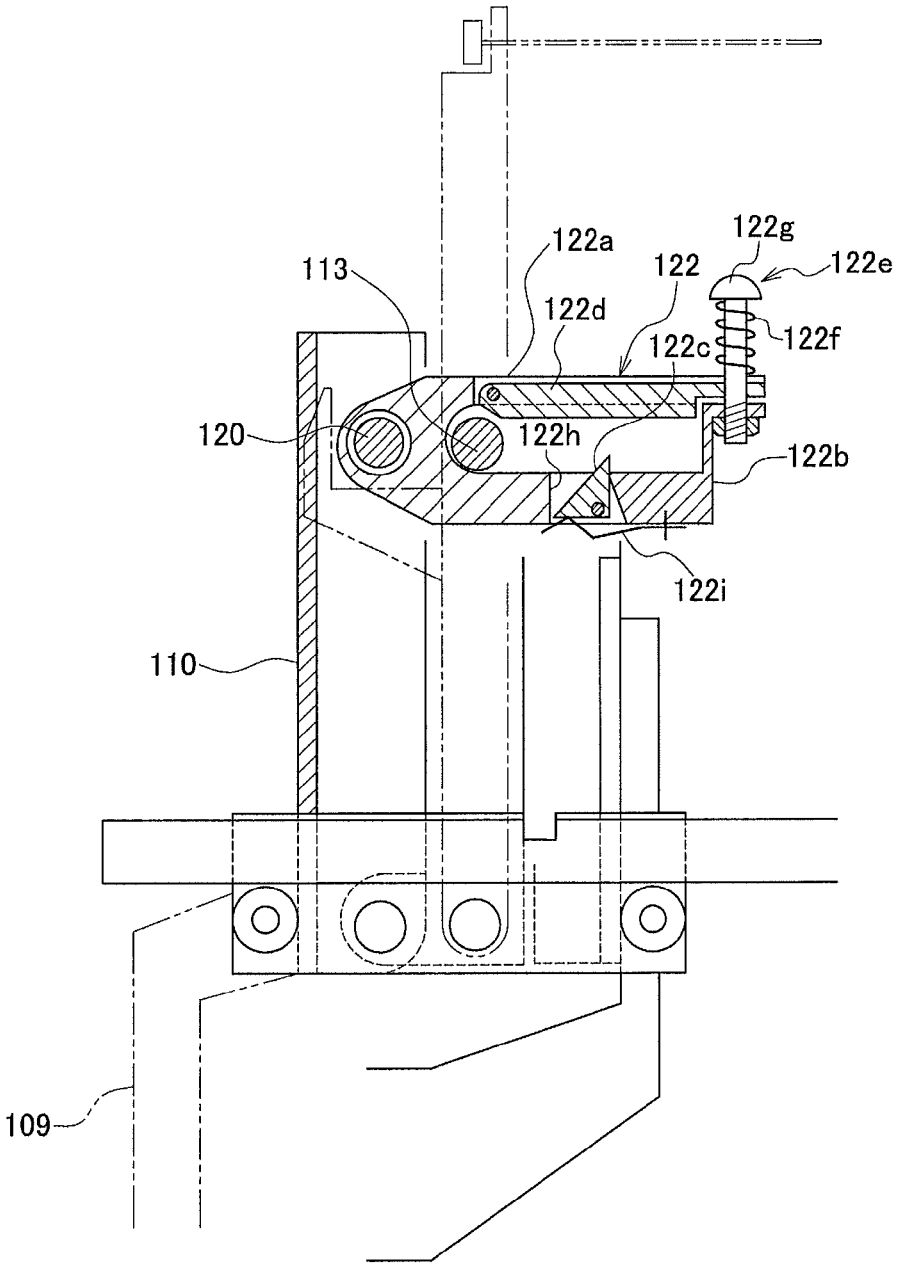
Figure 41:
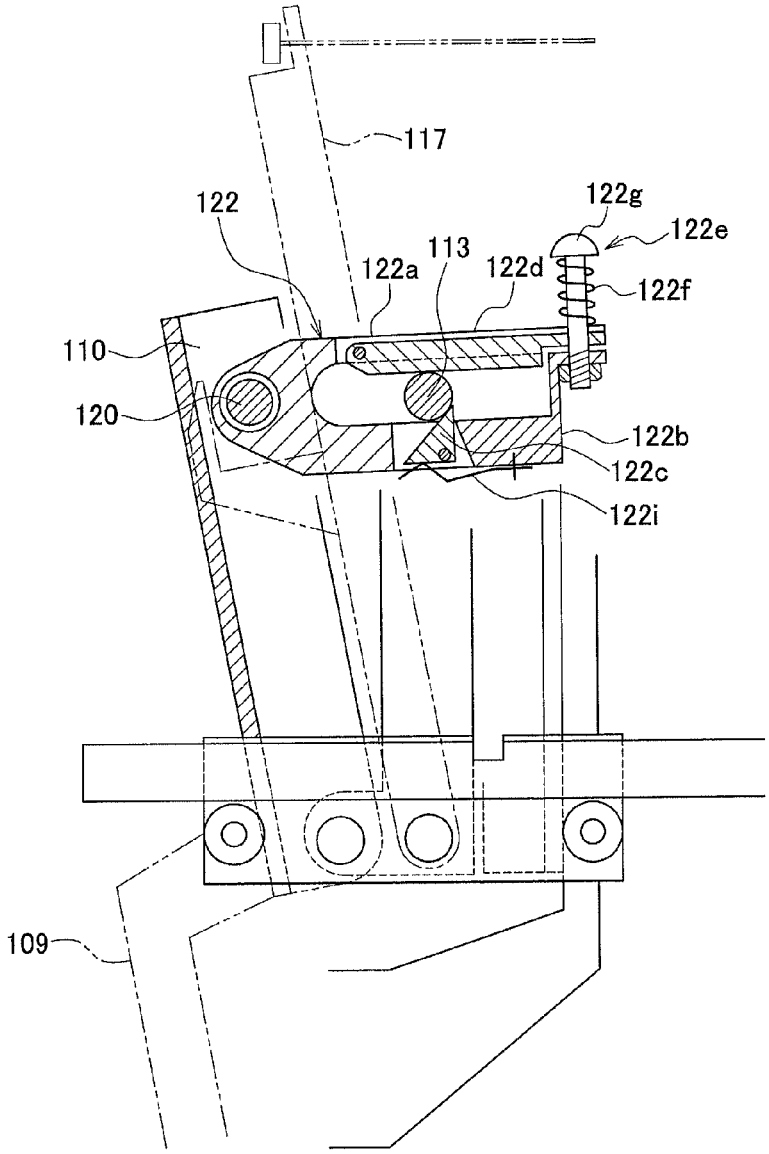
FIG. 41 is a sectional view showing the principal element side of the accelerator pedal stepping force adjusting ring when the accelerator pedal is stepped on within the normal range.
Figure 42:
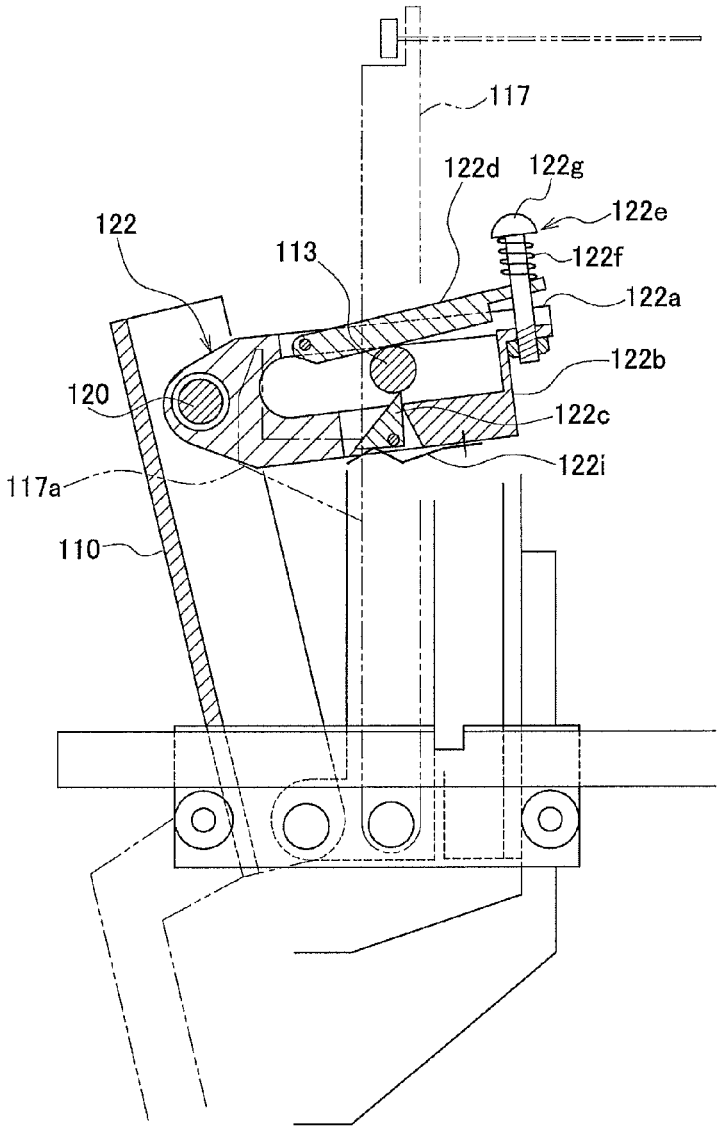
FIG. 42 is a sectional view showing the principal element side of the accelerator pedal stepping force adjusting ring when the accelerator pedal is stepped on by exceeding the normal range.
Figure 43:
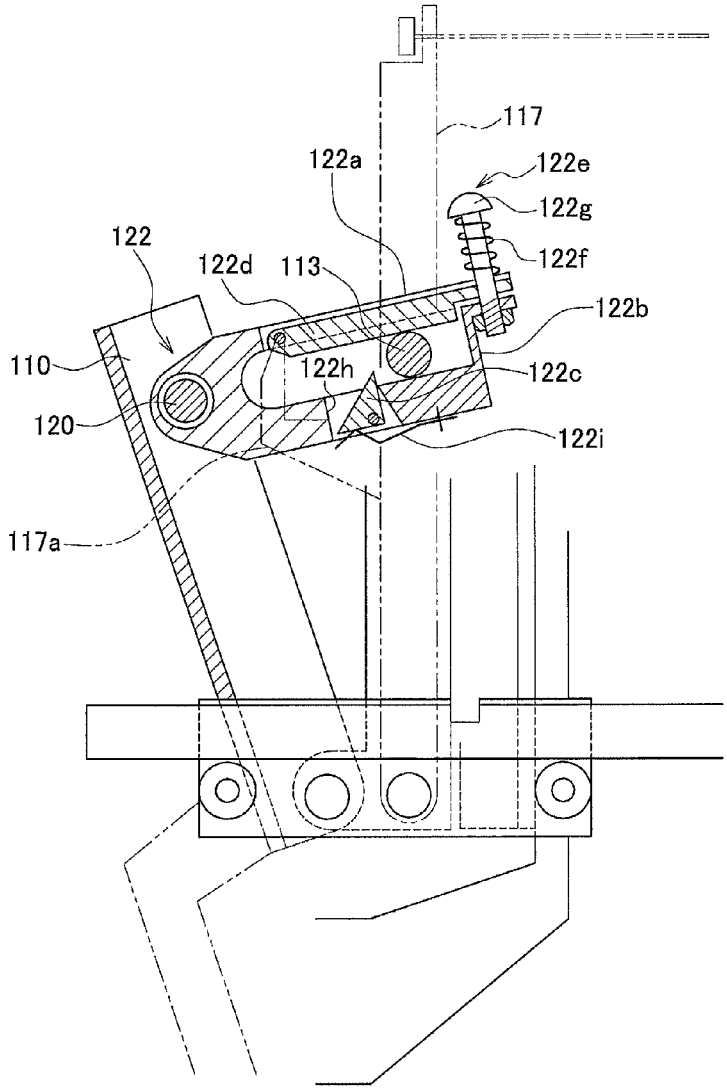
FIG. 43 is a sectional view showing the principal element side of the accelerator pedal stepping force adjusting ring when the accelerator pedal is kept on being stepped on by exceeding the normal range.
Figure 44:
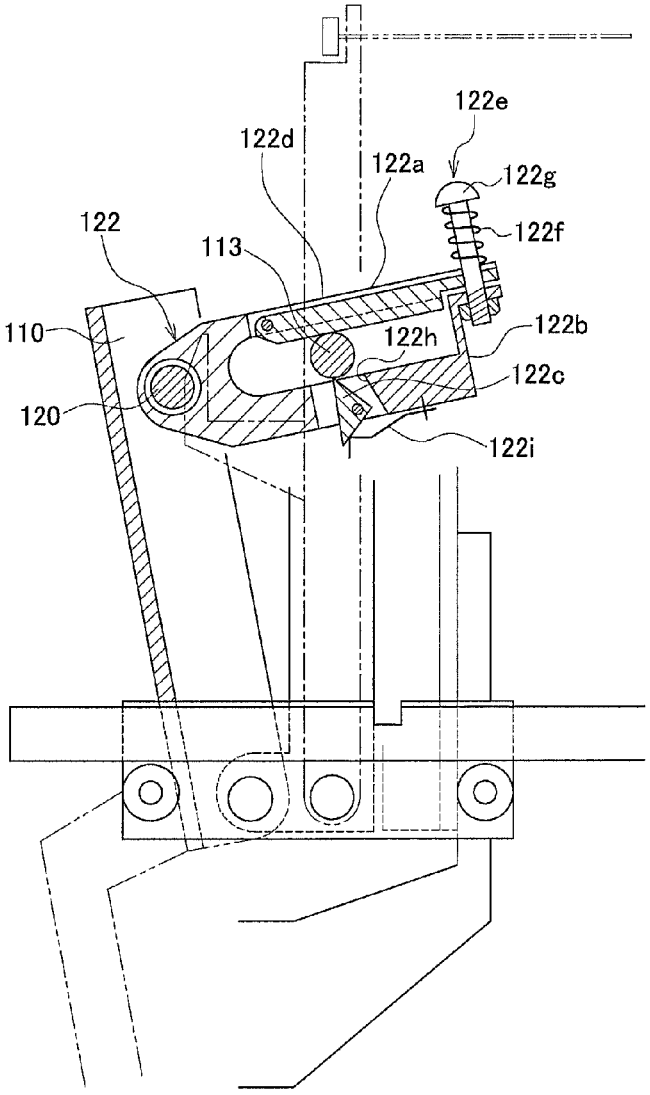
FIG. 44 is a sectional view showing the principal element side of the accelerator pedal stepping force adjusting ring after stopping stepping on the accelerator pedal.

Next, the action of the accelerator pedal stepping force adjusting ring will be described based on FIGS. 40 to 44. FIG. 40 is a sectional view showing the principal element side of an accelerator pedal stepping force adjusting ring before the accelerator pedal is stepped on, FIG. 41 is a sectional view when the accelerator pedal is stepped on within the normal range, FIG. 42 is a sectional view when the accelerator pedal is stepped on by exceeding the normal range, FIG. 43 is a sectional view when the accelerator pedal is kept on being stepped on by exceeding the normal range, and FIG. 44 is a sectional view after stopping stepping on the accelerator pedal.

The upper springing plate 122*a* of the accelerator pedal stepping force adjusting ring 122 includes two opposed plates and accommodates the adjusting plate 122*d* on the inner side thereof. The adjusting plate support plate 122*e* made of an adjusting screw 122*g* around which a coil spring 122*f* is wound is inserted through an outer end of the adjusting plate 122*d* and the tip of the adjusting screw 122*g* is screwed into the rear end of the lower springing plate 122*b*. An upward force of the adjusting plate 122*d* is changed by adjusting the height of screwing of the adjusting screw 122*g*.

The lower springing plate 122*b* is provided with a hole 122*h* in the intermediate portion thereof and accommodates the triangular cam 122*c* therein. The triangular cam 122*c* has a vertical angle protruding from the hole 122*h* and supports a lower outer vertical angle with a pin. A plate spring member 122*i* energizing upward abuts on the bottom surface of an inner vertical angle.

The outer side of the one vertical angle protruding from the hole 122*h* abuts on a hole wall surface. The relative position of the accelerator pedal stepping force adjusting ring 122 and the suspension pin 113 changes depending on the rocking angle of the rocking member 109 and when the accelerator pedal is stepped on, the relative position is displaced up to the position in FIG. 41 and the suspension pin 113 abuts on the triangular coma 122*c*. The abutting point is set immediately before unlocking of the first rising member 110 from the second rising member 117 occurs after the locking pin 120 being pushed in.

If the accelerator pedal is further stepped on, the triangular cam 122*c* cannot be displaced to the outer side and thus, the suspension pin 113 rises on an inclined plane of the triangular cam 122*c*. At this point, the suspension pin 113 abuts on the adjusting plate 122*d* on the top surface and pushes up the plate against the elastic force of the coil spring 122*f*. The resistance when pushed up becomes the resistance of the accelerator pedal so that an excessive stepping position of the accelerator pedal can be detected.

If, at this point, the accelerator pedal is further stepped on without loosening, as shown in FIG. 42, the suspension pin 113 is displaced and also the locking pin 120 is pushed in and the engagement with the linking claw 117*a* is thereby broken and unlocking of the first rising member 110 from the second rising member 117 occurs. When, as shown in FIG. 43, the suspension pin 113 is displaced to the front of the hole 122*h* after climbing the triangular cam 122*c*, pushup of the adjusting plate 122*d* disappears before returning to the initial position.

Then, if the accelerator pedal is eased up and the first rising member 110 is rotated in the direction of the initial position, as shown in FIG. 44, the suspension pin 113 runs in the opposite direction inside the accelerator pedal stepping force adjusting ring 122 and this time, rotates while pressing one vertical angle of the triangular cam 122*c* from the outer side to the inner side and pushing down the plate spring member 122*i*. Accordingly, the relative position of the accelerator pedal stepping force adjusting ring 122 and the suspension pin 113 returns to the initial position thereof.

The triangular cam 122*c* over which the suspension pin 113 have passed is rotated by the plate spring member 122*i* abutting on the inner vertical angle and the outer side of the one vertical angle protruding from the hole 122*h* is caused to abut on the hole wall surface to return to the initial position thereof.

Figure 45:
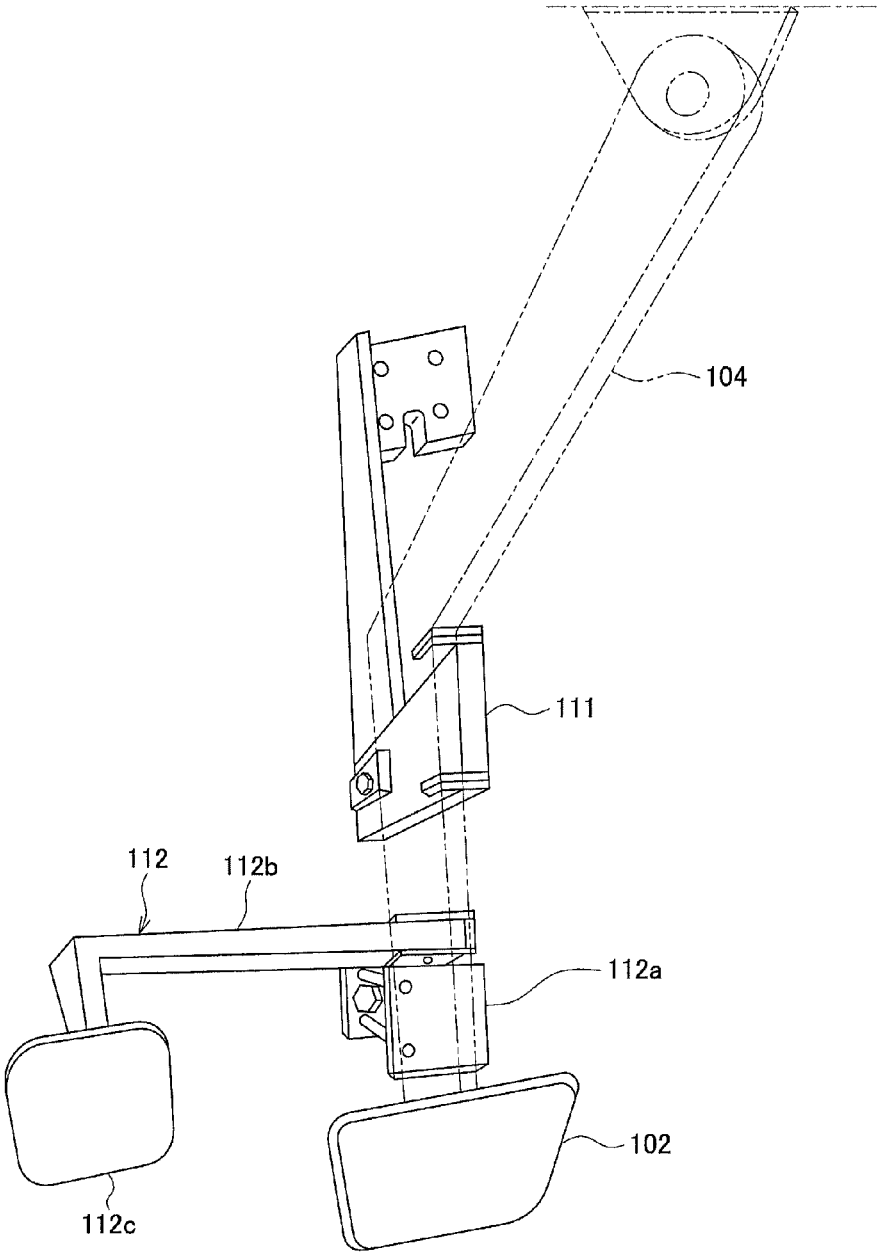
FIG. 45 is a perspective view of a brake pedal unit.

Next, the configuration of an auxiliary brake arm will be described based on FIG. 45. FIG. 45 is a perspective view of a brake pedal unit. The second fitting 112*a* removably fixed immediately above the brake pedal 102 is configured to be able to adjust the height of the auxiliary brake arm 112*b*. By installing the auxiliary brake pedal 112*c* fixed to the tip of the auxiliary brake arm 112*b* side by side with the brake pedal 102, a braking operation using both feet is made easier without the need to switch from the accelerator pedal.

By removably attaching a brake pedal for an emergency with a single operation in a clutch pedal position missing in a vehicle with automatic transmission as an optional function, accidents can be minimized or prevented because the vehicle can be stopped earlier by stepping on both of the brake and accelerator pedals in a stiff state of the whole body due to an unexpected panic. This includes an accelerator function extinguishing mechanism that, when both pedals are stepped on simultaneously, prevents the action of a stepping force of the accelerator pedal from reaching the accelerator wire.

Figure 46:
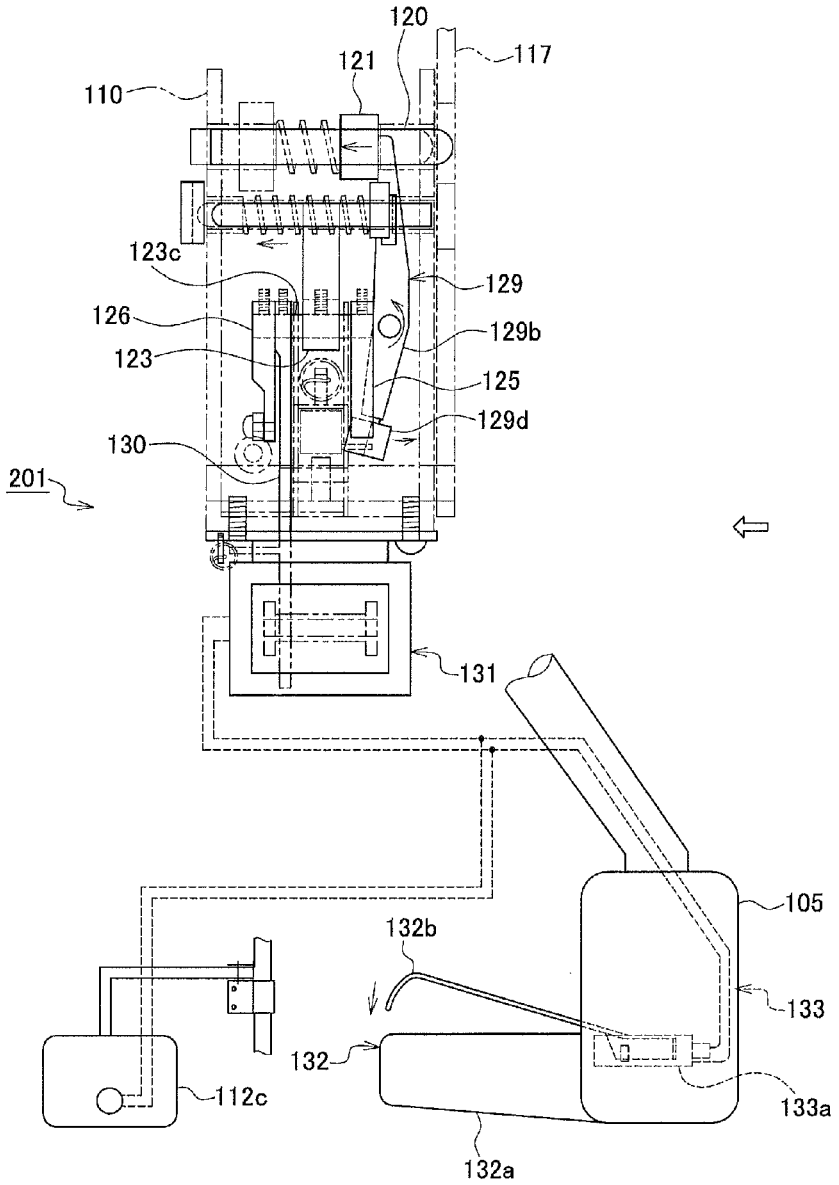
FIG. 46 is a schematic diagram showing principal elements of an accelerator pedal malfunction elimination apparatus in which an electric machinery operation circuit is connected to the accelerator pedal and an auxiliary brake pedal.
Figure 47:
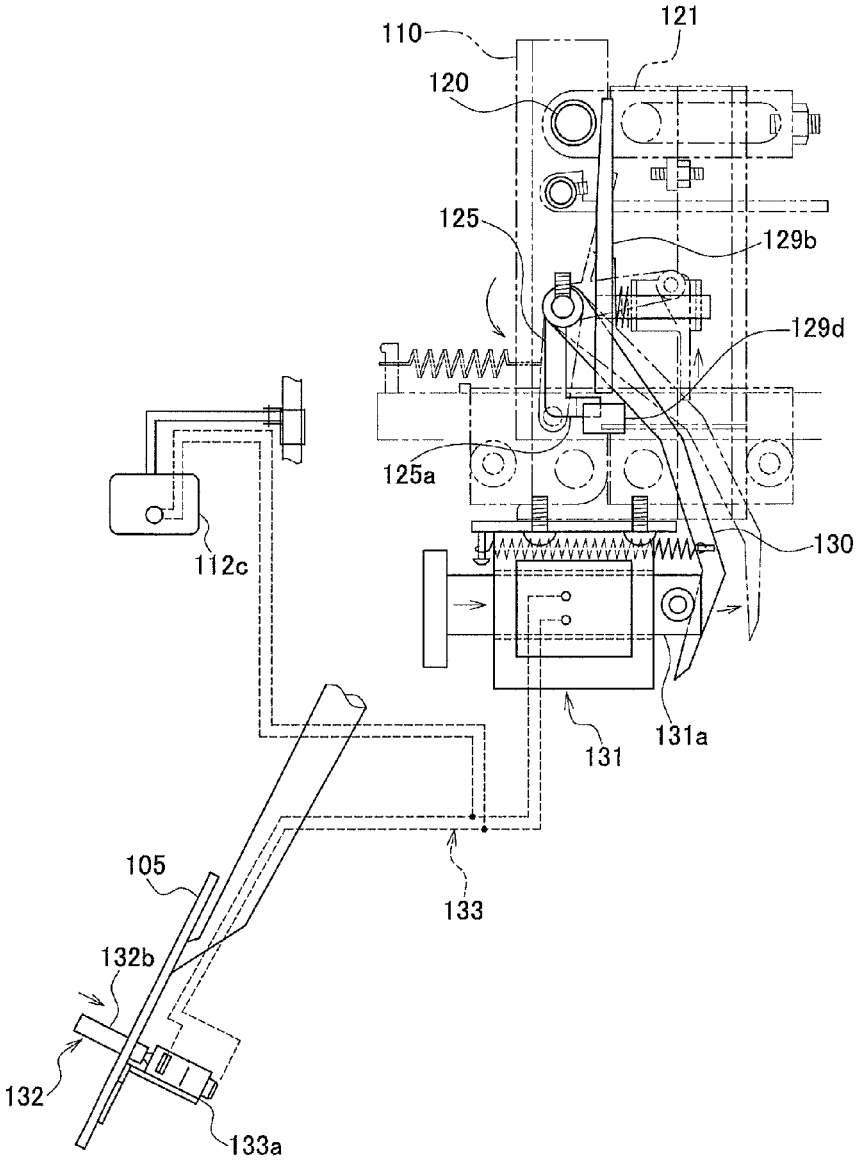
FIG. 47 is an arrowed view from an arrow direction in FIG. 46.

Next, an embodiment of the accelerator pedal malfunction elimination apparatus using an electric operation is shown in FIGS. 46 and 47. FIG. 46 is a schematic diagram showing principal elements of an accelerator pedal malfunction elimination apparatus in which an electric machinery operation circuit is connected to the accelerator pedal and an auxiliary brake pedal and FIG. 47 is an arrowed view from an arrow direction in FIG. 46.

An accelerator pedal malfunction elimination apparatus 201 in the embodiment includes, in addition to the L-shaped body 125 adjacent to a crossing portion of the conversion fitting 123 whose upper end is fixed to the axis 123*c* and having the tapered protruding surface 125*a* formed at the lower end, an arched body 130 installed side by side on the side of the suspended member 126.

The arched body 130 also has an upper portion fixed to the axis 123*c* and has a lower end abutting on a movable iron core 131*a* of a solenoid 131. The solenoid 131 is connected via a stepping operation unit 132 and an operation circuit 133 provided on the side of the accelerator pedal 105. The auxiliary brake pedal 112*c* is also provided with a second stepping operation unit, which is connected to the operation circuit 133. The second stepping operation unit operates when the auxiliary brake pedal 112*c* is depressed and always disables the accelerator pedal 105 during operation of the auxiliary brake pedal 112*c*.

The stepping operation unit 132 includes a foot place 132*a* springing out from the accelerator pedal 105 and a lever member 132*b* that can be operated by moving the foot and a switch 133*a* of the operation circuit 133 is turned on by displacement of the lever member 132*b* to push out the movable iron core 131*a* of the solenoid 131.

When the movable iron core 131*a* is pushed out, the arched body 130 rotates the conversion fitting 123 to cause the tapered protruding surface 125*a* of the L-shaped body 125 to abut on a rolling member 129*d* at the lower end of the columnar body 129*b* of the internal locking pin pushing portion 129, pushes in the first ring member 121, and also pushes in the locking pin 120 so that unlocking of the first rising member 110 from the second rising member 117 occurs.

The accelerator pedal malfunction elimination apparatus described above can stop a motor vehicle more swiftly and reliably than switching to step on a brake pedal based on the driver's intention of stopping the motor vehicle even if an accelerator pedal is erroneously stepped on and therefore, misstep accidents themselves will disappear.

Even when accelerating by stepping on the accelerator pedal, the accelerator function can be eliminated only by lightly stepping on the brake pedal with the left foot and the accelerator pedal being accelerated by the right foot is automatically switched to the brake pedal function and therefore, a motor vehicle can be stopped earlier by stepping on simultaneously with the accelerator pedal without the need to switch to step on the brake pedal so that accidents can be minimized or prevented.

When applied to existing common vehicles, the work is completed only by replacing the existing accelerator pedal and so can be completed in four to five minutes.

The accelerator pedal malfunction elimination apparatuses can easily be attached to existing common vehicles and will contribute to preventing motor vehicle accidents.

What is claimed is:

1. An accelerator pedal malfunction elimination apparatus comprising:

a brake arm having a brake pedal affixed to one end thereof and an opposite end thereof attached to a pivot for performing a braking operation by a rotary movement; an accelerator pedal stepping force transmission member comprising an acceleration pedal affixed to one end thereof, a fulcrum pin inserted into an intermediate portion of the acceleration pedal stopping force transmission member, an accelerator wire affixed to an opposite end of the accelerator pedal stepping force transmission member, an accelerator linking mechanism for transmitting a force generated by depressing the accelerator pedal to the accelerator wire and ceasing the transmission of the force generated by depressing the accelerator pedal to the accelerator wire when the accelerator pedal has been depressed past a specified point and a pedal linking mechanism for transmitting the force generated by depressing the accelerator pedal to the brake pedal after the accelerator pedal has been depressed past the specified point, wherein the brake arm has a bend formed therein and a fitting is provided on the brake arm adjacent to the bend and extends to a side of the accelerator pedal stepping force transmission member, a pillar body is affixed to the fitting, a suspension pin is laterally placed in an upper portion of the pillar body, a stepping force conversion suspended body rotatably suspended from the suspension pin and having the fulcrum pin placed laterally in a pedal side of a protruding portion which is formed at a lower end of the stepping force conversion suspended body, the accelerator pedal stepping force transmission member includes a first rising member rotatably attached to the fulcrum pin at the pedal side of the protruding portion, a return spring is attached to the first rising member to return the first rising member to an initial position when the accelerator pedal is released from a depressed position, a second rising member has a base end rotatably attached to the protruding portion of the stepping force conversion suspended body at a side opposite to the pedal side, the accelerator linking mechanism includes an accelerator linking member provided in an intermediate portion of the second rising member and a movable member attached to the first rising member for locking onto or unlocking from the accelerator linking member in accordance with a rotation angle of the first rising member and the pedal linking mechanism includes a guide member through which the stepping force conversion suspended body is inserted and an end of the guide member abuts a chassis wall, a linking connection member connecting the suspension pin and the first rising member to link both in accordance with the rotation angle of the first rising member, a conversion fitting is supported by a bearing provided in an intermediate portion of the stepping force conversion suspended body, a conversion fitting rotating member is capable of rotating the conversion fitting by abutting the conversion fitting when the linking connection member rotates and a lock fitting is rotatably suspended from the conversion fitting to allow a lower locking portion thereof to be locked onto or unlocked from a notch portion of the guide member.

2. The accelerator pedal malfunction elimination apparatus according to claim 1, wherein the guide member includes a spring supported displaceably with respect to the stepping force conversion suspended body and biased to a side of the chassis wall and has a tip portion that can be displaced while abutting a surface of the chassis wall.

3. The accelerator pedal malfunction elimination apparatus according to claim 2, wherein the accelerator linking mechanism includes the accelerator linking member having a linking claw protruding a side of the first rising member, the movable member including a locking pin capable of appearing and disappearing with respect to the linking claw by being biased in a direction of the linking claw, and a locking pin pushing portion capable of pressing and displacing the locking pin in accordance with the rotation angle of the first rising member.

4. The accelerator pedal malfunction elimination apparatus according to claim 3, wherein the pedal linking mechanism includes the linking connection member having a ring member with an end fixed to the locking pin and an elongated hole formed therein, the conversion fitting is provided with a crotch portion as a rotation stopper by accommodating the suspension pin to suppress rotation around the bearing, and the conversion fitting rotating member that inserts a brake pin which extends from an intermediate portion of the conversion fitting into the elongated hole and the locking pin pushing portion is formed in the ring member.

5. The accelerator pedal malfunction elimination apparatus according to claim 4, wherein the locking pin pushing portion comprises a bent portion forming a free end side of the ring member and an upper inner surface of the pillar body is capable of abutting the bent portion.

6. The accelerator pedal malfunction elimination apparatus according to claim 4, wherein the pillar body has a supporting plate including a horizontal portion and an inclined rising portion which extends downward and the lock fitting includes a leg capable of rolling on the supporting plate below the lower locking portion suspended from a lower end of the conversion fitting.

7. The accelerator pedal malfunction elimination apparatus according to claim 4, wherein the rotation stopper is a protruding body which extends to a side of a wall of the stepping force conversion suspended body and is capable of abutting the wall of a protruding portion at a lower end of the conversion fitting.

8. The accelerator pedal malfunction elimination apparatus according to claim 3, wherein the pedal linking mechanism includes the linking connection member having a first ring member having an end fixed to the locking pin and an elongated hole formed on the side of another end through which the suspension pin is inserted, the conversion fitting that biases an axis to which a crossing portion of a horizontal portion from whose tip the lock fitting is suspended and a blade rising portion set up at a rear end thereof is fixed to rotate in a direction of the notch portion of the guide member, and a conversion fitting rotating member including a blade pushing member extending from a lower portion of the first ring member and capable of abutting a tip of the blade rising portion, and the locking pin pushing portion is attached to the first ring member.

9. The accelerator pedal malfunction elimination apparatus according to claim 8, wherein the locking pin pushing portion includes an upper locking pin pushing portion including a springing portion formed on a free end side of the first ring member and an upper inner surface of the stepping force conversion suspended body capable of abutting on the springing portion and an internal locking pin pushing portion rotatably supports an axial body extending from an intermediate portion of a columnar body whose lower end is rollable with respect to a side protruding plate formed on the guide member and whose upper end is slidingly displaceable on the first ring member by the stepping force conversion suspended body, an elastic body biasing the upper end to rotate to an outer side being wound around the axial body.

10. The accelerator pedal malfunction elimination apparatus according to claim 9, wherein the internal locking pin pushing portion has an L-shaped body adjacent to a crossing portion of the conversion fitting whose upper end is fixed to the axis and having a tapered protruding surface formed at the lower end installed side by side and the tapered protruding surface abuts the lower end of the columnar body during rotation of the axis.

11. The accelerator pedal malfunction elimination apparatus according to claim 10, further comprising: an arched body having an upper portion fixed to the axis of the conversion fitting and a lower end abutting movable iron core of a solenoid; a stepping operation unit provided on a side of the accelerator pedal; and an operation circuit connecting the stepping operation unit and the solenoid.

12. The accelerator pedal malfunction elimination apparatus according to claim 11, wherein the brake arm includes an auxiliary brake arm attached immediately above the brake pedal and an auxiliary brake pedal installed side by side with the brake pedal by being fixed to a tip of the auxiliary brake arm.

13. The accelerator pedal malfunction elimination apparatus according to claim 10, wherein a coupling member in a tubular bar shape is attached to a lower portion of the pillar body, the conversion fitting has a suspended member adjacent to the crossing section whose upper end is fixed to the axis installed side by side, a horizontal member is connected to the lower end of the suspended member displaceably in a horizontal direction, and the horizontal member and the coupling member are linked.

14. The accelerator pedal malfunction elimination apparatus according to claim 8, wherein the stepping force conversion suspended body is provided with a stopper that abuts the pillar body on the side of the wall.

15. The accelerator pedal malfunction elimination apparatus according to claim 8, wherein the pillar body is provided with a springing portion having a sawtooth cross section on an upper side, a pedal linking pin body is laterally installed displaceably in an axial direction below the locking pin of the first rising member, an elastic body fixing bar body arranged in parallel on an outer side of the first ring member and biased to the side of the second rising member is wound around the pedal linking pin body, the bar body is inserted through an elongated hole provided in the columnar body of the internal locking pin pushing portion, and the pedal linking pin body forms a tapered tip capable of engaging with the springing portion having a sawtooth cross section and is displaceable along a sawtooth inclined plane of the springing portion.

16. The accelerator pedal malfunction elimination apparatus according to claim 3, wherein the accelerator linking mechanism forms an upper springing portion and a lower springing portion having the locking pin inserted through an end thereof and also the suspension pin inserted on the side of another end such that a crossing position can vary, a triangular cam capable of overstepping displacement by supporting the suspension pin when the suspension pin is displaced away from the locking pin and by rotation when the suspension pin is displaced closer to the locking pin is disposed in the lower springing portion, and the upper springing portion includes an adjusting plate pushed up when the locking pin is linked by a pin and the suspension pin oversteps by being supported by the triangular cam and an accelerator pedal stepping force adjusting ring including an elastic body holding an outer end of the adjusting plate while biasing to the side of the lower springing portion.

17. The accelerator pedal malfunction elimination apparatus according to claim 1, wherein the brake arm includes an auxiliary brake arm attached immediately above the brake pedal and an auxiliary brake pedal installed side by side with the brake pedal by being fixed to a tip of the auxiliary brake arm.

* * * * *